US009115550B2

(12) United States Patent
Robnett et al.

(10) Patent No.: US 9,115,550 B2
(45) Date of Patent: Aug. 25, 2015

(54) ROBOTIC DISASSEMBLY METHOD AT A WELL SITE

(76) Inventors: Kasia L. Robnett, Midland, TX (US); Frederic M. Newman, Midland, TX (US); Jonathan V. Huseman, Midland, TX (US); Victor D. Trotter, Fort Worth, TX (US); James B. Story, Highland Village, TX (US)

( * ) Notice: Subject to any disclaimer, the term of this patent is extended or adjusted under 35 U.S.C. 154(b) by 574 days.

(21) Appl. No.: 13/556,472

(22) Filed: Jul. 24, 2012

(65) Prior Publication Data

US 2013/0269952 A1 Oct. 17, 2013

Related U.S. Application Data

(60) Provisional application No. 61/624,273, filed on Apr. 14, 2012.

(51) Int. Cl.
*E21B 19/20* (2006.01)
*E21B 19/15* (2006.01)

(52) U.S. Cl.
CPC ..... *E21B 19/20* (2013.01); *E21B 19/155* (2013.01)

(58) Field of Classification Search
CPC ..... E21B 19/00; E21B 19/16; E21B 19/18; E21B 15/00
USPC ..... 166/377, 381, 77.51, 85.1
See application file for complete search history.

(56) References Cited

U.S. PATENT DOCUMENTS 2,477,359 A * 7/1949 Barksdale ..... 91/50
4,604,724 A 8/1986 Shaginian et al.
4,765,401 A 8/1988 Boyadjieff
4,901,805 A 2/1990 Ali-Zade et al.
5,266,756 A * 11/1993 Hatano ..... 187/285
5,711,382 A * 1/1998 Hansen et al. ..... 175/52
5,988,299 A 11/1999 Hansen et al.
6,695,559 B1 * 2/2004 Pietras ..... 414/22.57
6,788,190 B2 * 9/2004 Bishop ..... 340/435
6,860,337 B1 3/2005 Orr et al.
6,994,171 B2 2/2006 Orr et al.
7,290,621 B2 11/2007 Orr et al.
7,293,607 B2 11/2007 Lambert et al.
7,303,021 B2 12/2007 Schats et al.
7,350,587 B2 4/2008 Springett et al.
7,546,869 B2 6/2009 Lambert et al.

(Continued)

OTHER PUBLICATIONS

Flexrig; Helmerich & Payne, Inc.; company website posted online at http://www.hpinc; numerous pages having published copyright date of 2007.

Titan; Tour of Tatan's FlexRig 4 Drilling Rig; YouTube video segments 1-8; Nov. 21, 2010; representative example url of http://www.youtube.com/watch?v=afv23NyewDE.

(Continued)

*Primary Examiner* — William P Neuder
*Assistant Examiner* — Ronald Runyan
(74) *Attorney, Agent, or Firm* — www.bobharter.com; Robert J. Harter

(57) ABSTRACT

An example robotic method for disassembling and removing a well string (e.g., a string of sucker rods or tubing within a wellbore) involves a computer controlled track and trolley system. Movement of multiple trolleys, carriages, shuttles, articulated arms and other hardware is orchestrated in a manner that minimizes cycle time and thus reduces the overall time for removing the entire well string. In some examples, upper and lower robots travel along and share a first set of tracks while an upper trolley mechanism and a main trolley travel along and share a second set of tracks. In some examples, the two sets of tracks are mounted vertically to a mast, wherein the mast is part of a workover vehicle.

18 Claims, 100 Drawing Sheets

(56) References Cited

U.S. PATENT DOCUMENTS

| | | | |
|---|---|---|---|
| 8,006,751 | B2 | 8/2011 | Lambert et al. |
| 2010/0329823 | A1 | 12/2010 | Baumler et al. |
| 2011/0188973 | A1 | 8/2011 | Baumler |

OTHER PUBLICATIONS

Williams; Williams Companies Flex Rig 4 Natural Gas Drilling Rig; Animation posted on YouTube; Jan. 17, 2012; posted online at http://www.youtube.com/watch?v=8jhesVOUZpU.

* cited by examiner

FIG. 27
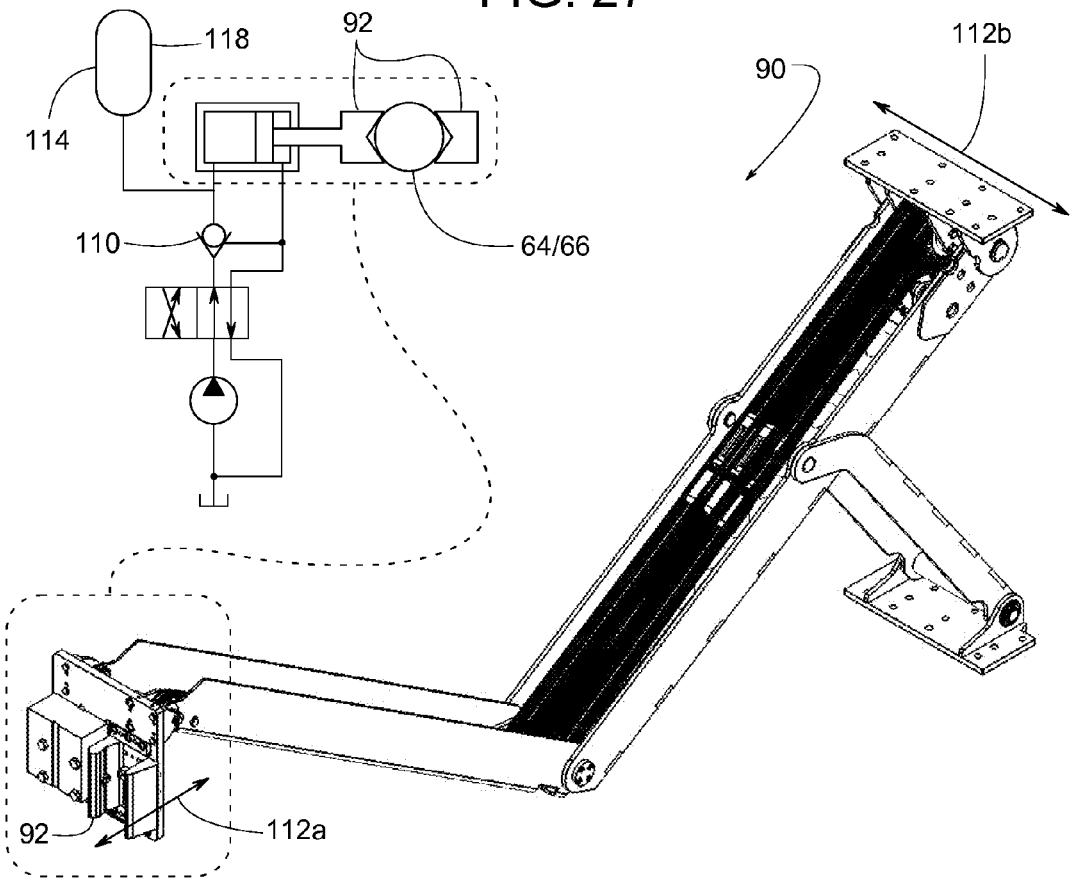
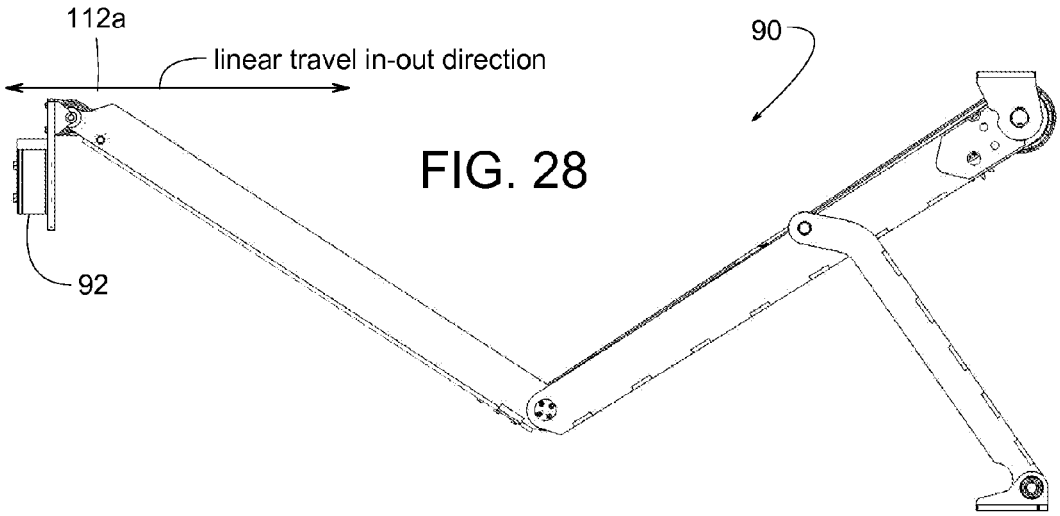
FIG. 28

Rods POOH (PULLING OUT OF HOLE)

Note: It is assumed that the emtpy elevator lowers at 6 ft/s

Rods RIH (RUNNING IN HOLE)

Tubing POOH (PULL OUT OF HOLE)

Tubing RIH (RUNNING IN HOLE)

ROBOTIC DISASSEMBLY METHOD AT A WELL SITE

CROSS REFERENCE TO RELATED APPLICATIONS

This application claims the benefit of provisional patent application Ser. No. 61/624,273 filed on Apr. 14, 2012.

FIELD OF THE INVENTION

The subject invention generally pertains to workover vehicles for servicing well bores and more specifically to a method for removing well strings.

BACKGROUND

Drilling rigs are used for drilling new wells, and workover units typically are for servicing or repairing completed wells. Drilling rigs usually comprise a broad range of equipment that is assembled and set up in a modular manner at a well site. Workover units, on the other hand, comprise a generally self-contained vehicle carrying various components. After traveling to a well site, the workover vehicle is reconfigured for use.

BRIEF DESCRIPTION OF THE DRAWINGS

FIGS. 27-33 pertain to the upper robot 90.

FIG. 27 is a perspective view of the articulated arm portion of the upper robot, wherein the arm portion is shown extended.

FIG. 28 is a side view of FIG. 27.

FIG. 29 is a bottom view of FIG. 27.

FIG. 30 is a back view of FIG. 27.

FIG. 31 is a perspective view similar to FIG. 27 but showing the arm portion of the upper robot retracted.

FIG. 32 is a side view of FIG. 31.

FIG. 33 is a top view of FIG. 31.

FIG. 34 is a front view of the articulated arm portion of the lower robot, wherein the arm portion is extended. The end effectors of the upper and lower robots 90 and 36 are controlled to travel horizontally generally in unison.

FIG. 35 is a bottom view of FIG. 34.

FIG. 36 is a back view of FIG. 34.

FIG. 37 is a perspective view of FIG. 34.

FIG. 38 is a side view of FIG. 34.

FIG. 39 is a top view of FIG. 34.

FIG. 40 is a front view similar to FIG. 34 but showing the arm portion of the lower robot retracted.

FIG. 41 is a top view of FIG. 40, which is similar to FIG. 39 but with the arm portion of the lower robot retracted.

FIG. 42 is a back view of FIG. 40.

FIG. 43 is a perspective view of the articulated arm portion of the lower robot.

FIG. 44 is a side view of FIG. 43.

FIG. 45 is a bottom view of FIG. 43.

FIG. 69 shows elevator 106 in its lowermost position.

FIG. 90B is a schematic right end view of FIG. 90A.

DETAILED DESCRIPTION

Figure 1:
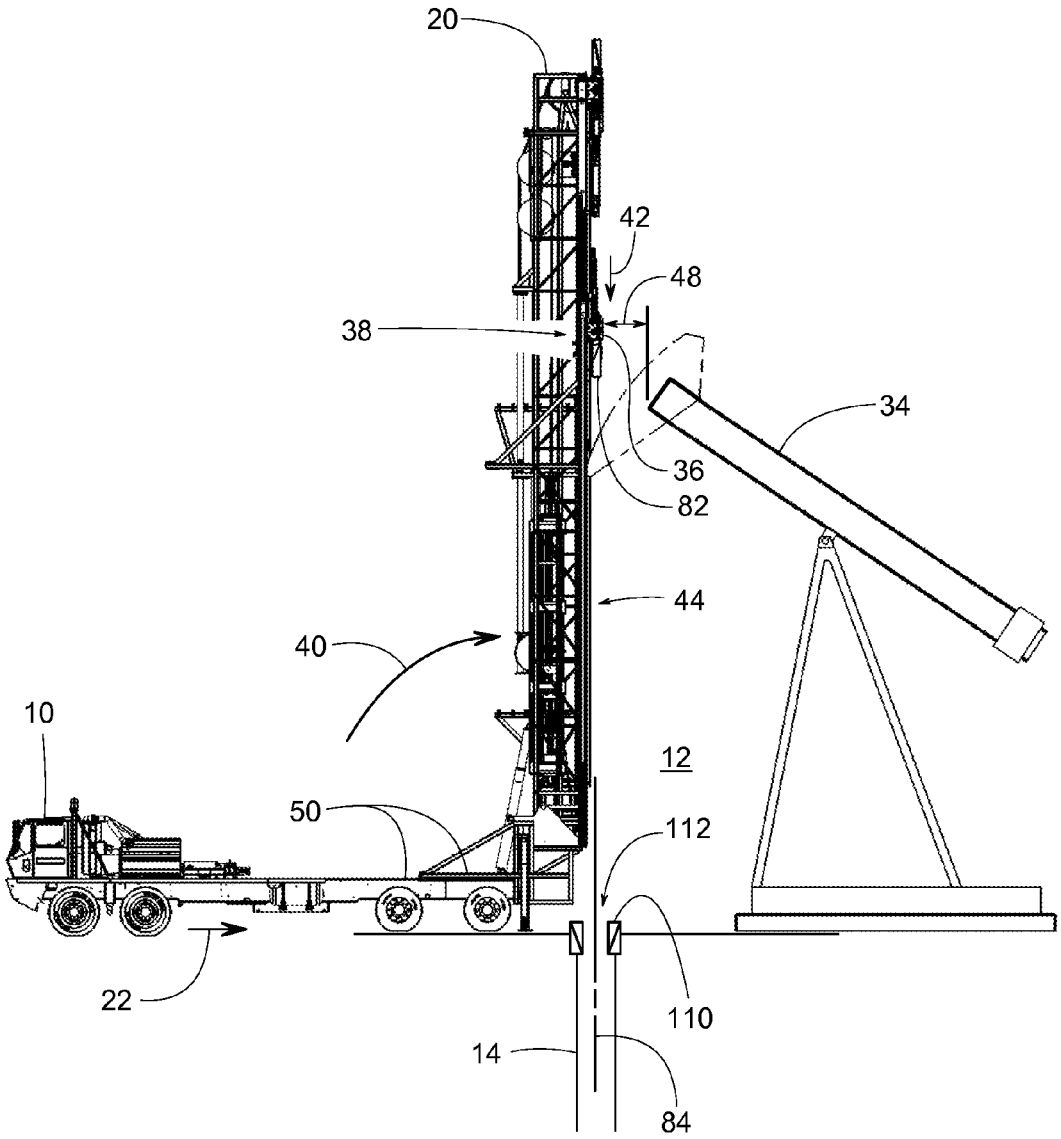
FIG. 1 is a side view of a workover vehicle at a well site according to some example embodiments of the invention.
Figure 2:
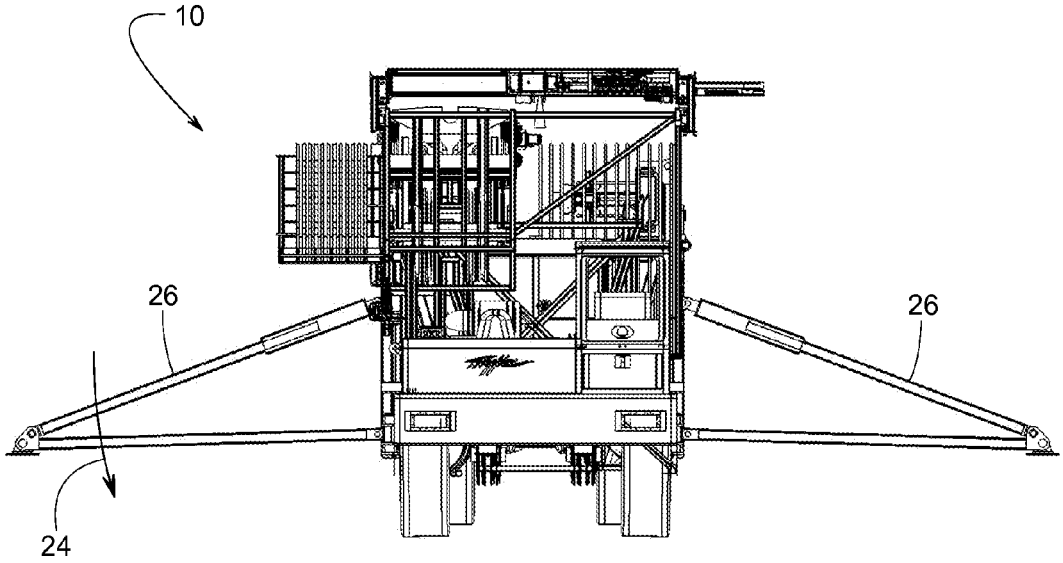
FIG. 2 a front end view of the vehicle of FIG. 1, but with the mast lowered.
Figure 3:
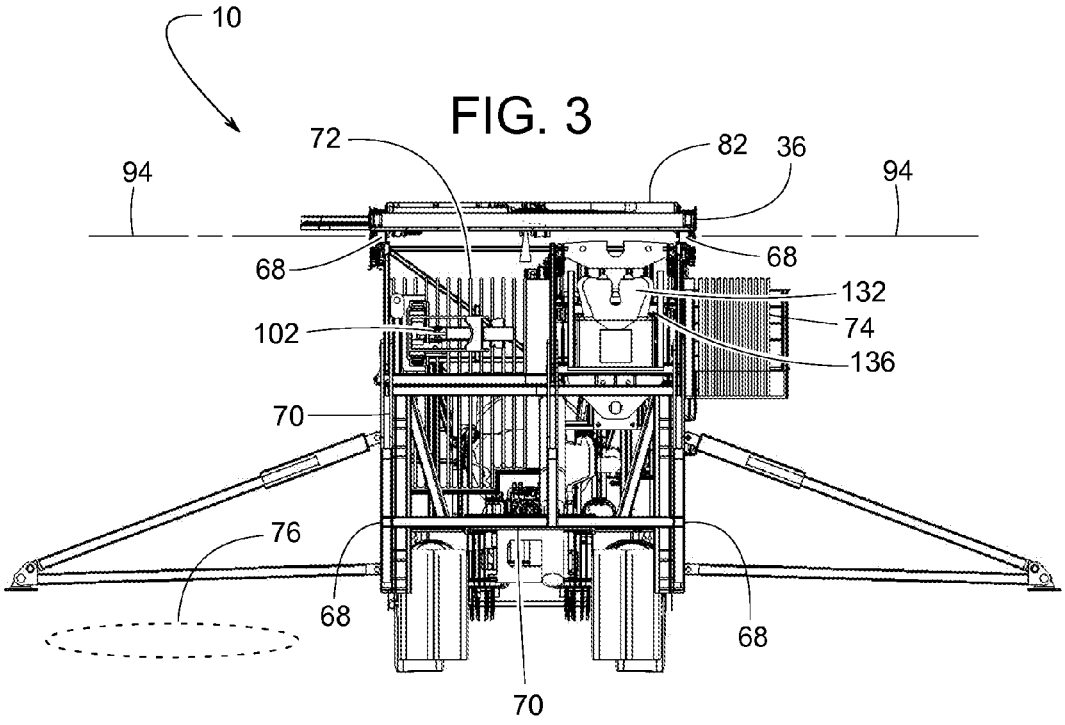
FIG. 3 is a back end view of the vehicle of FIG. 1, but with the mast lowered and the robot jib in its transport position.
Figure 4:
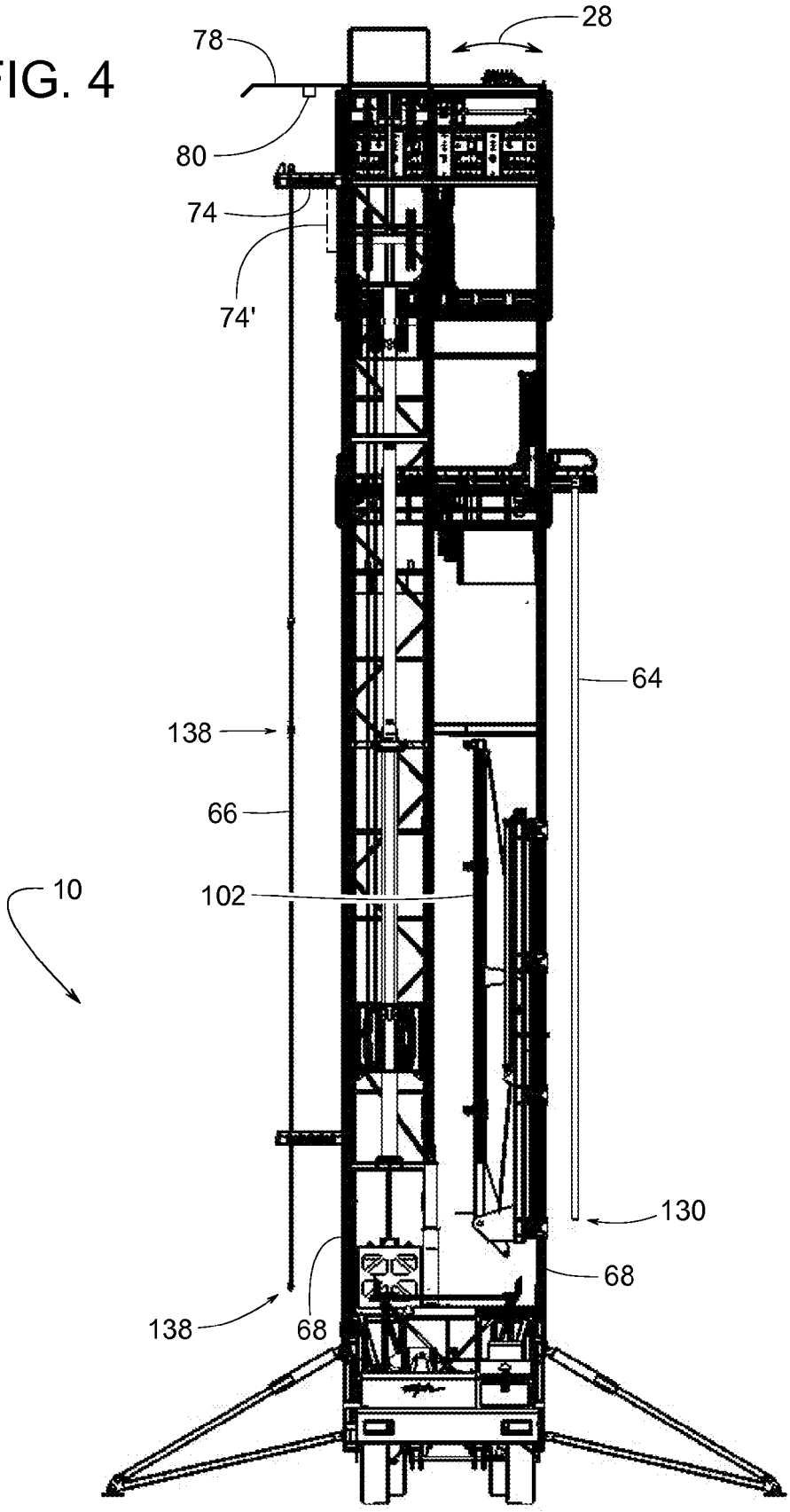
FIG. 4 is similar to FIG. 2 but showing the mast raised.
Figure 5:
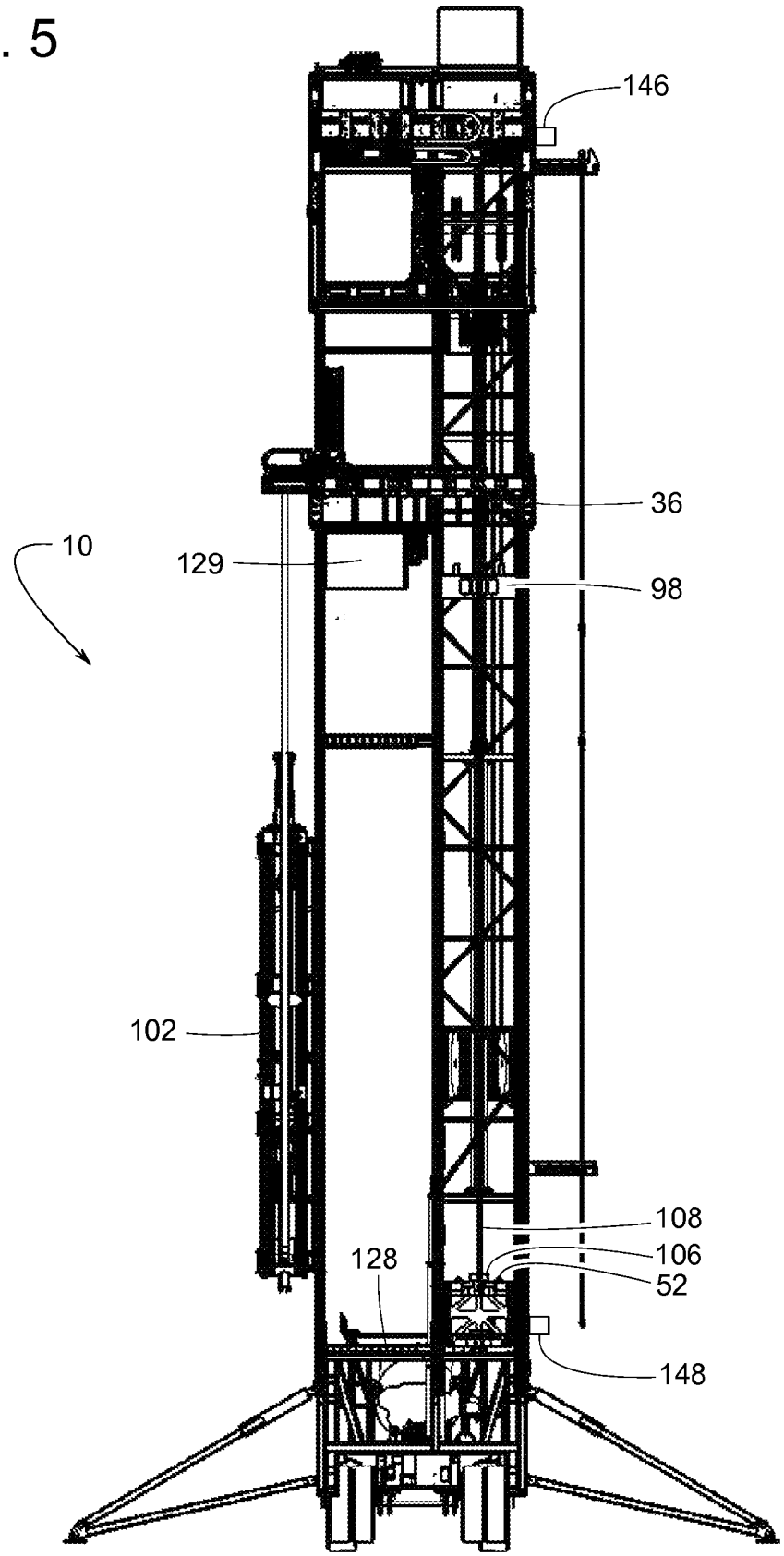
FIG. 5 is similar to FIG. 3 but showing the mast raised and the robotic jib partially deployed.
Figure 6:
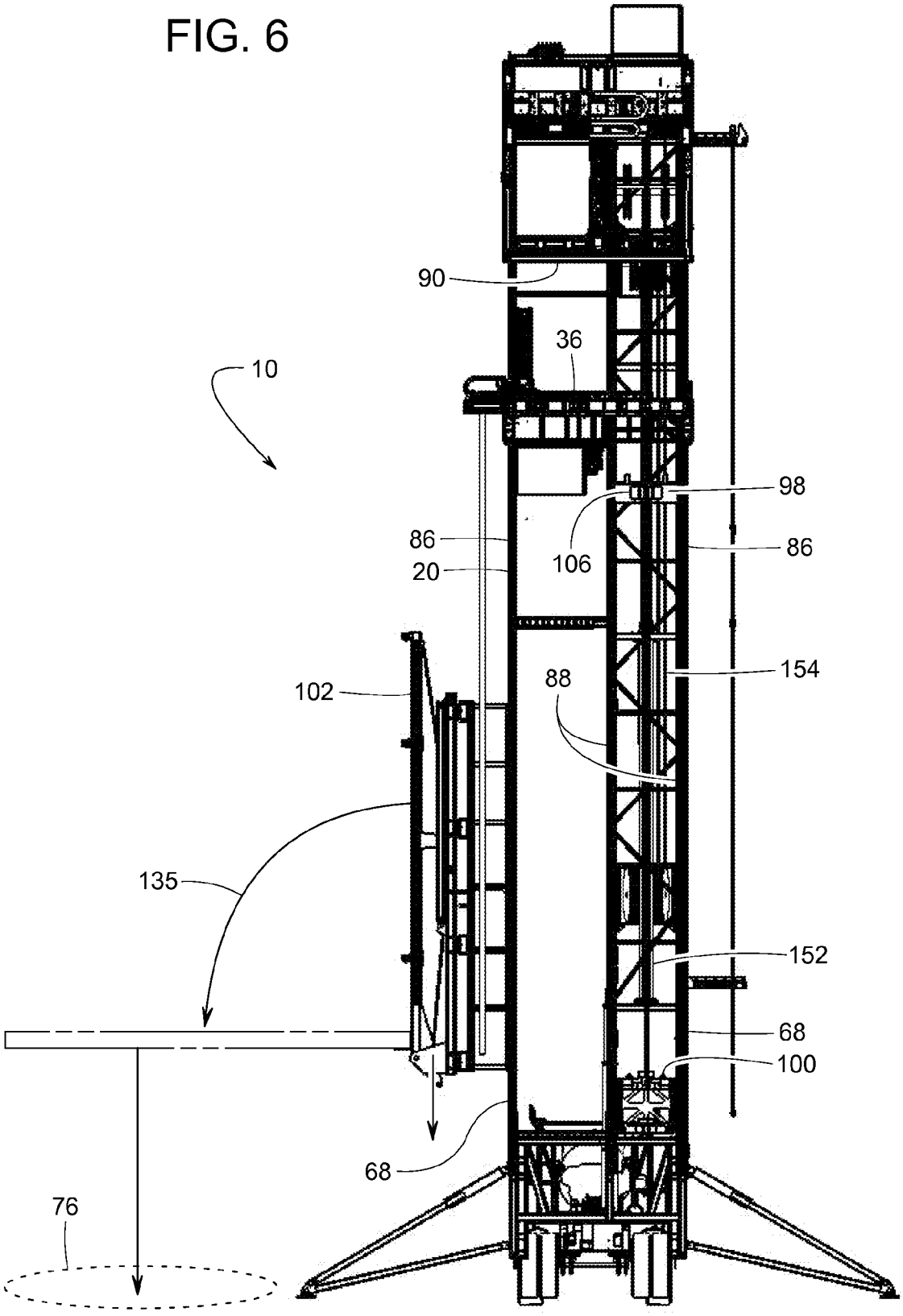
FIG. 6 is similar to FIG. 5 but showing the mast further deployed.
Figure 7:
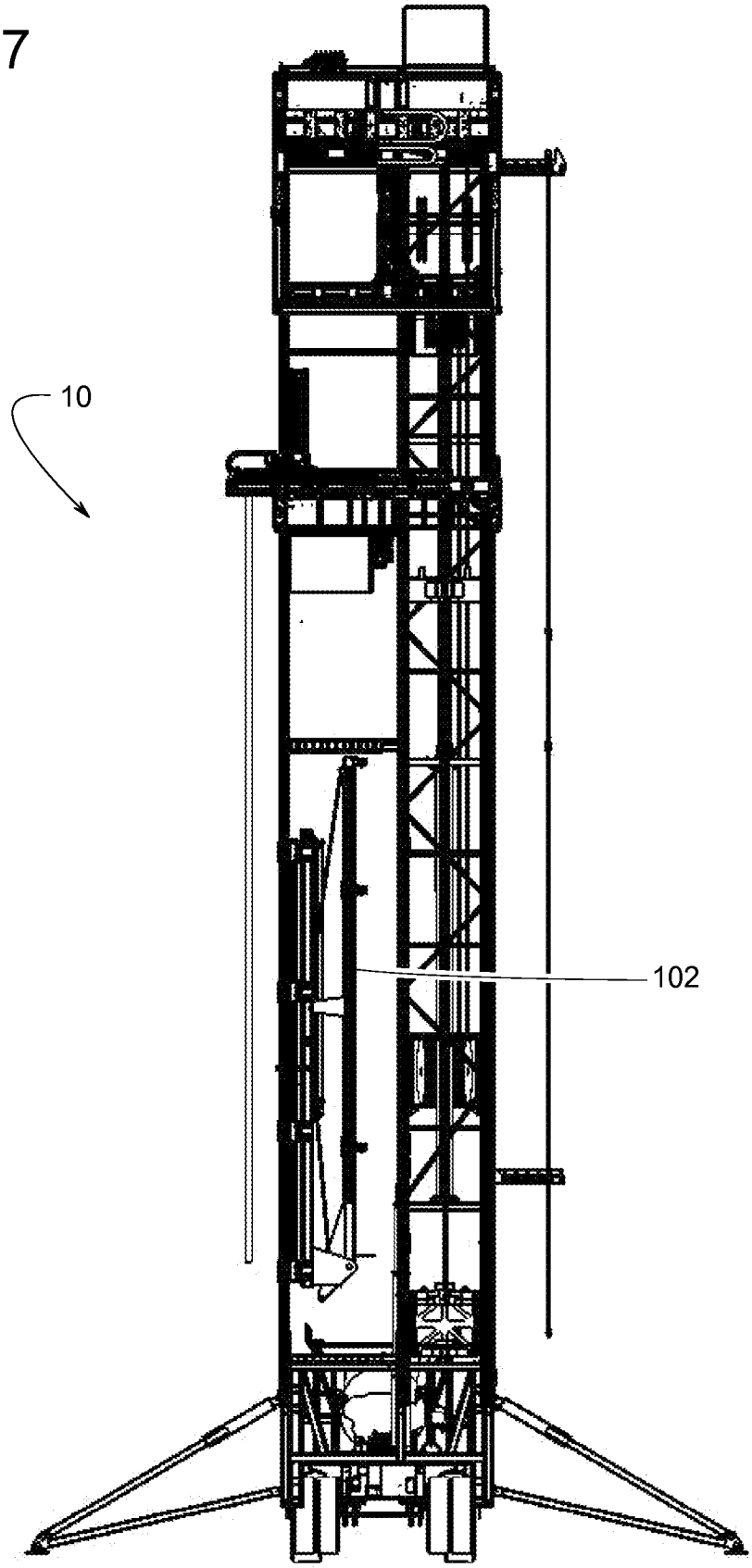
FIG. 7 is a back view of FIG. 4.
Figure 8:
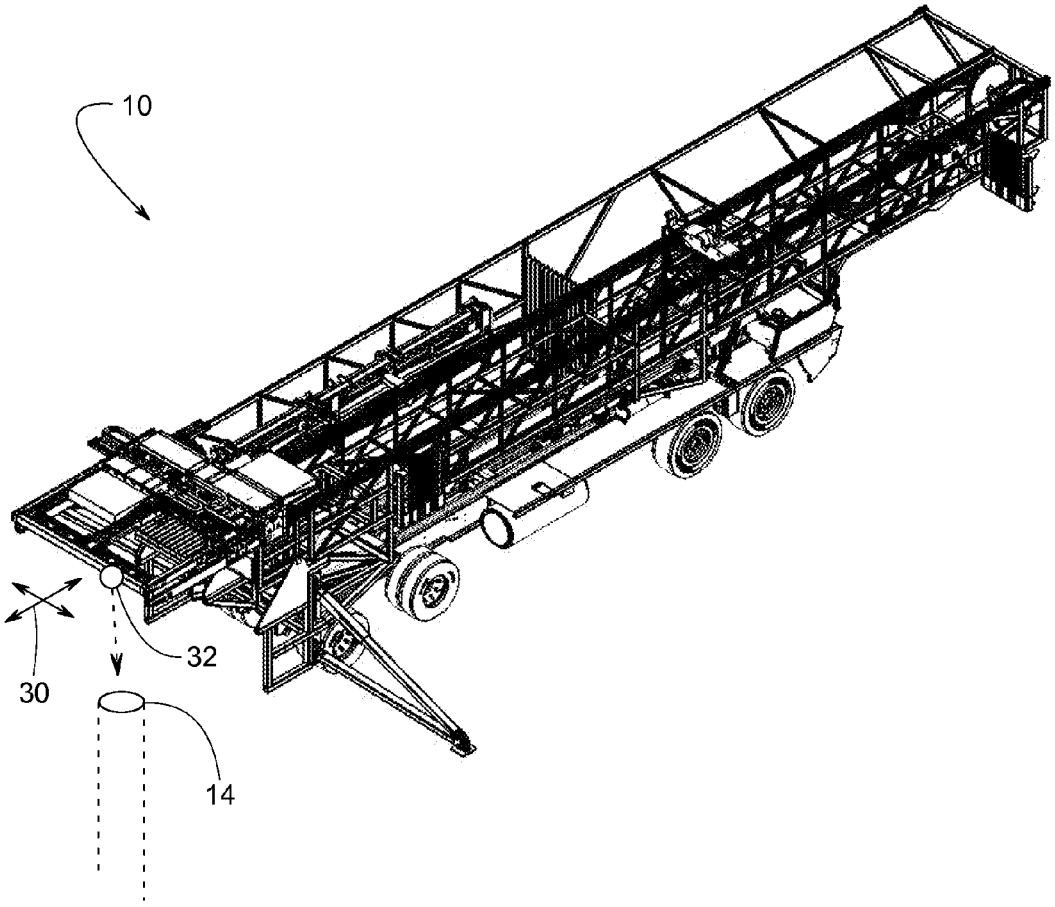
FIG. 8 is a perspective view of the workover vehicle in the process of being aligned to the wellbore.
Figure 9:
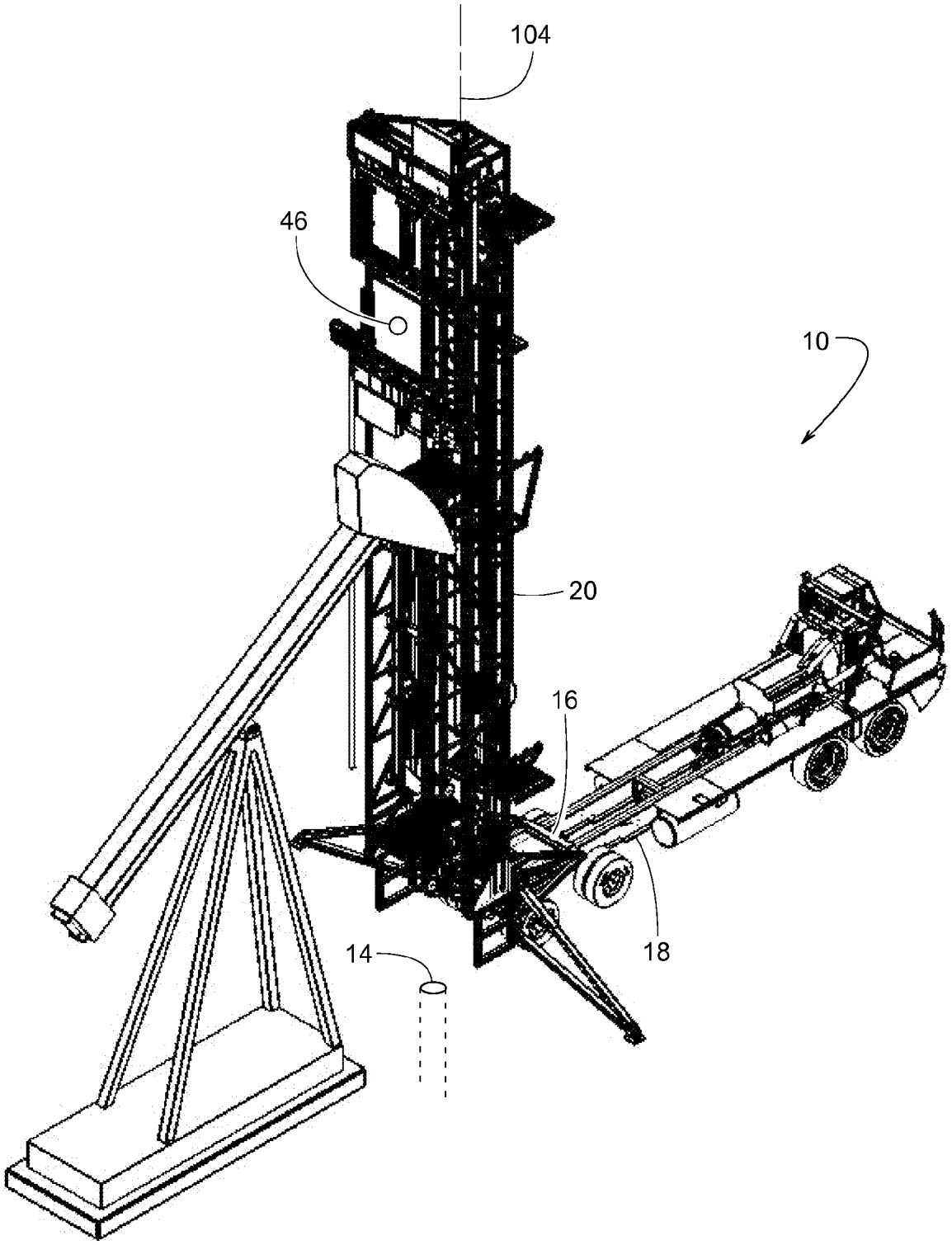
FIG. 9 is similar to FIG. 8 but showing the mast raised and proximate a pump jack with a walking beam.
Figure 10:
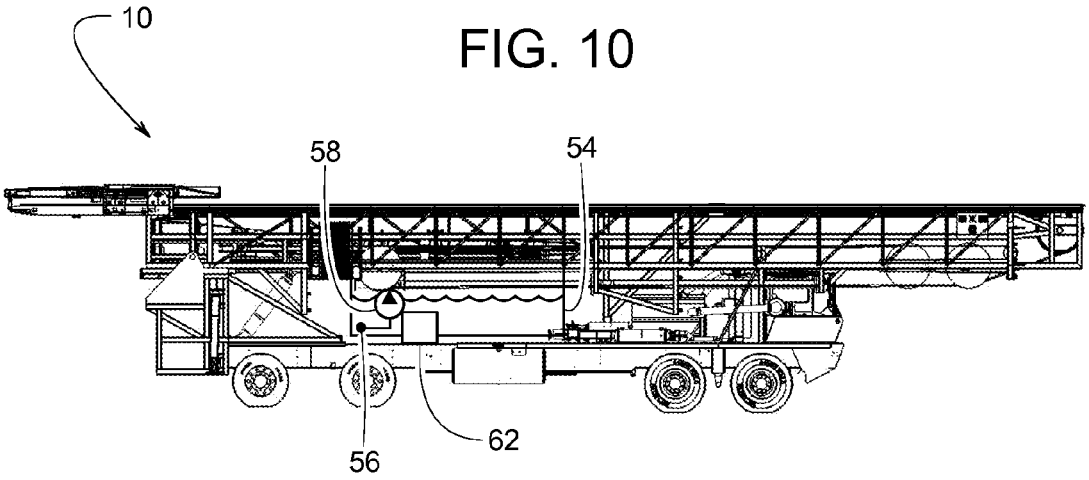
FIG. 10 is a side view showing the mast and hydraulic tank lowered to a transport position.
Figure 11:
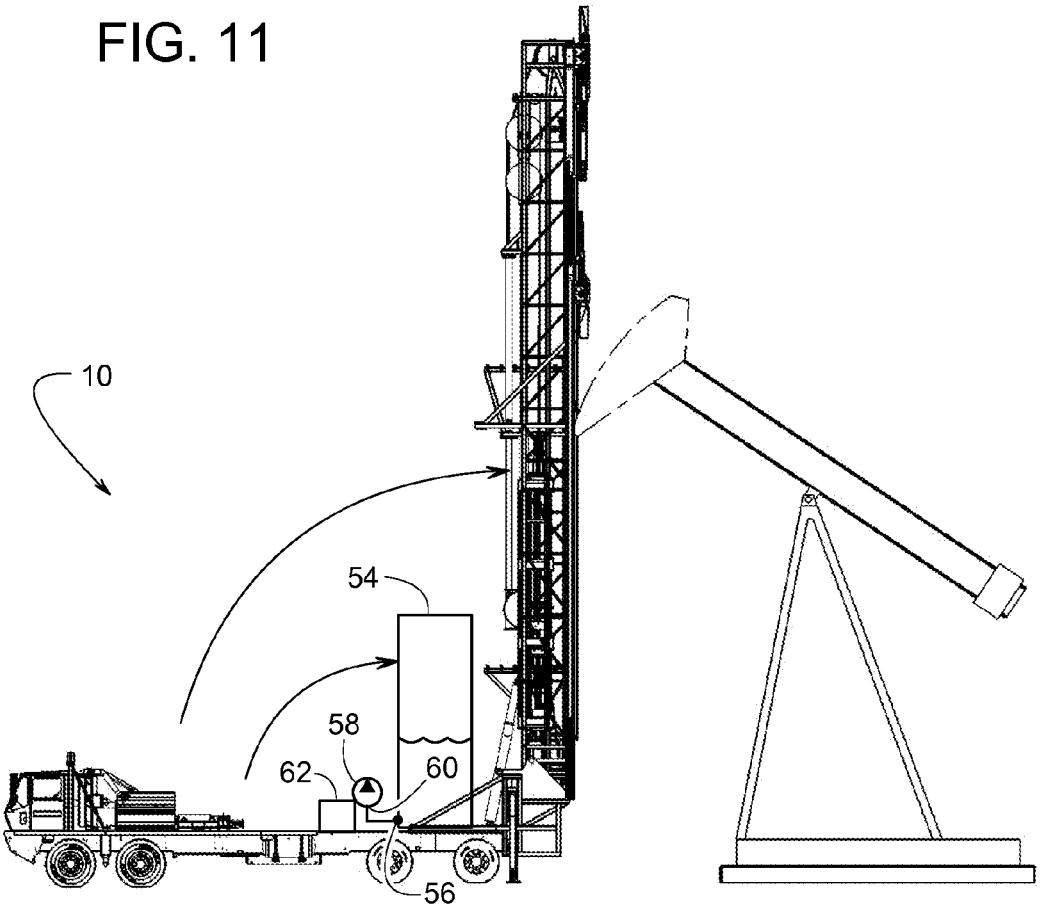
FIG. 11 shows the mast and hydraulic tank raised.
Figure 12:
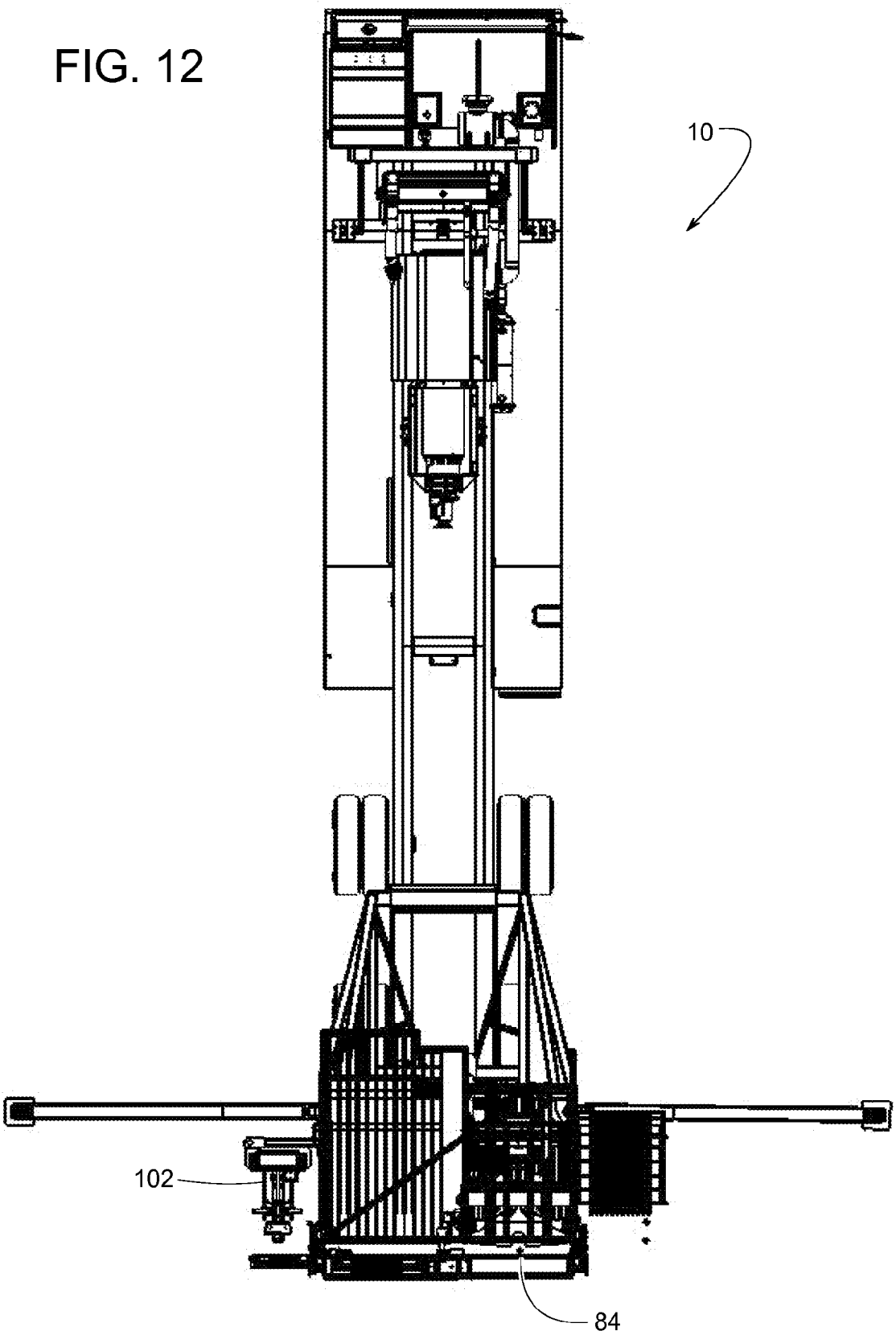
FIG. 12 is a top view with the mast raised, robotic jib deployed and a rod storage rack extended to an operative configuration.
Figure 13:
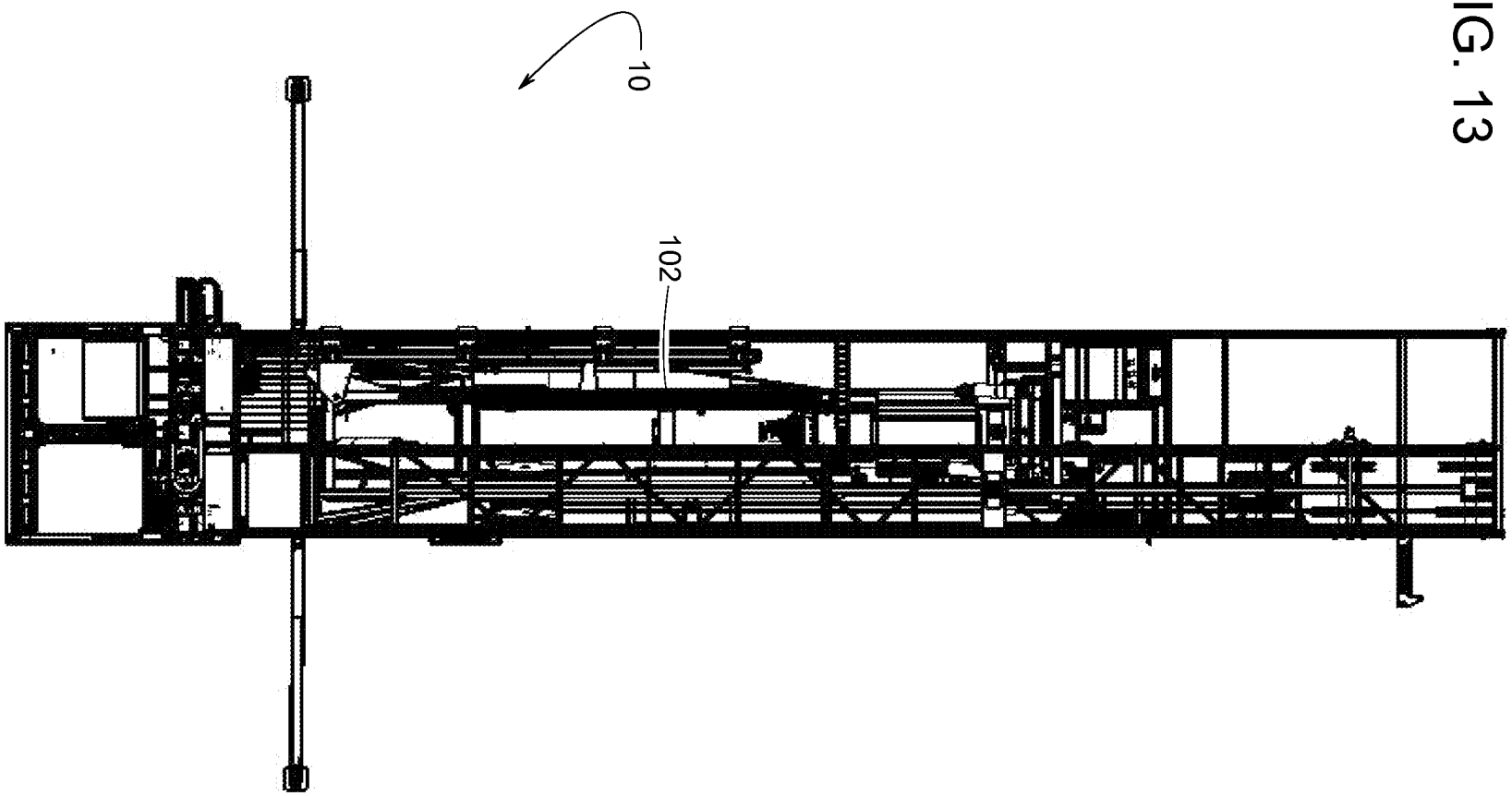
FIG. 13 is a top view with the mast down, and both the rod storage rack in its transport configuration.
Figure 14:
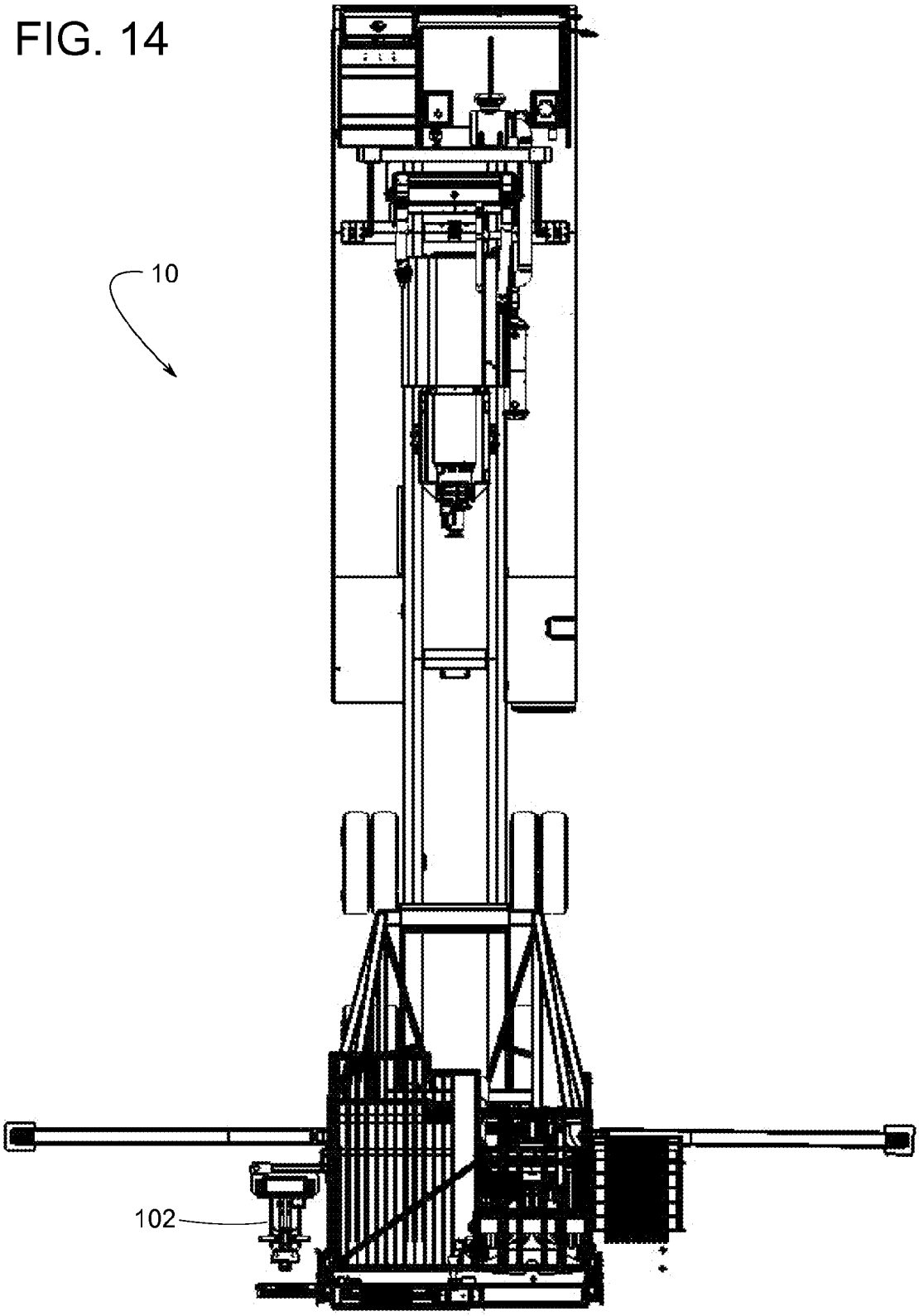
FIG. 14 is a duplicate of FIG. 12.
Figure 15:
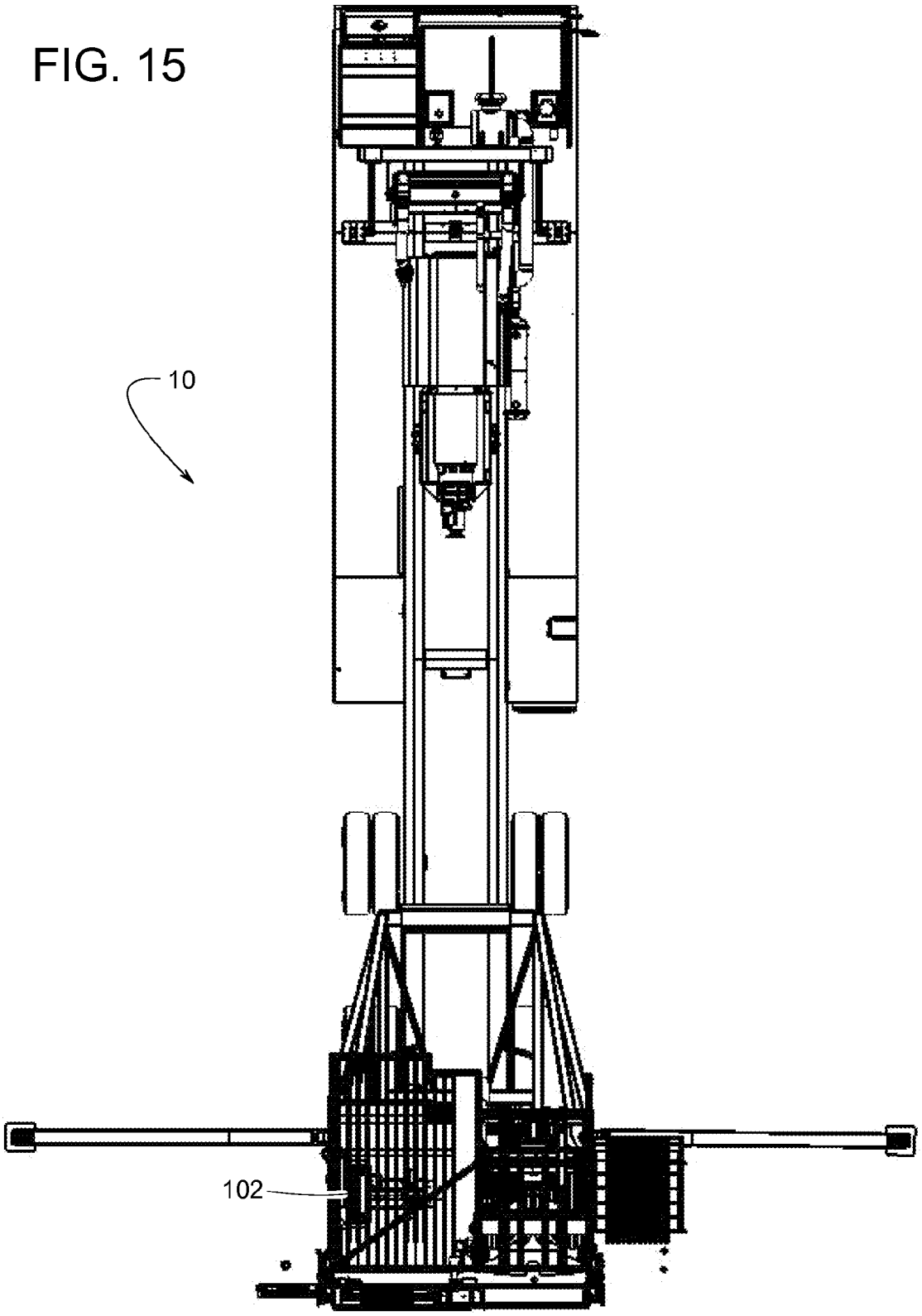
FIG. 15 is similar to FIG. 14 but showing the robotic jib in its transport configuration.
Figure 16:
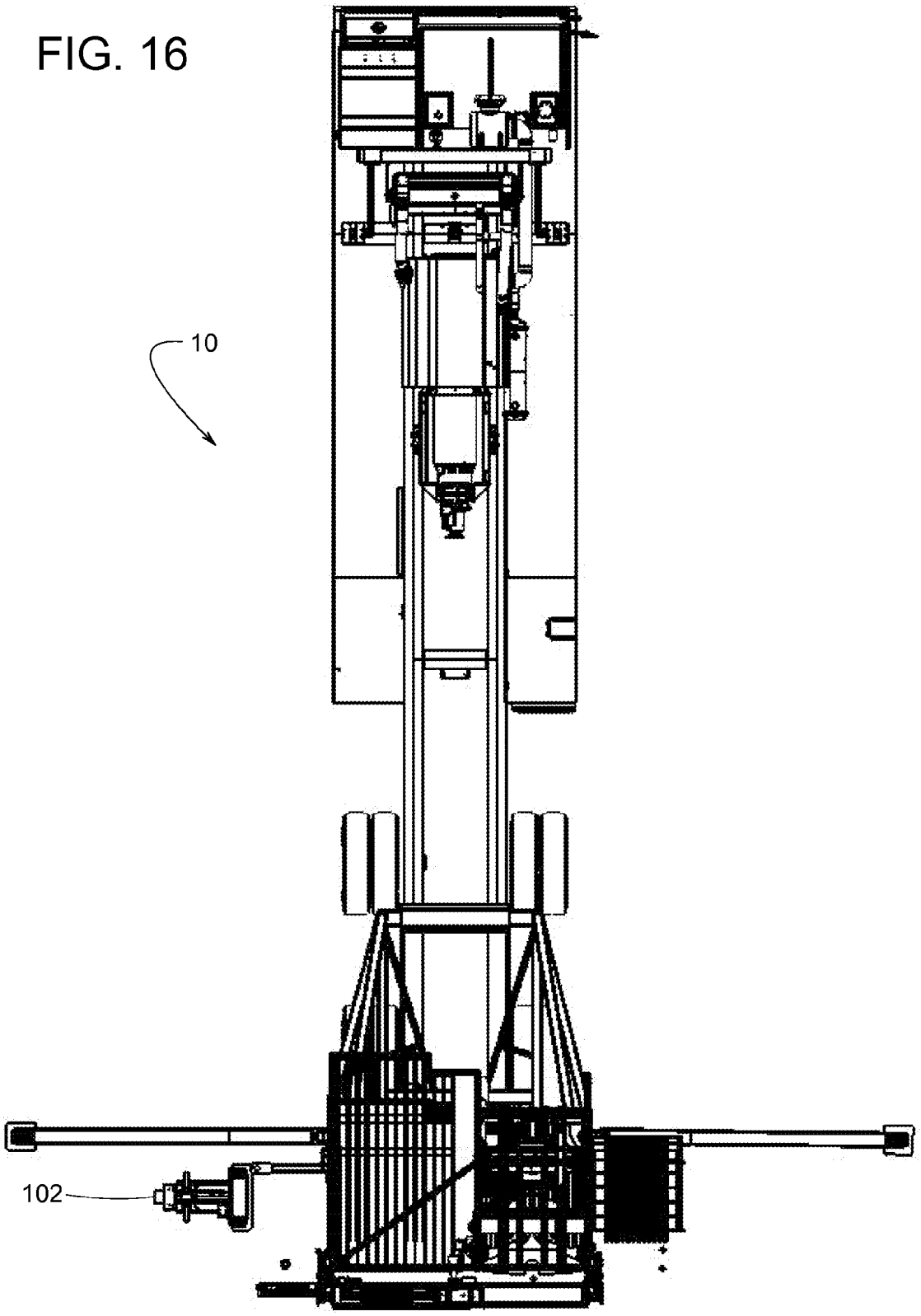
FIG. 16 is similar to FIG. 12 but showing the robotic jib further deployed.
Figure 17:
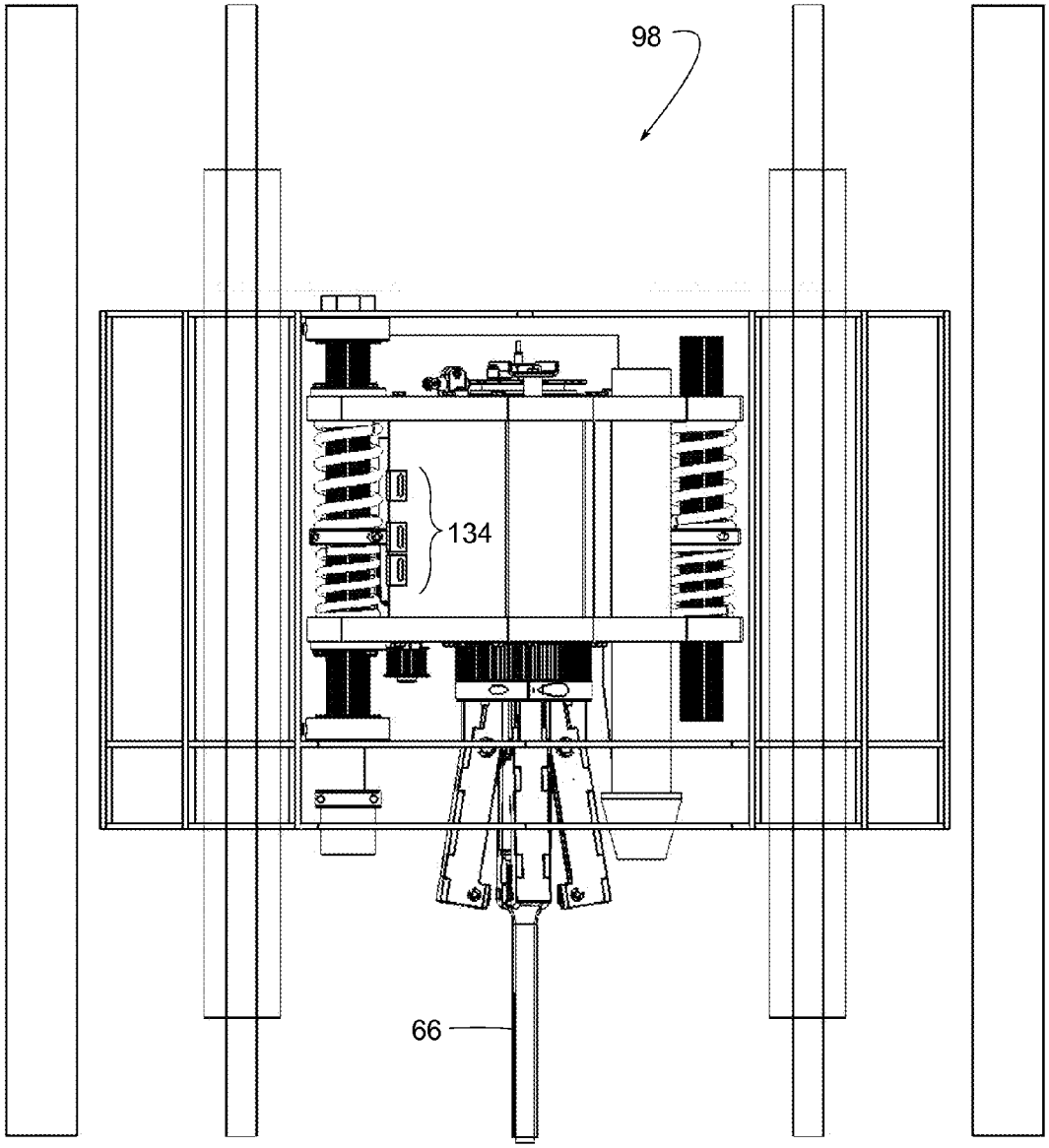
FIG. 17 is a front view of the upper trolley mechanism about to engage the upper end of a well rod.
Figure 18:
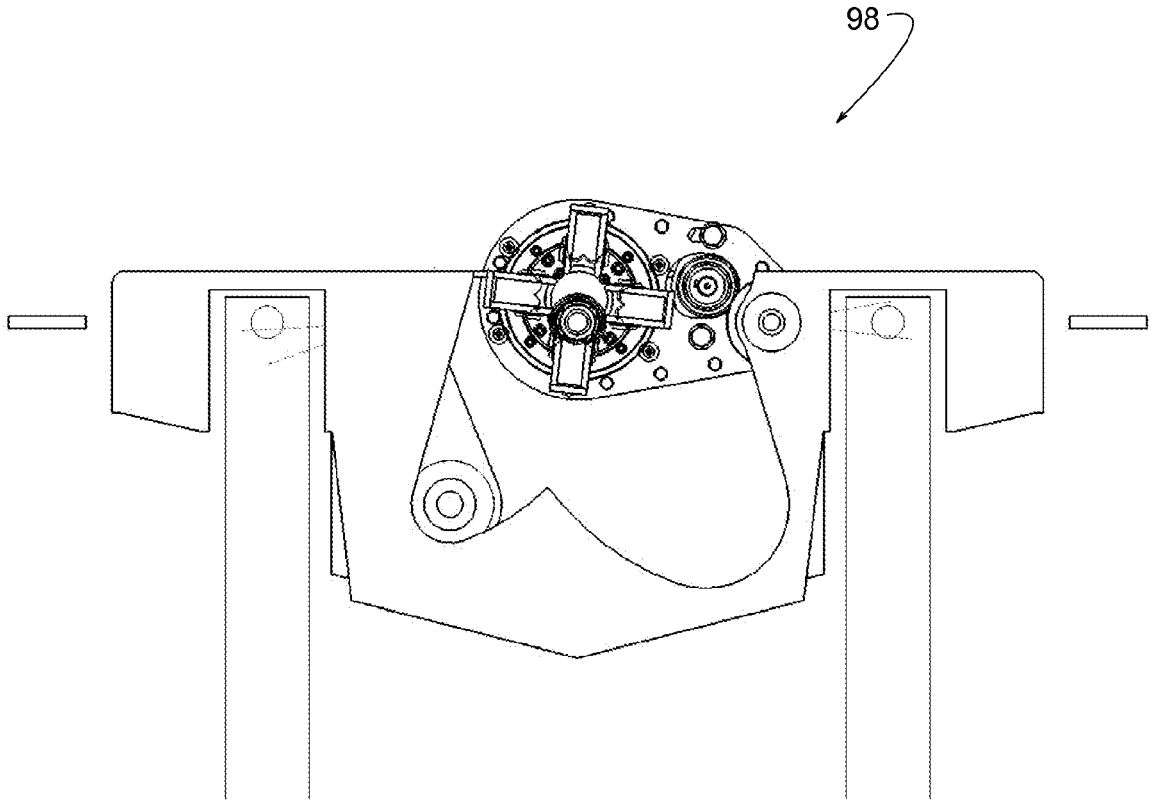
FIG. 18 is a bottom view of FIG. 17.
Figure 19:
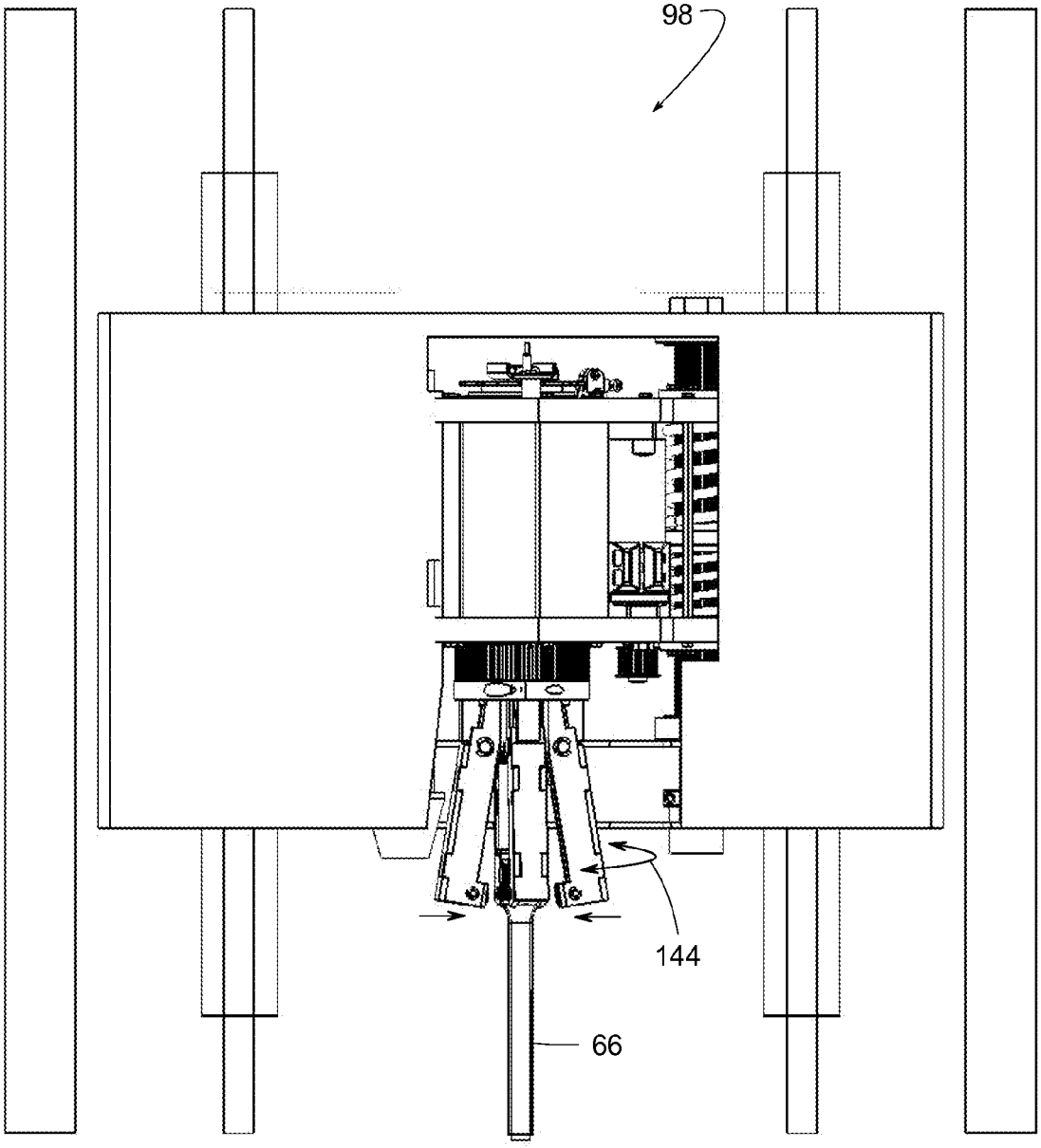
FIG. 19 is a back view of FIG. 17.
Figure 20:
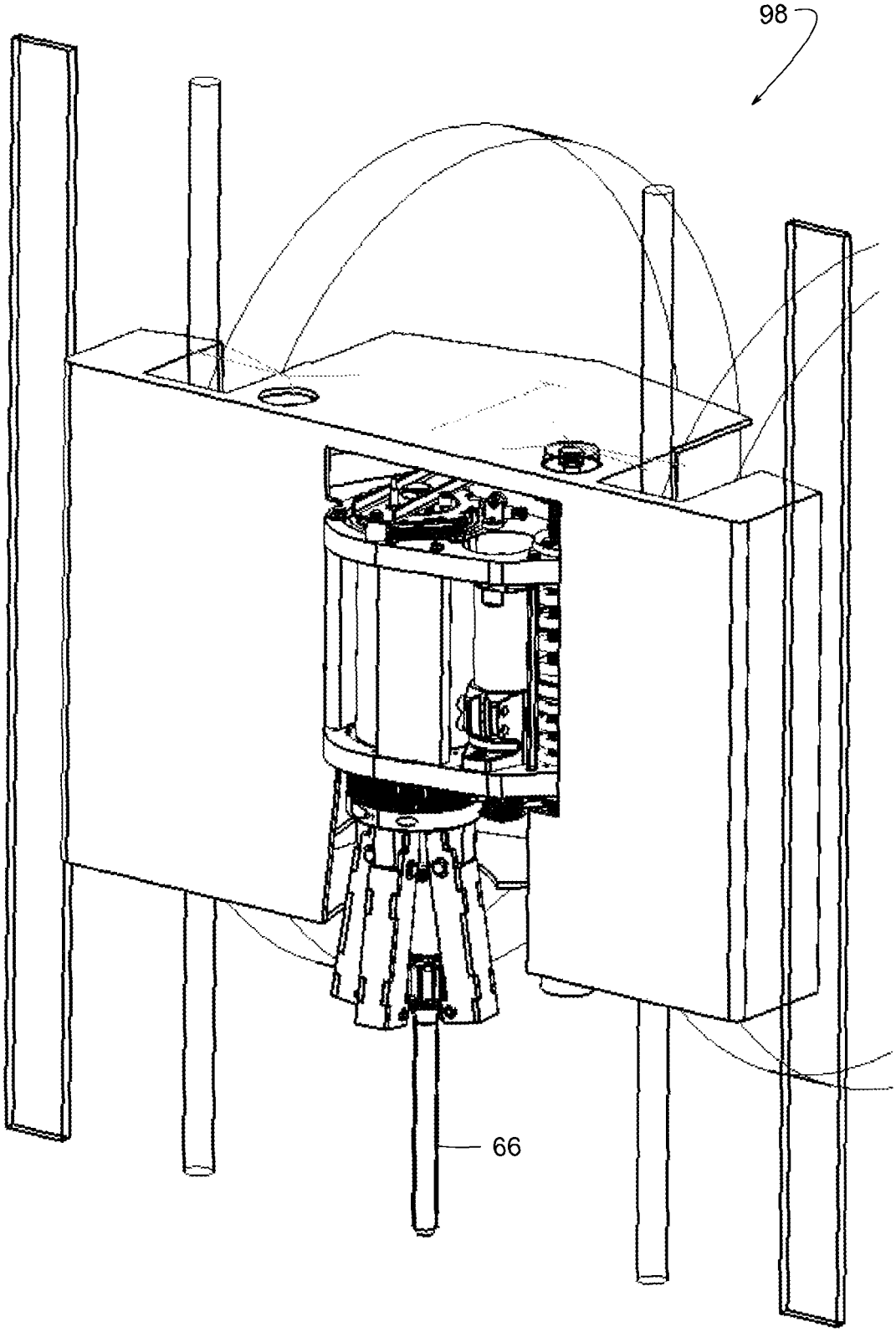
FIG. 20 is a perspective view of the upper trolley mechanism.
Figure 21:
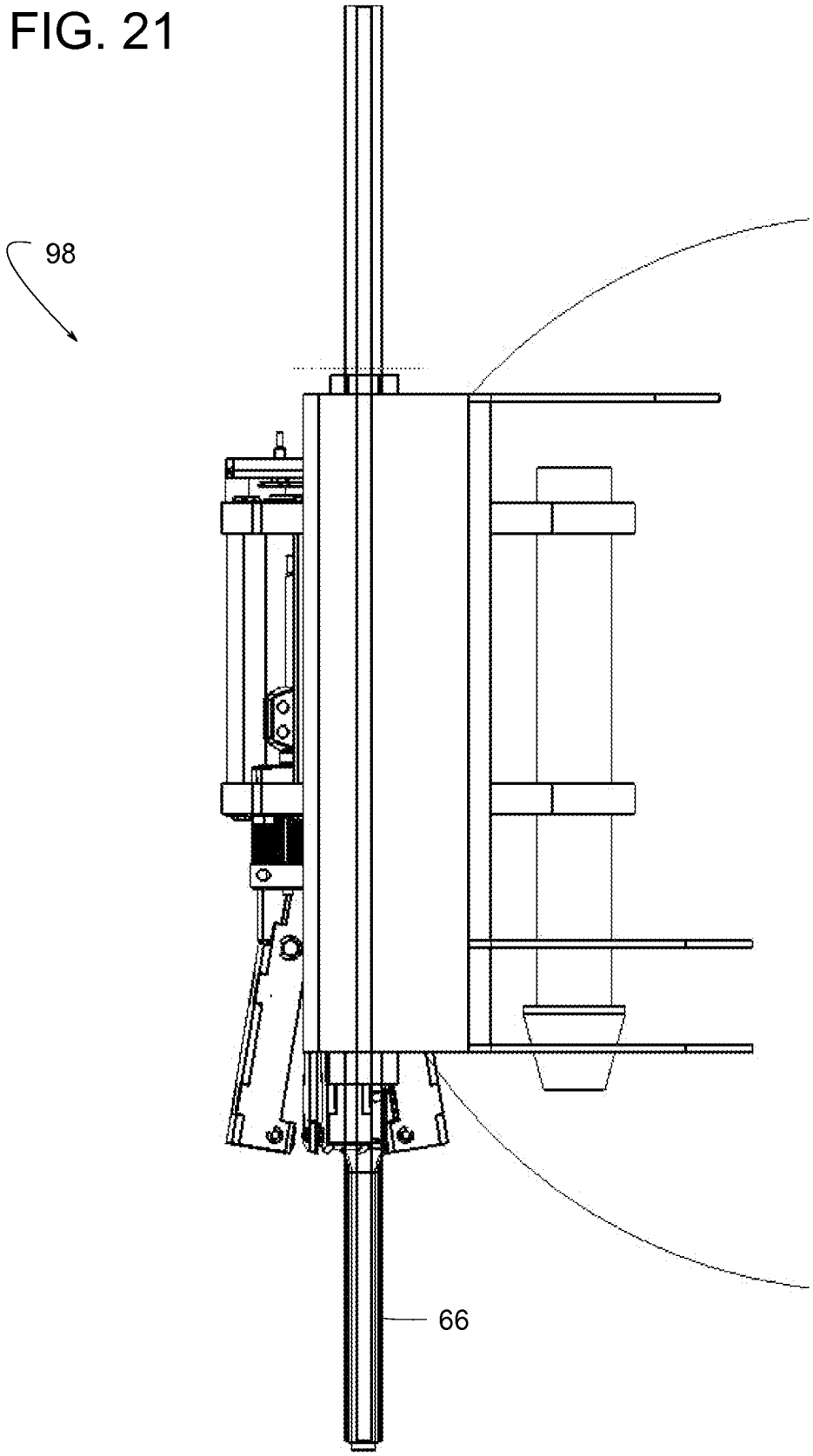
FIG. 21 is a side view of FIG. 17.
Figure 22:
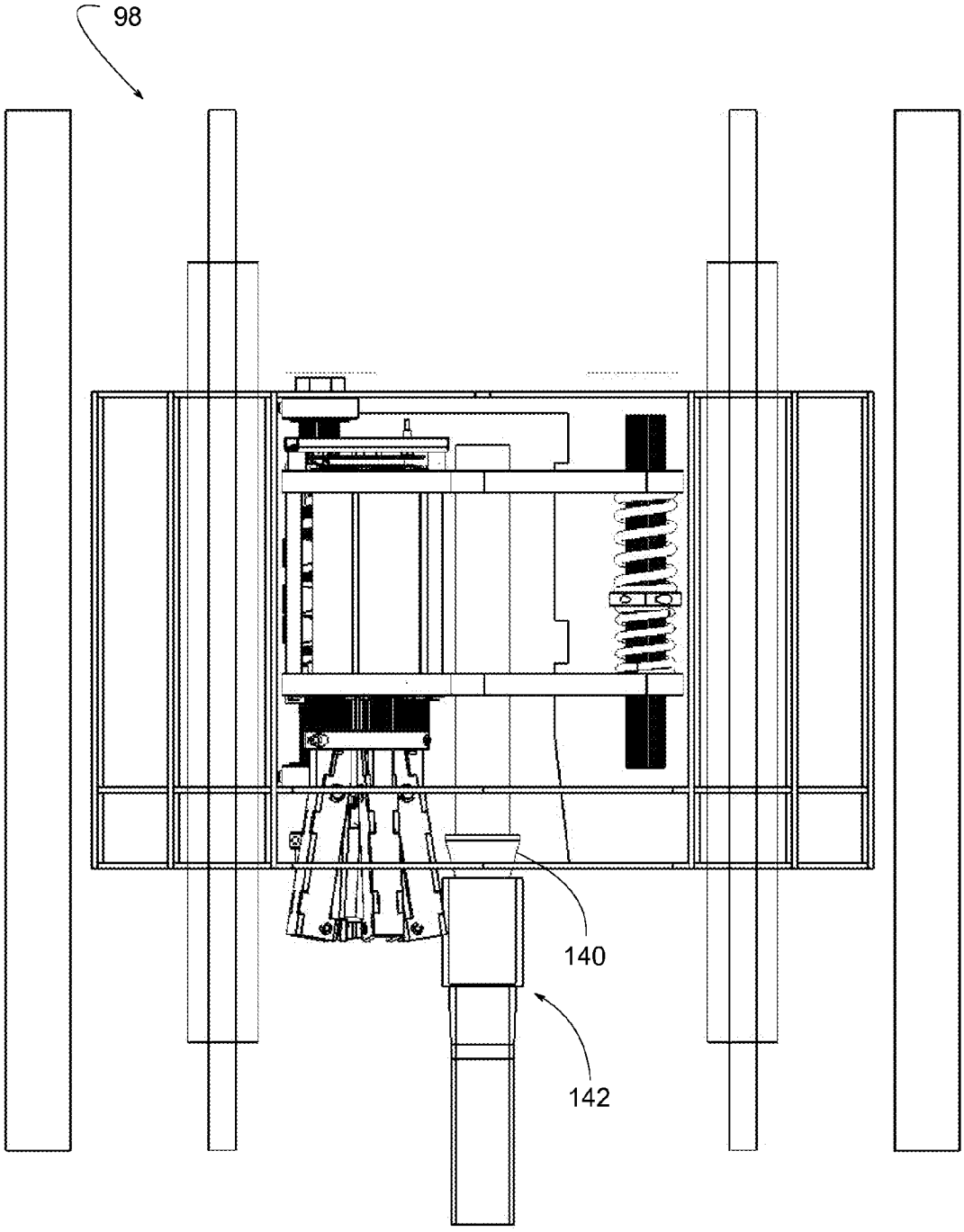
FIG. 22 is a back view showing the upper trolley mechanism guiding the upper end of a well tube.
Figure 23:
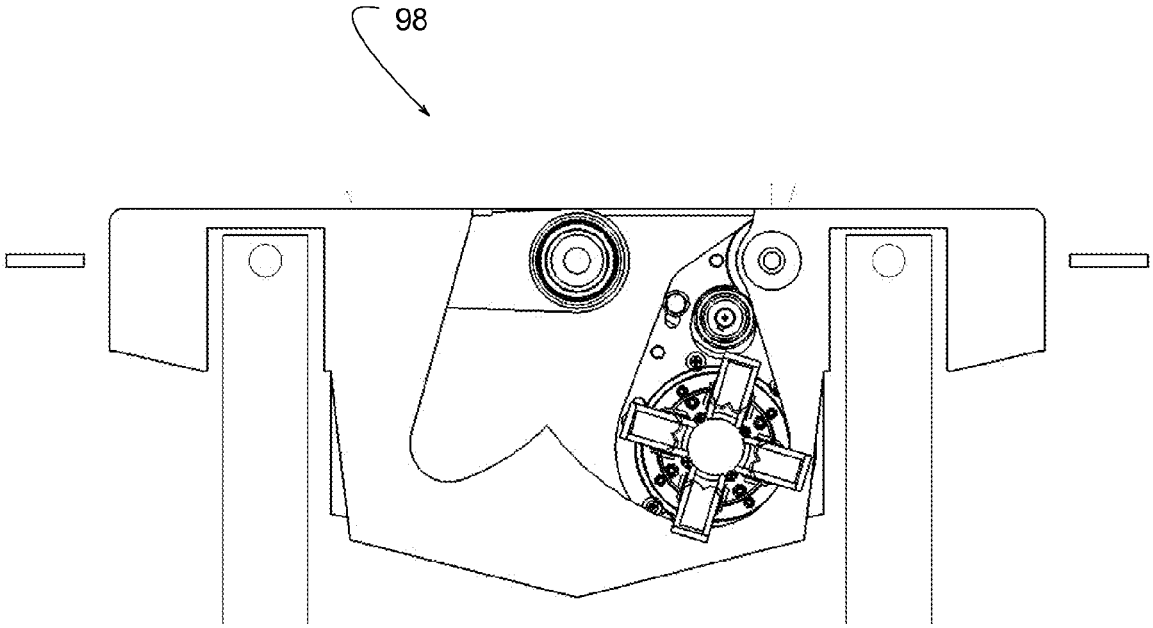
FIG. 23 is a bottom view of FIG. 22.
Figure 24:
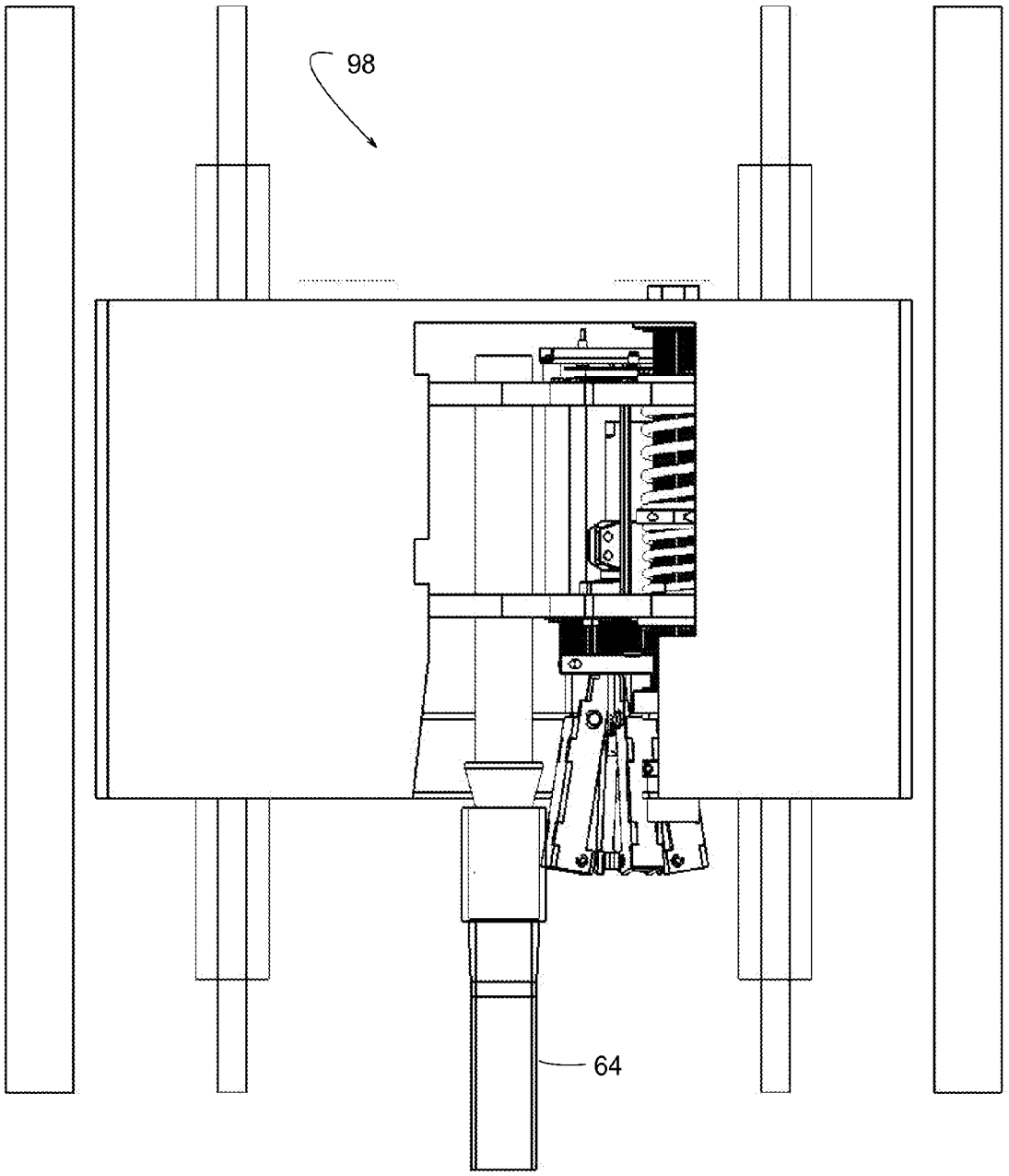
FIG. 24 is a front view of FIG. 22.
Figure 25:
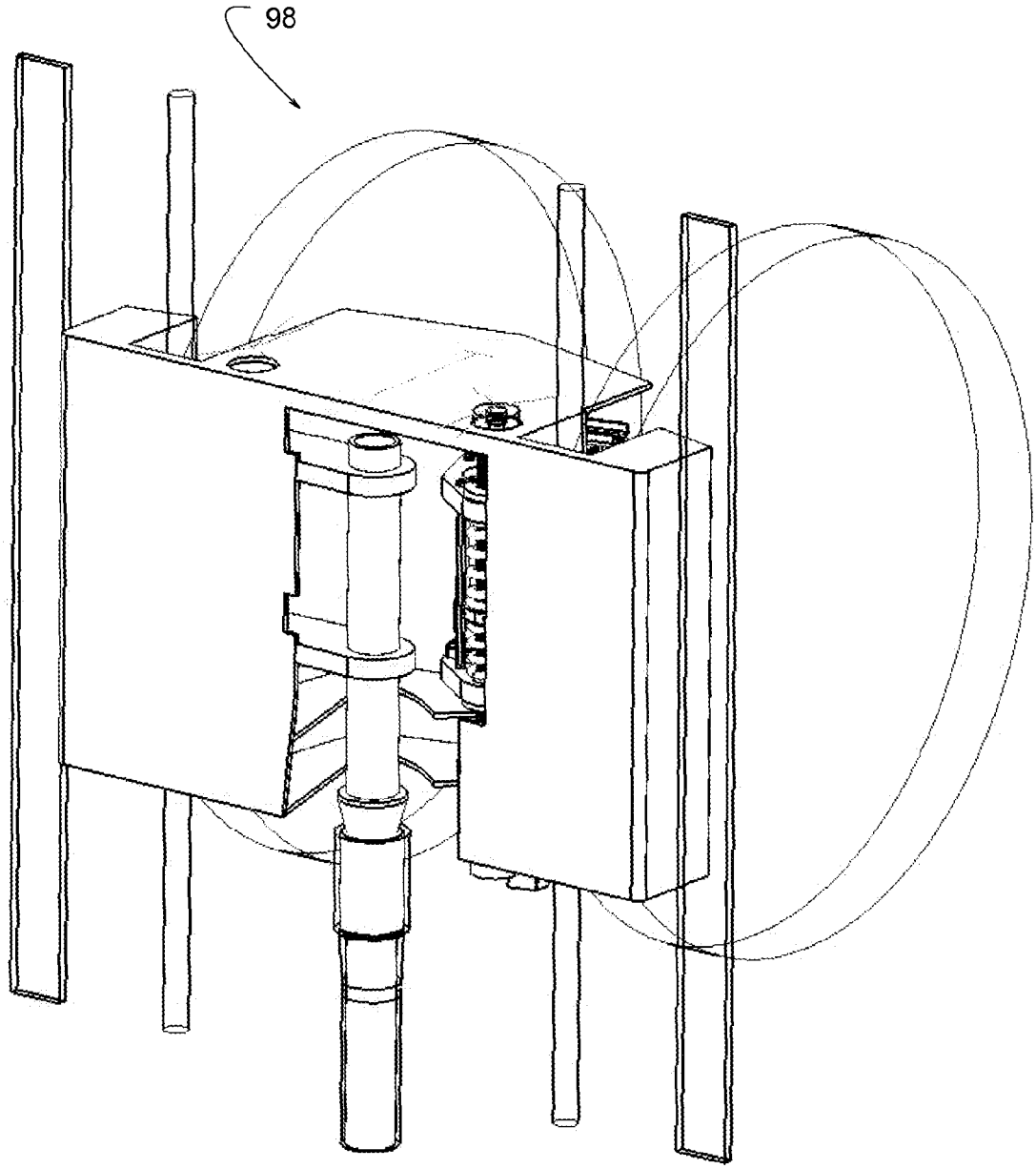
FIG. 25 is a perspective view of FIG. 22.
Figure 26:
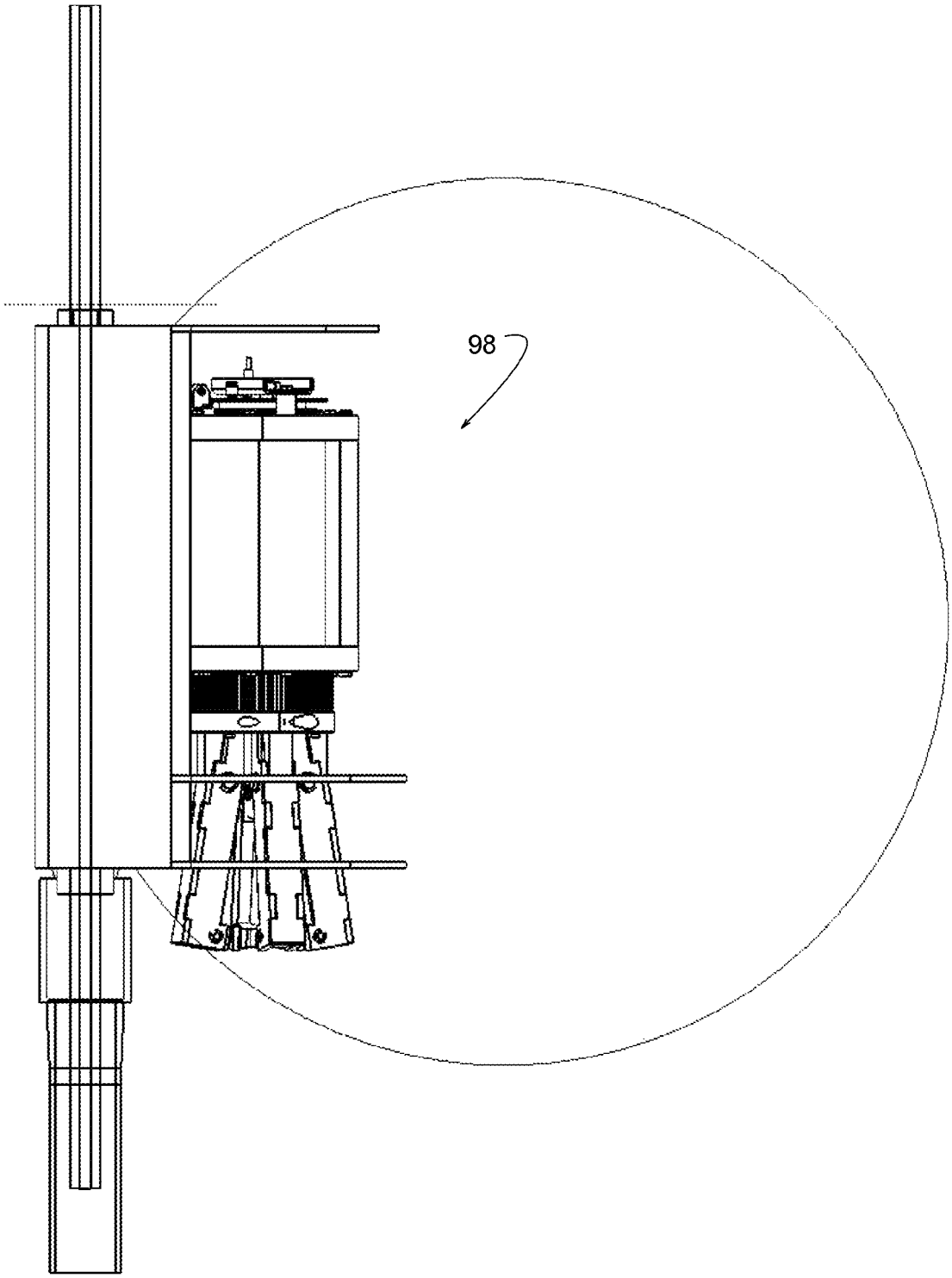
FIG. 26 is a side view of FIG. 22.
Figure 29:
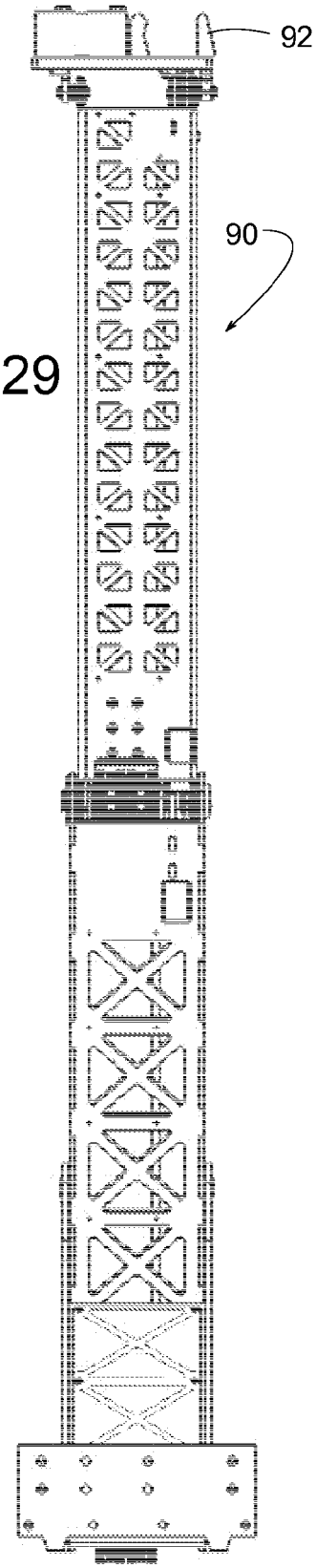
Figure 30:
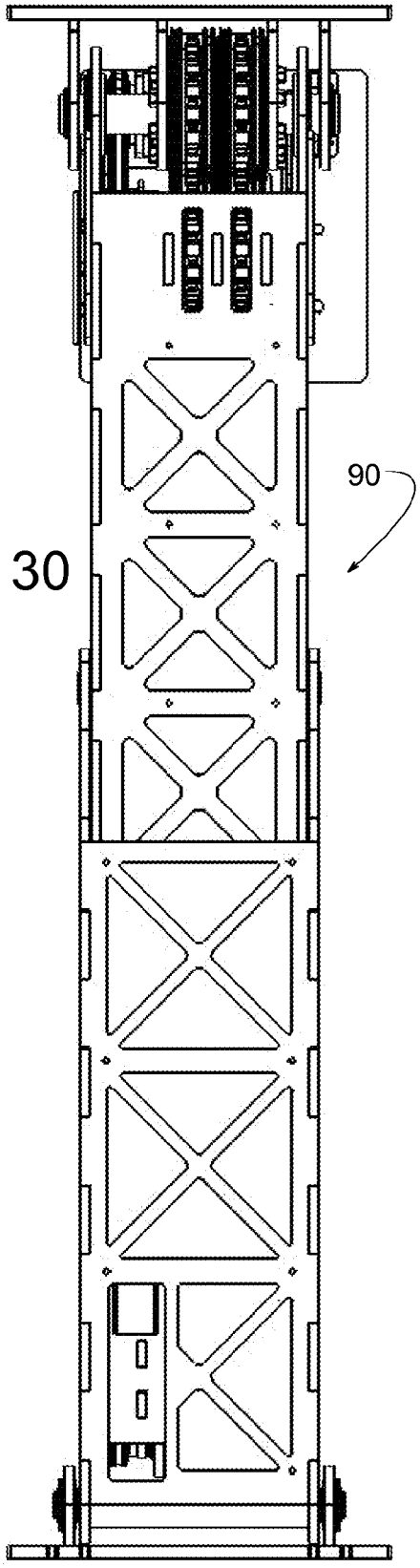
Figure 31:
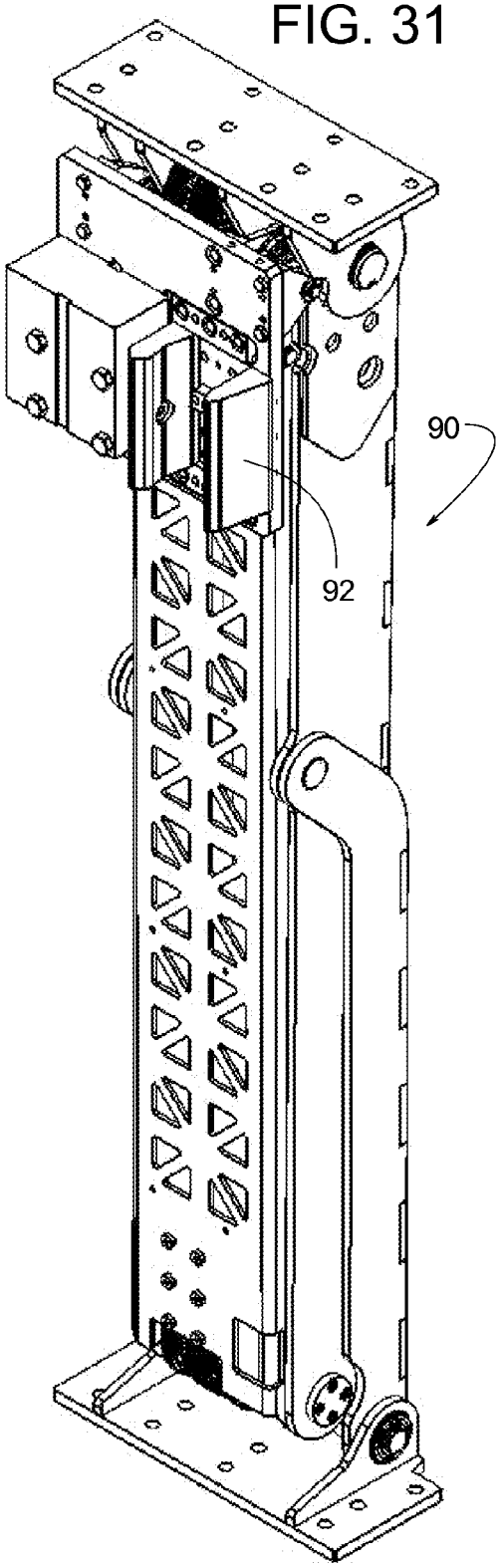
Figure 32:
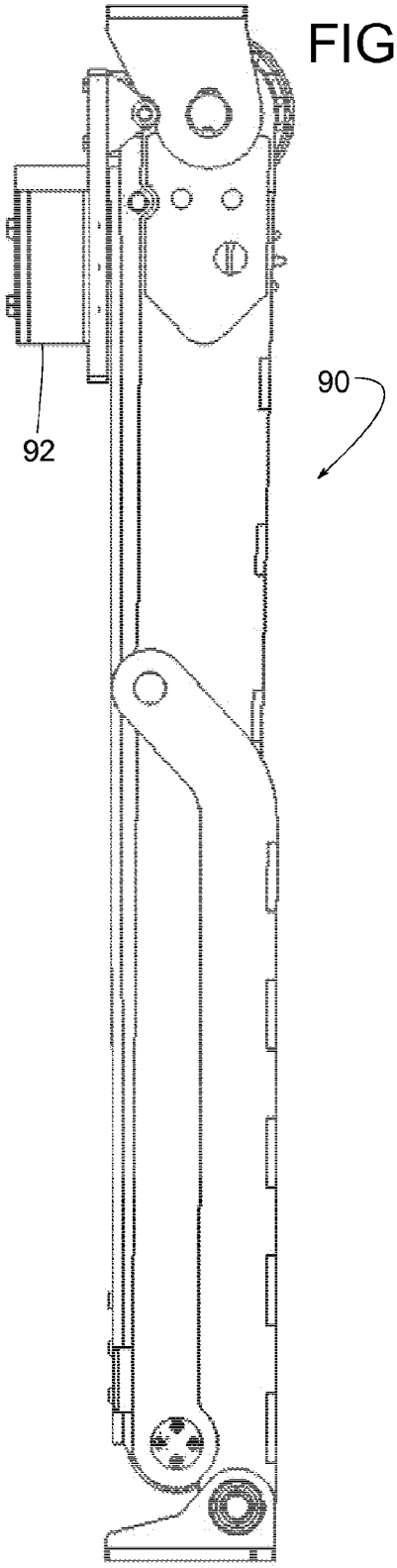
Figure 33:
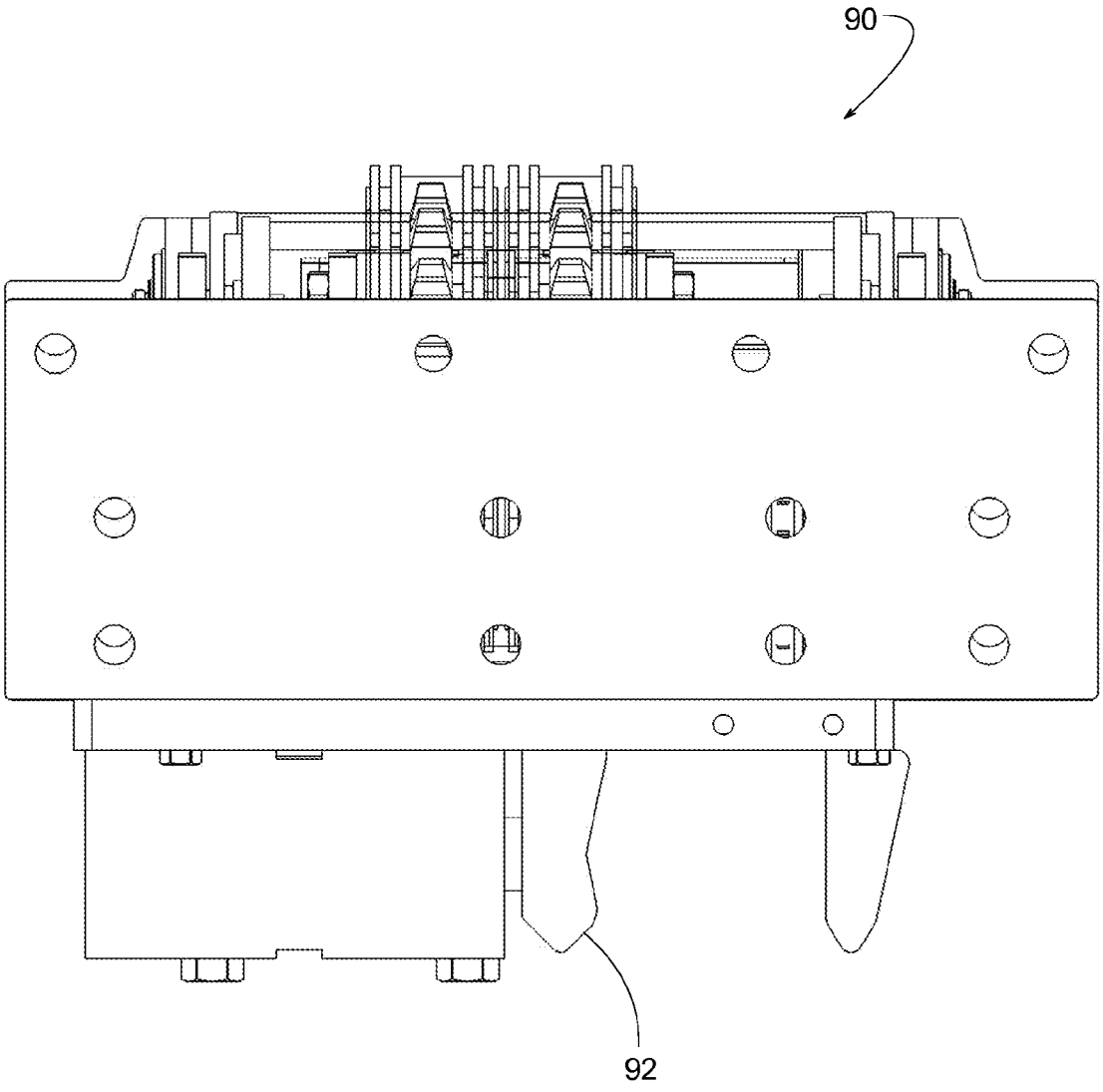
Figure 34:
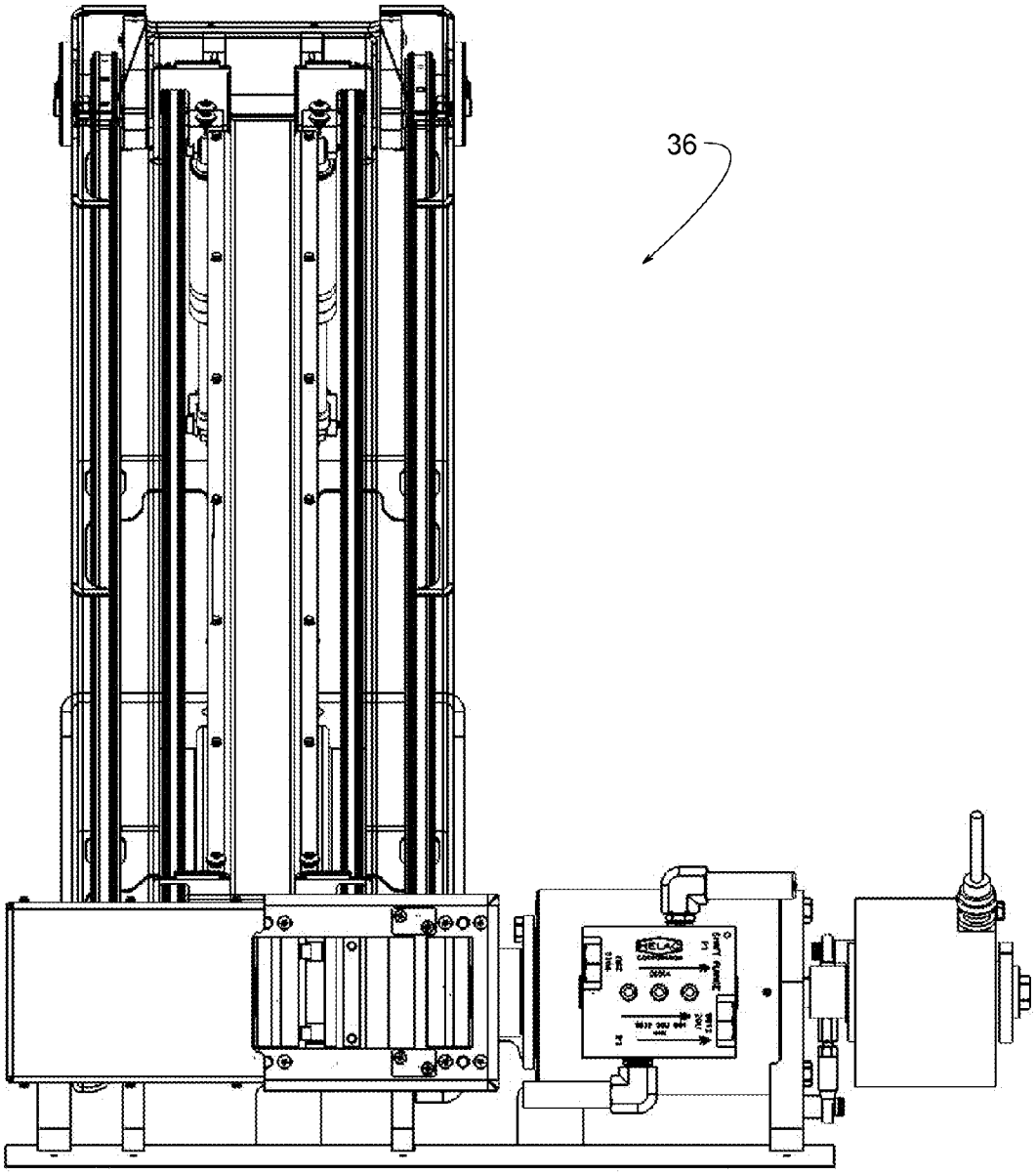
FIGS. 34-45 pertain to the lower robot 36.
Figure 35:
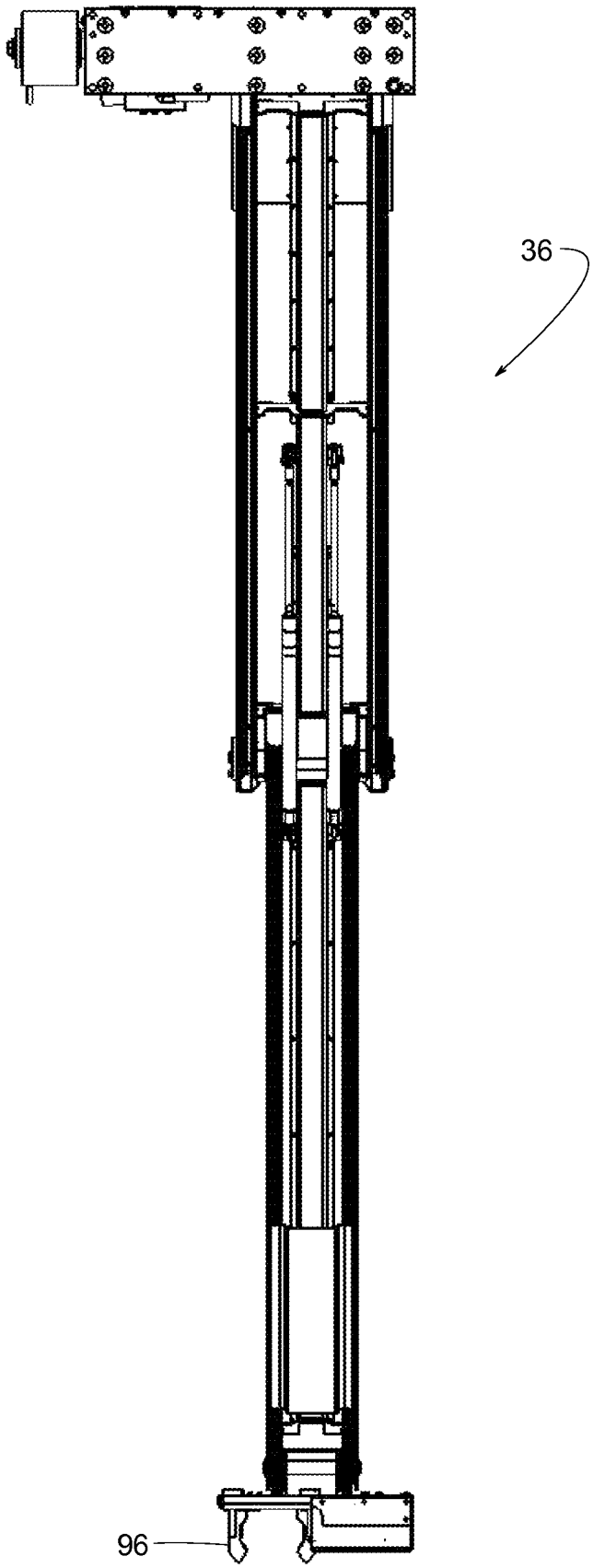
Figure 36:
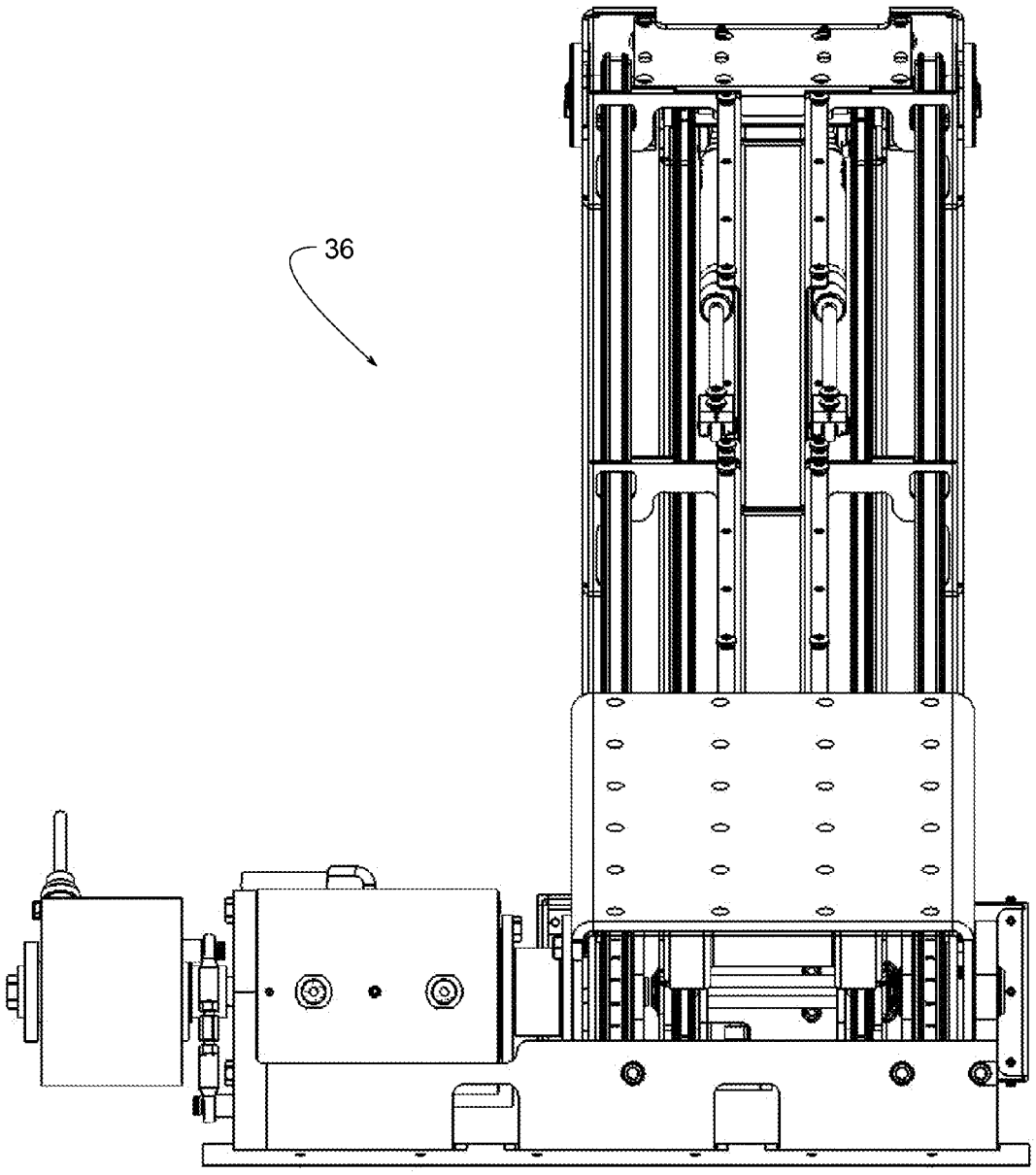
Figure 37:
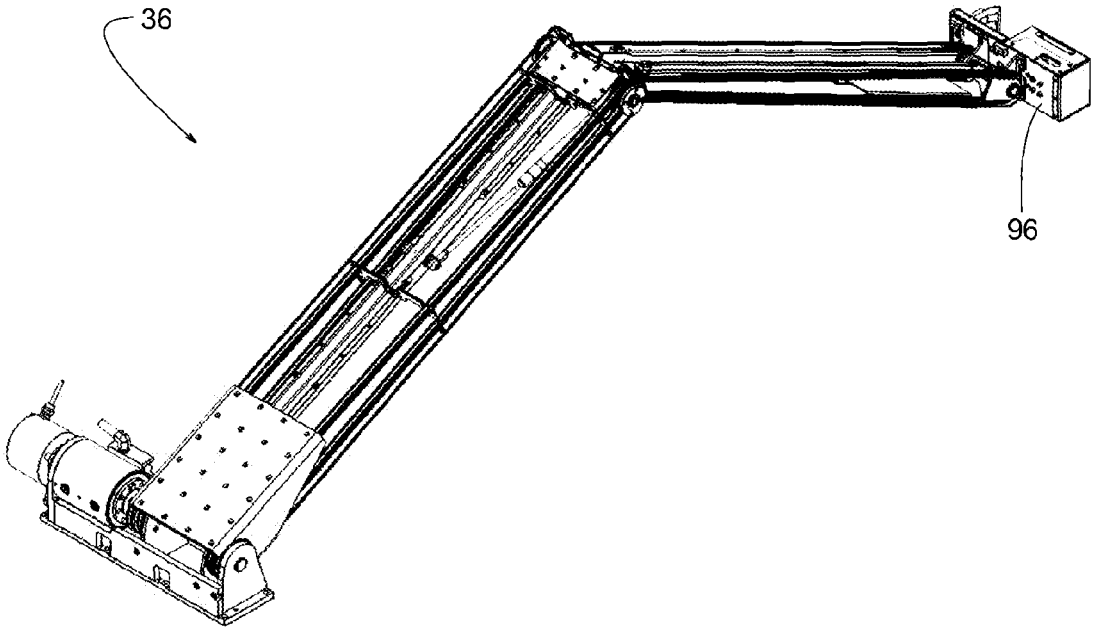
Figure 38:
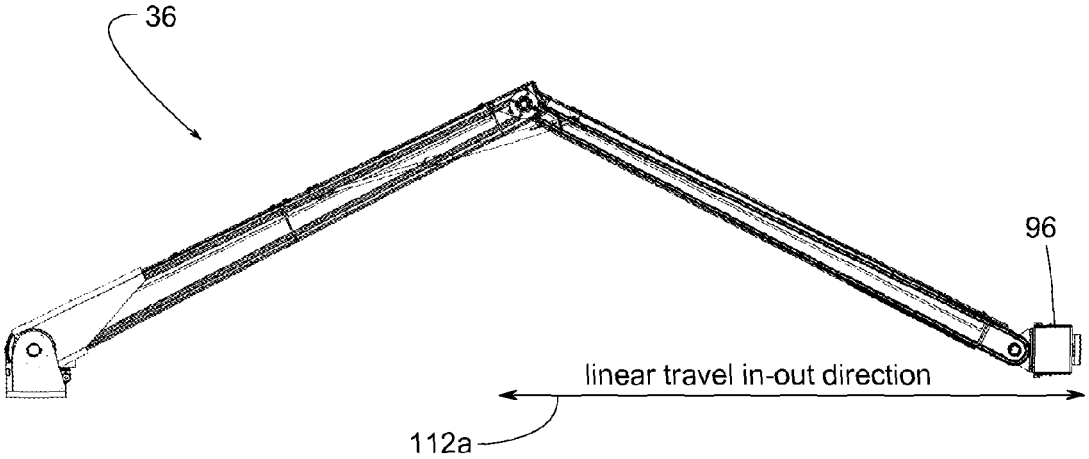
Figure 39:
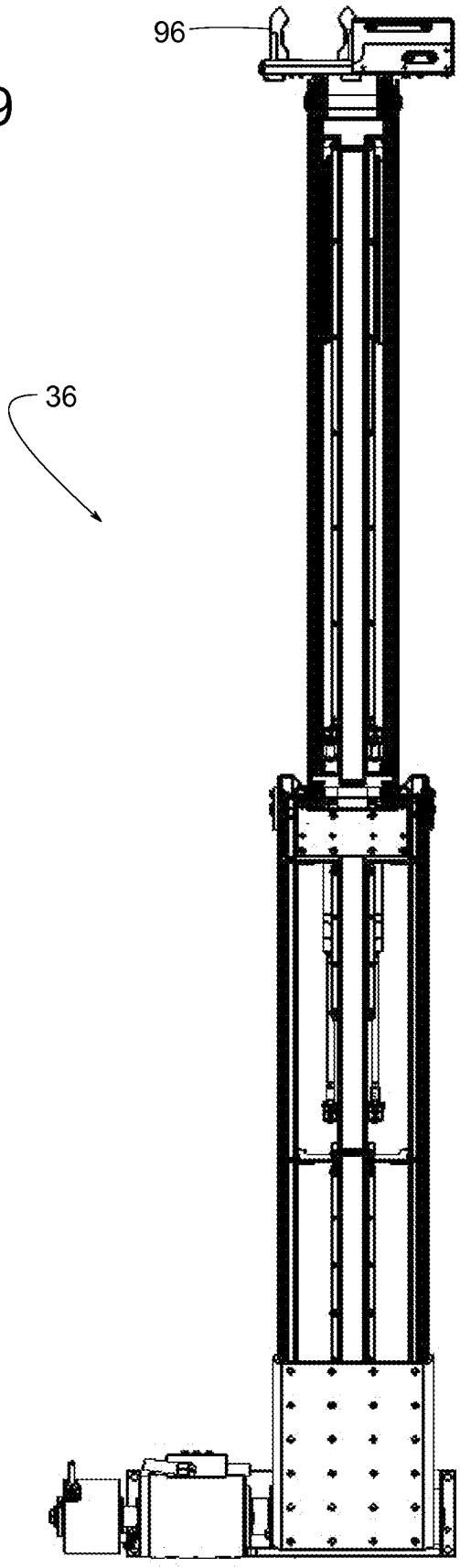
Figure 40:
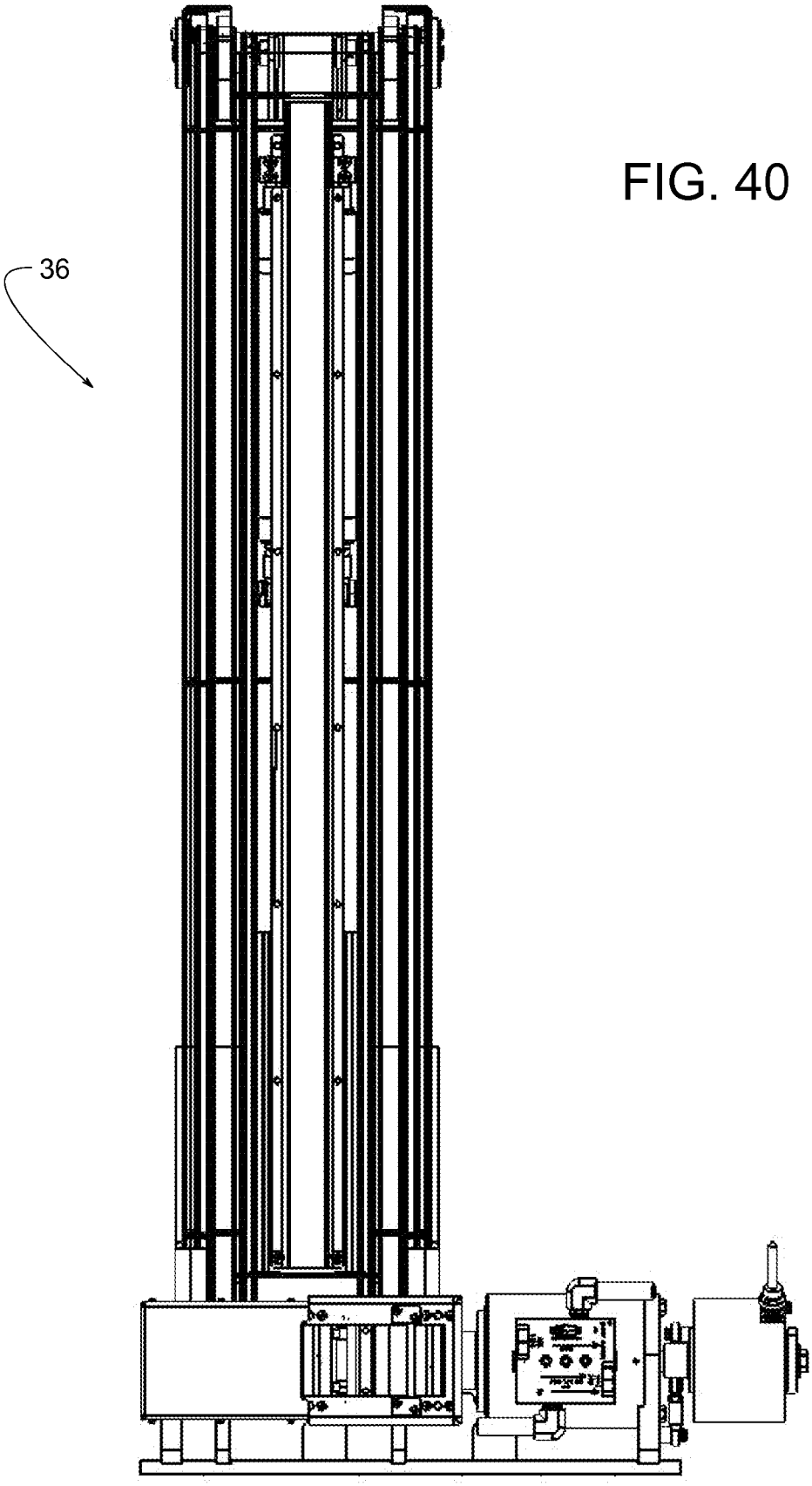
Figure 41:
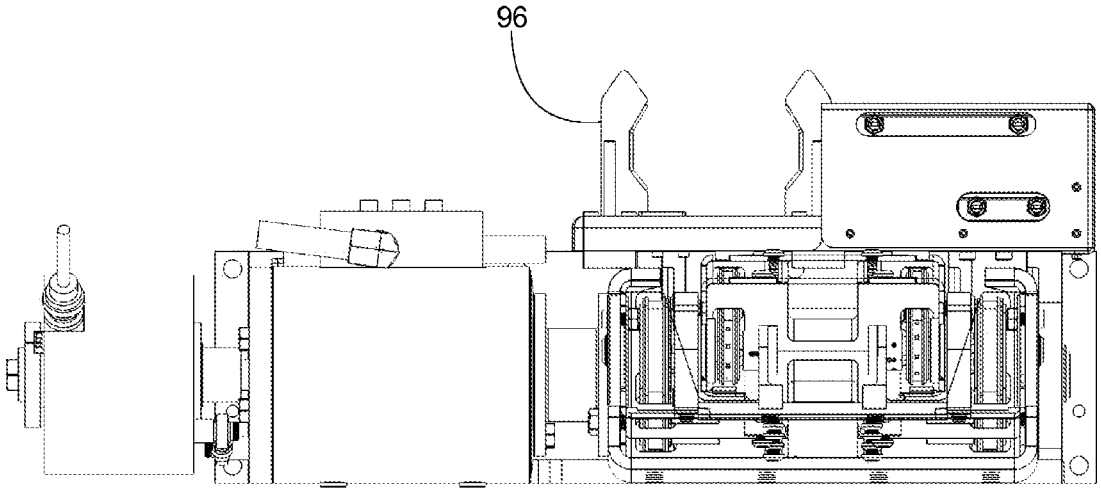
Figure 42:
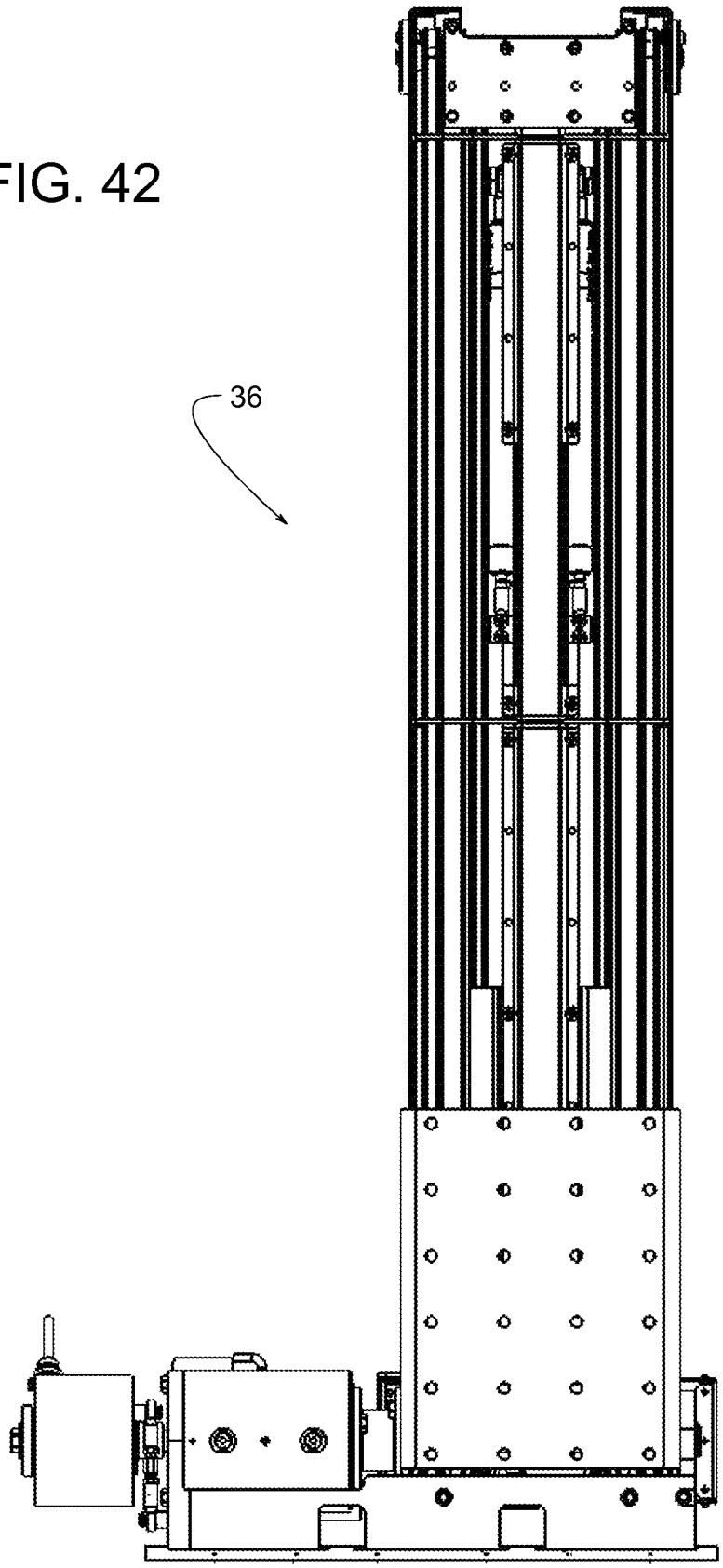
Figure 43:
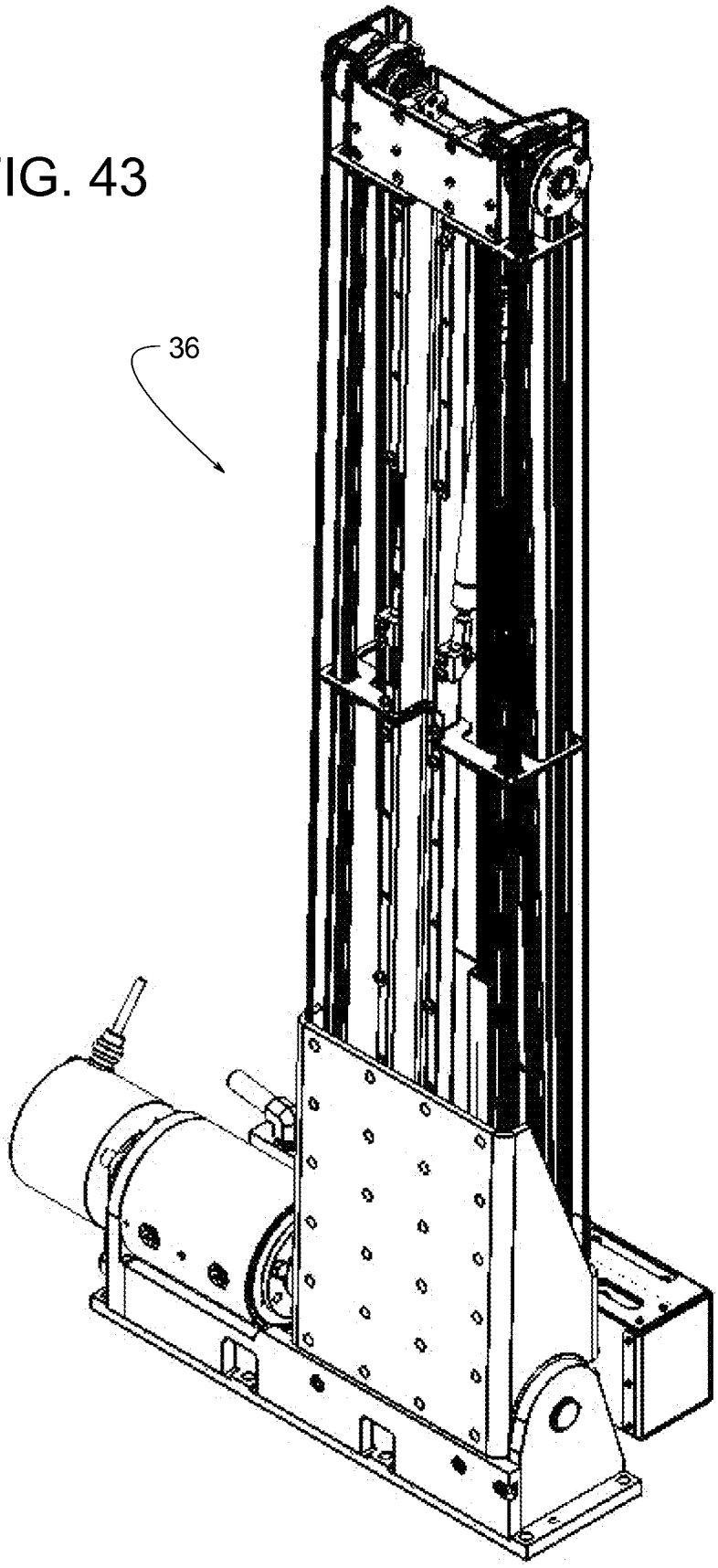
Figure 44:
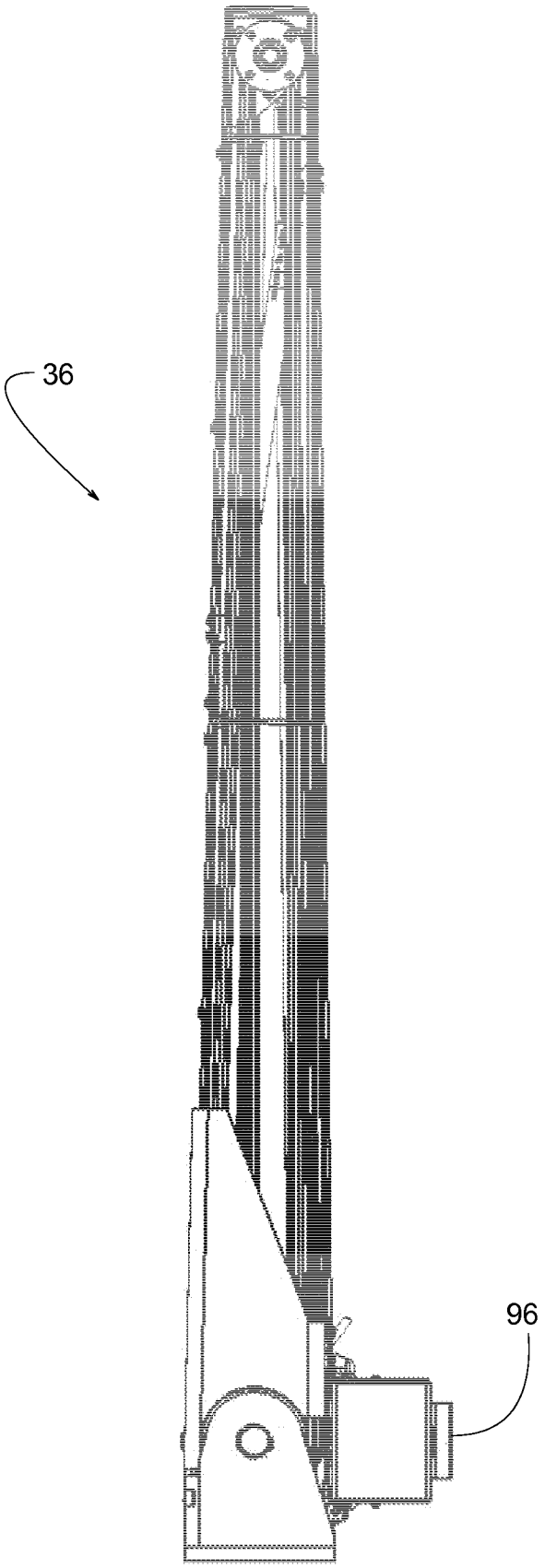
Figure 45:
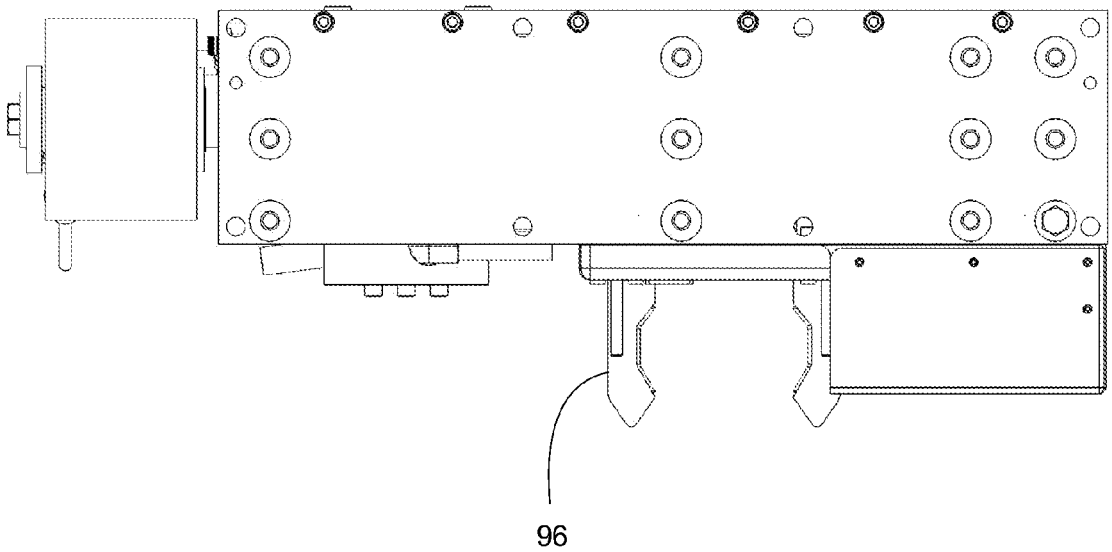
Figure 46:
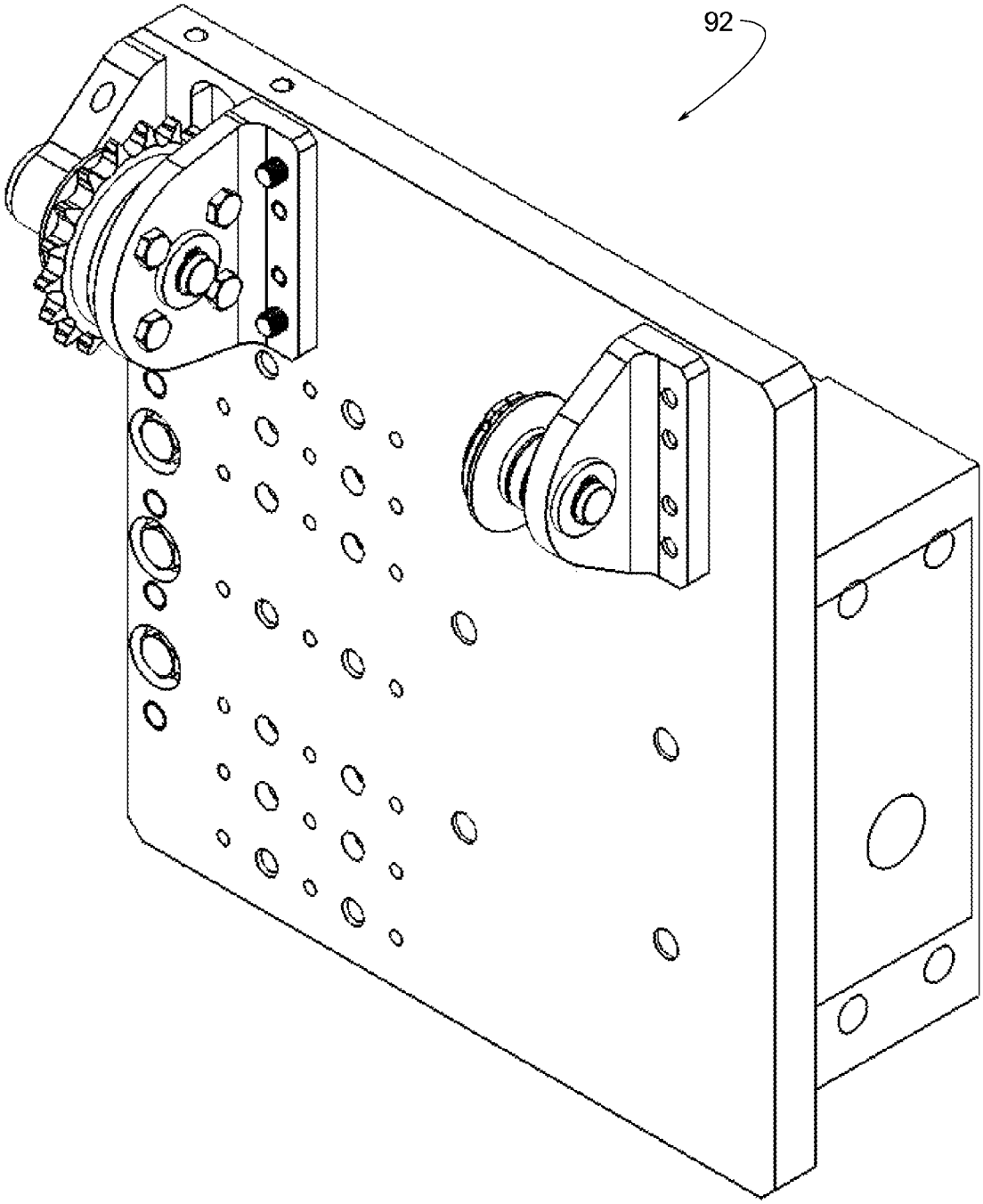
FIGS. 46-49 show various views of an end effector 92 of the upper robot 90.
Figure 47:
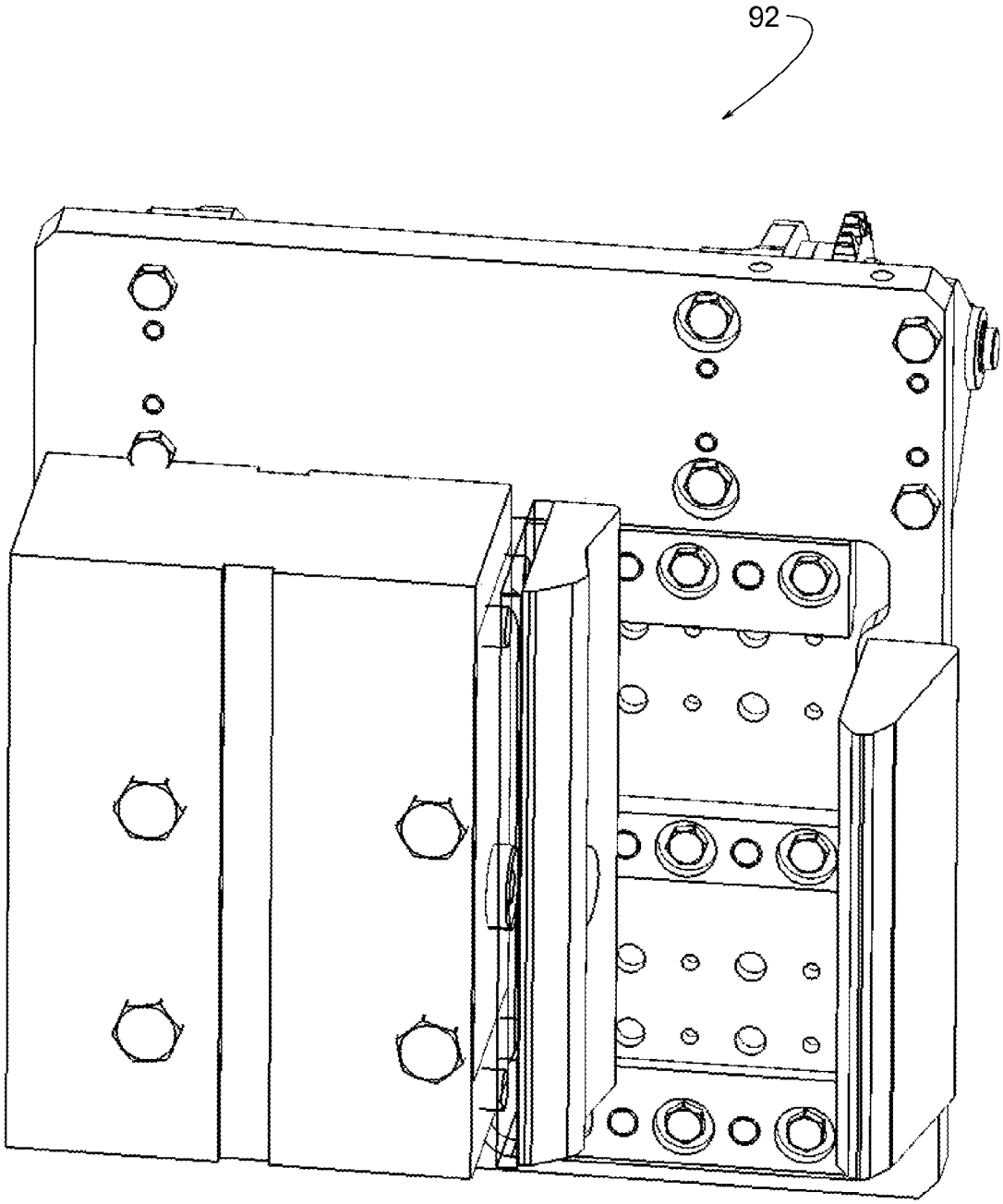
Figure 48:
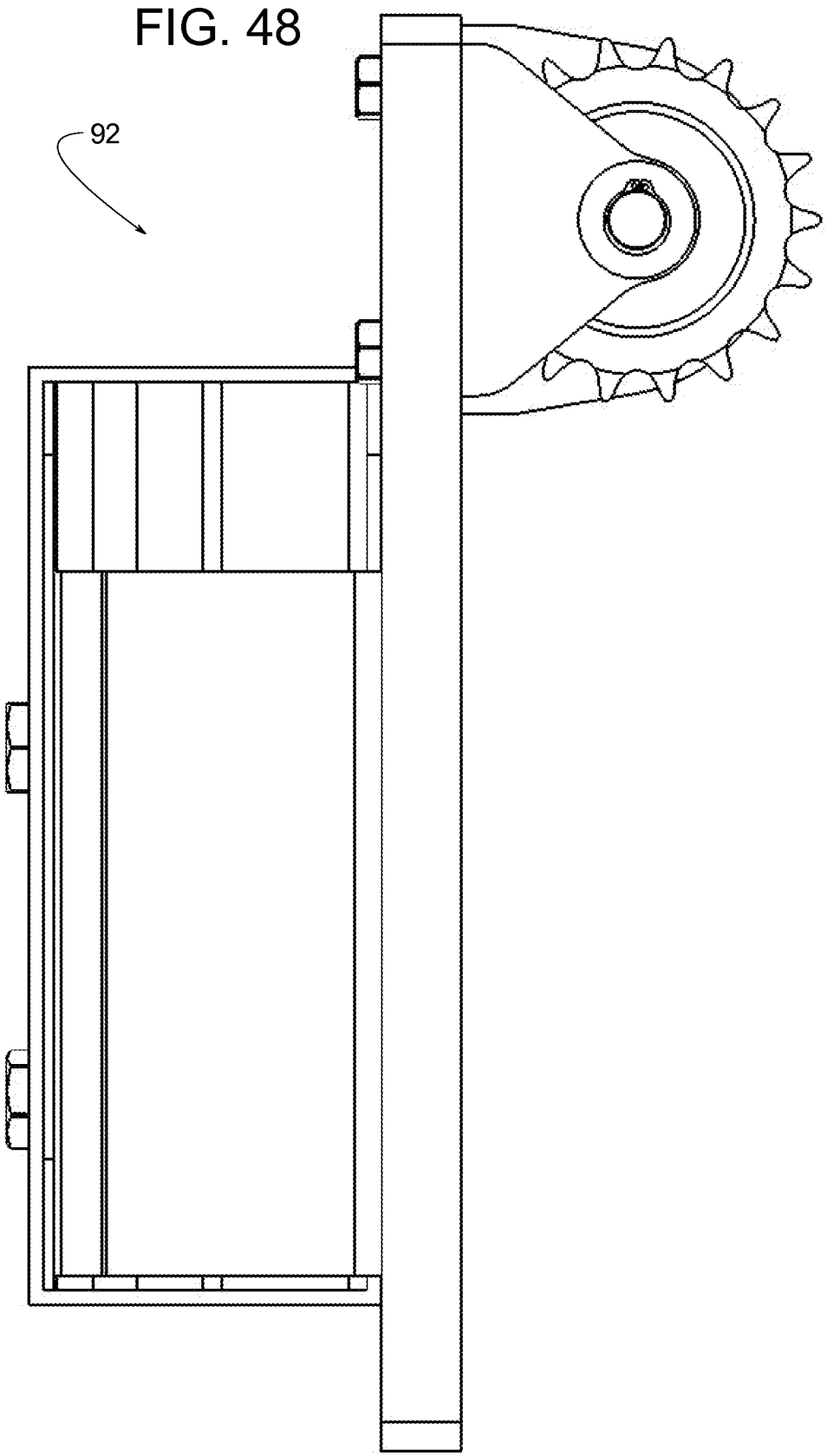
Figure 49:
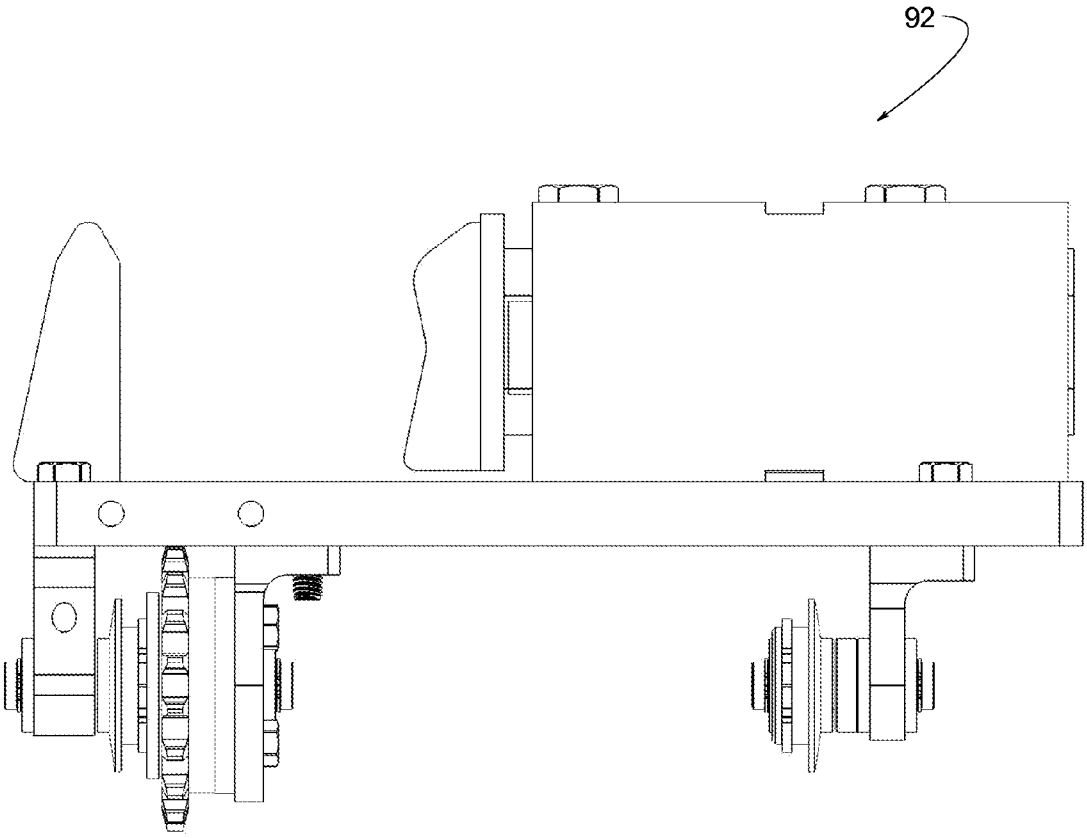
Figure 50:
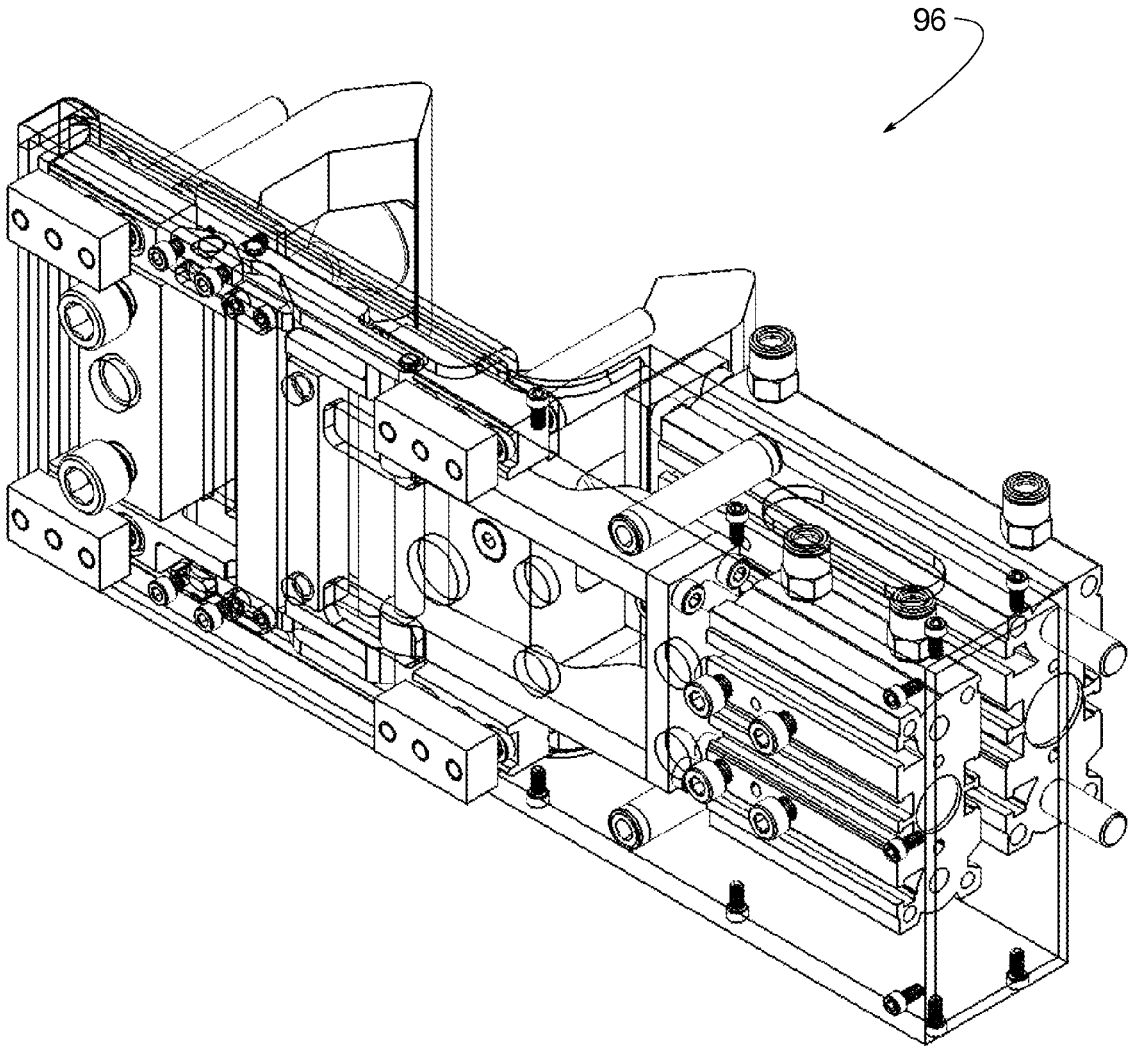
FIGS. 50-54 show various views of an end effector 96 of the lower robot 36.
Figure 51:
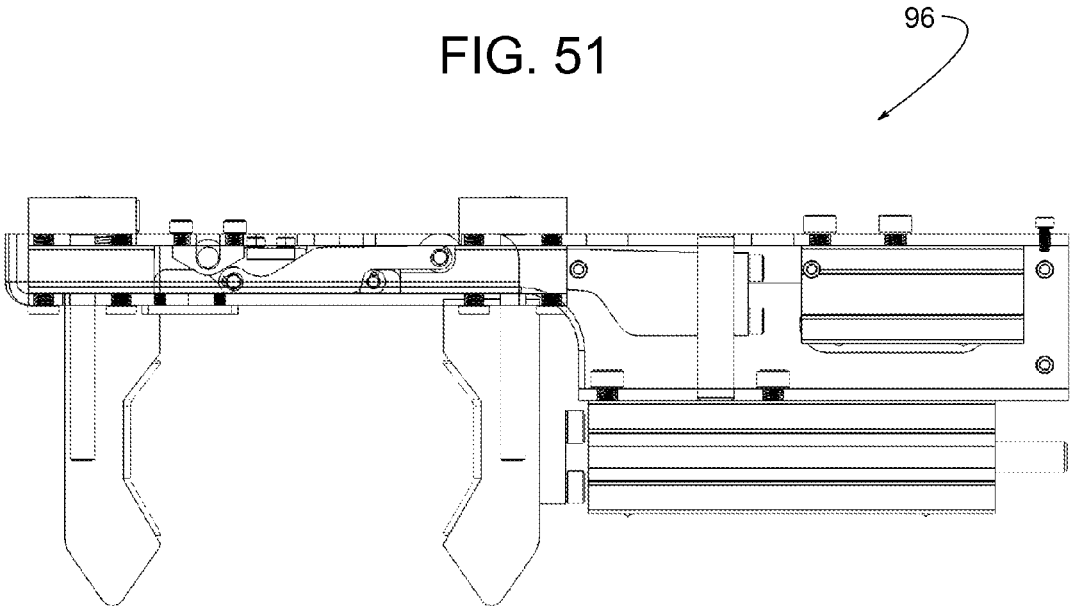
Figure 52:
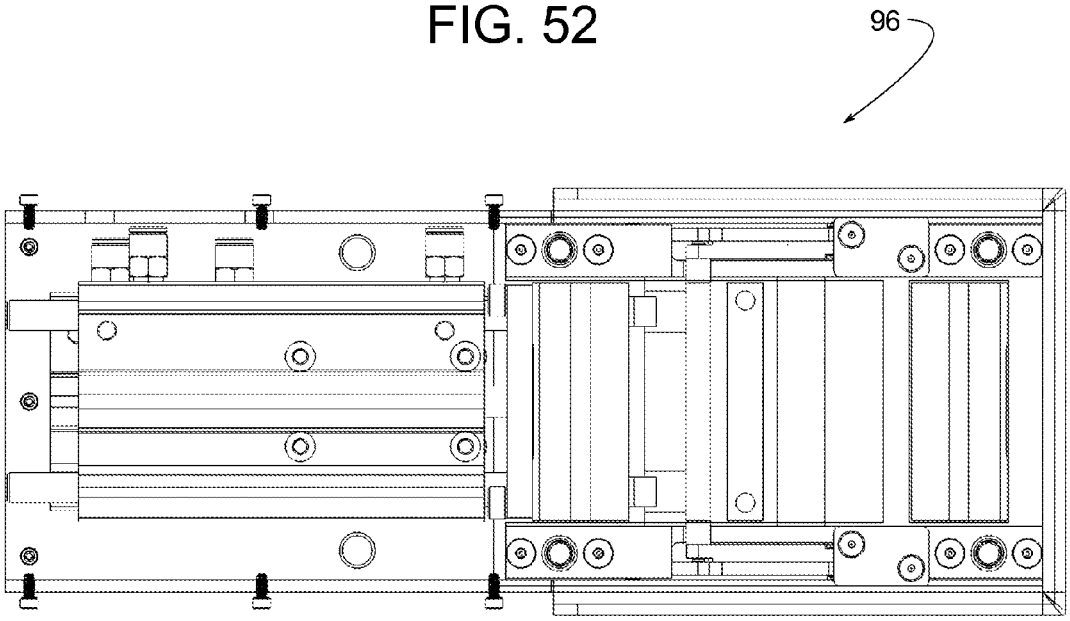
Figure 53:
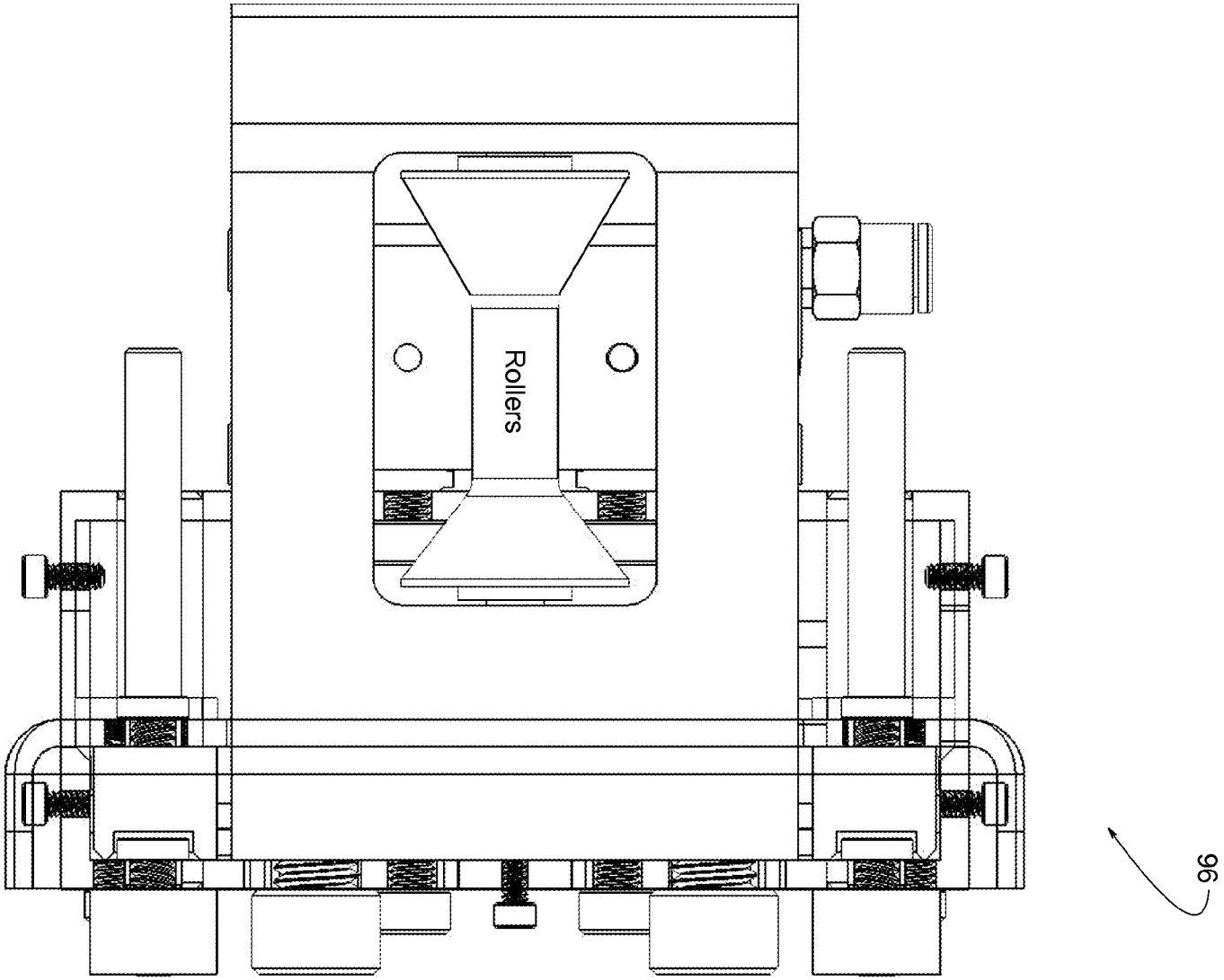
Figure 54:
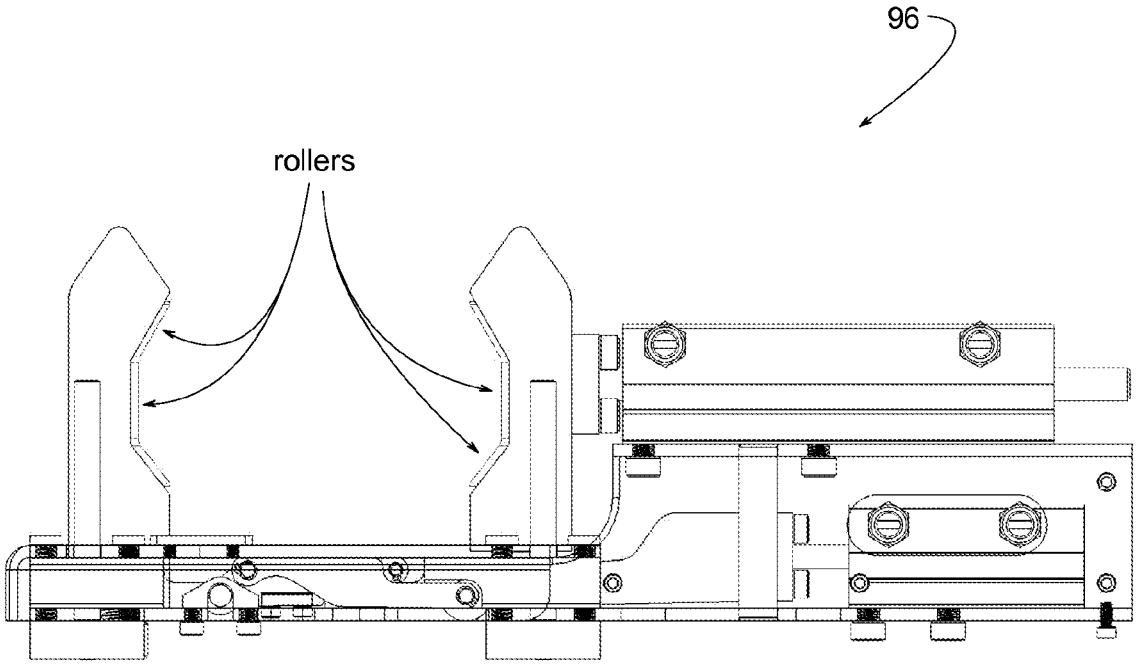
Figure 55:
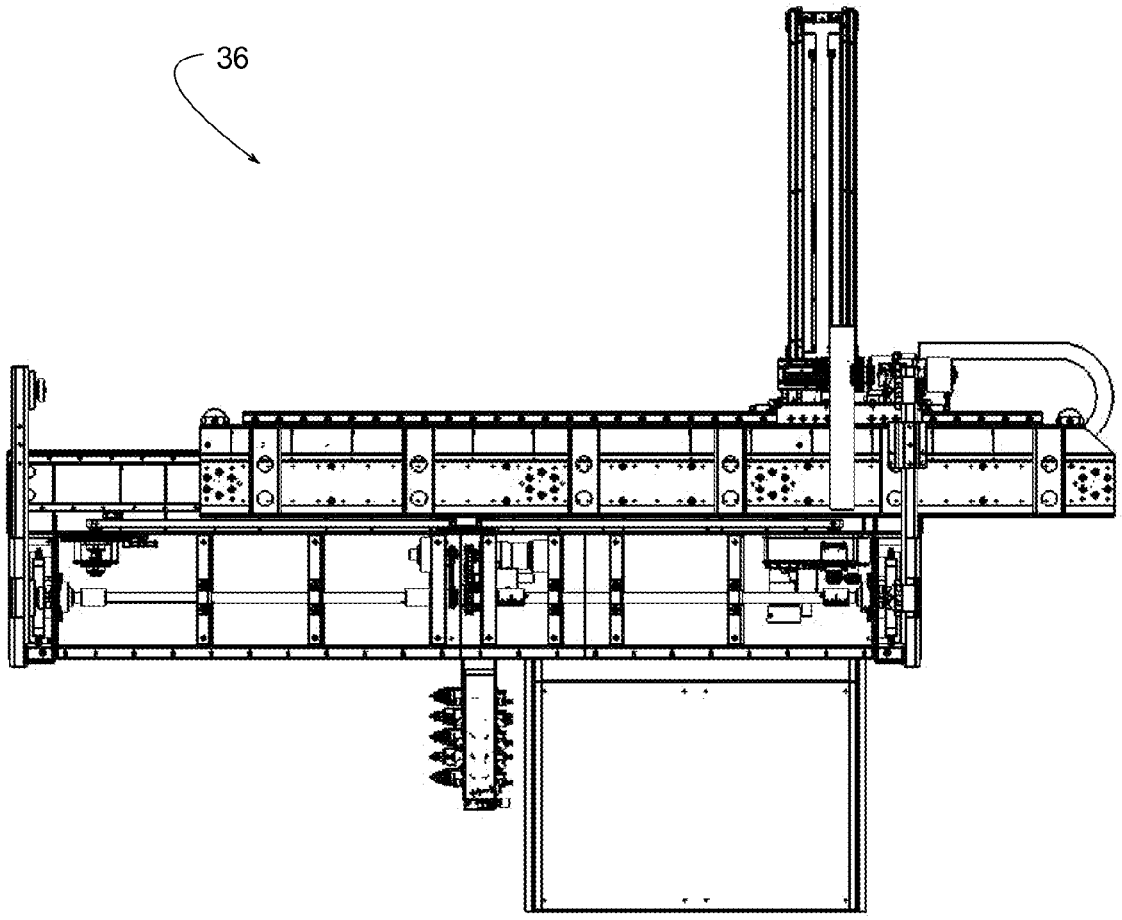
FIG. 55 is a front view of the lower robot 36 with its articulated arm portion retracted.
Figure 56:
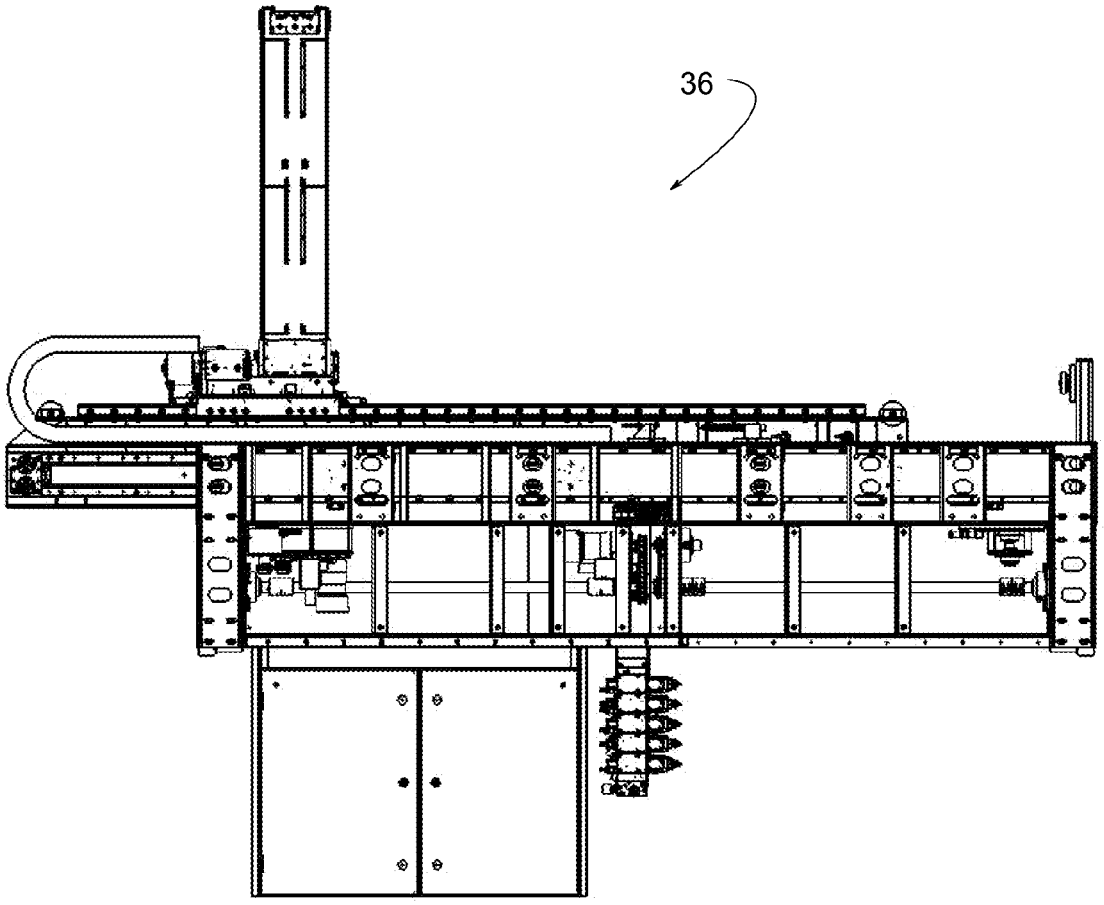
FIG. 56 is a back view of FIG. 55.
Figure 57:
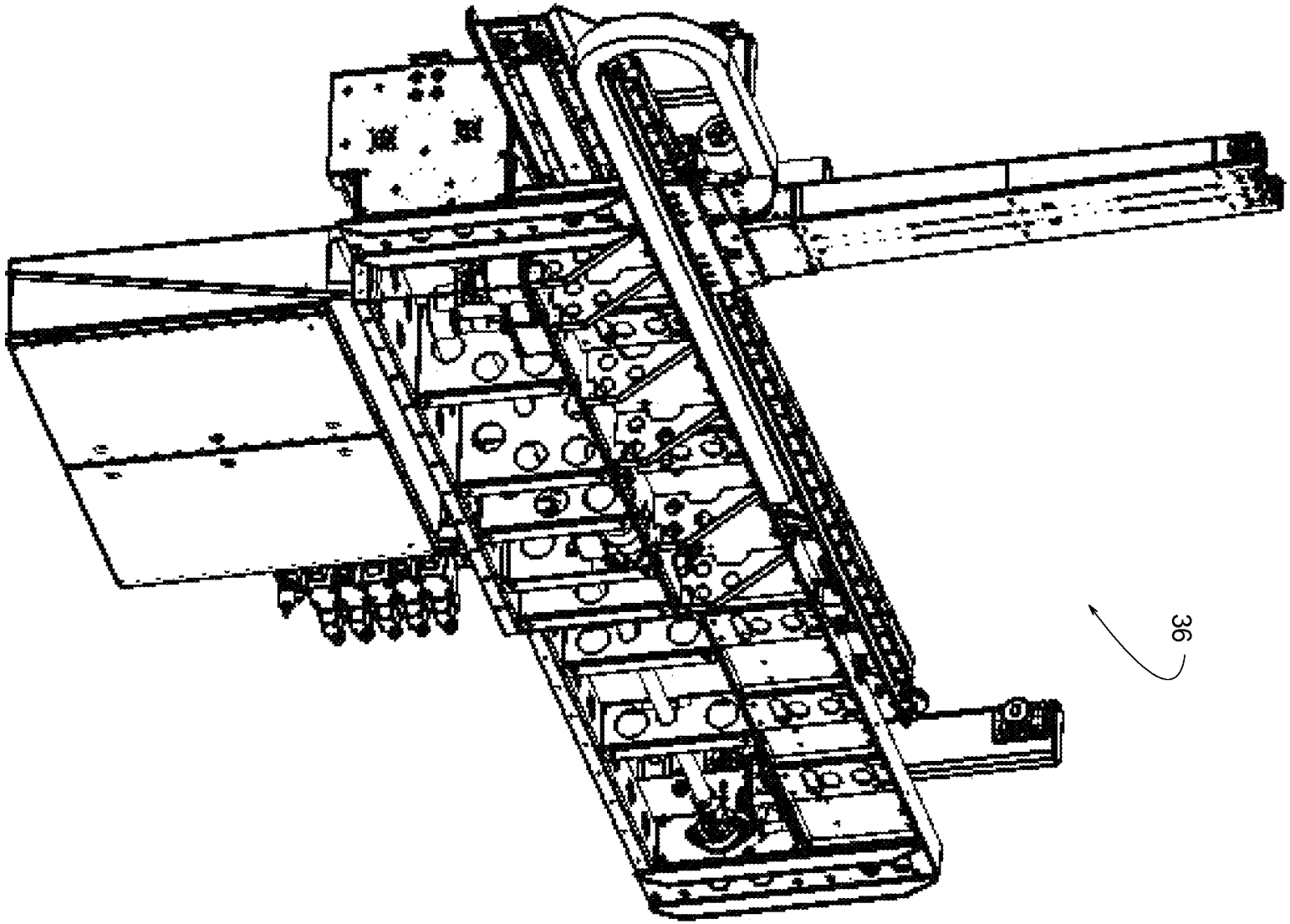
FIG. 57 is a perspective view of the lower robot 36 with its articulated arm portion retracted.
Figure 58:
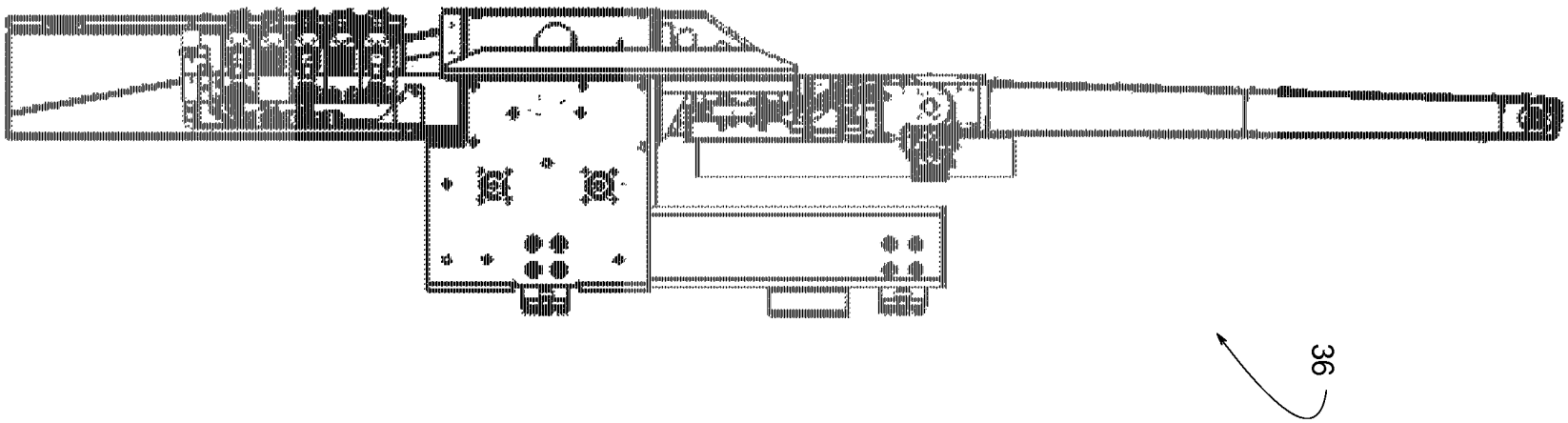
FIG. 58 is a side view of the lower robot 36 with its articulated arm portion retracted.
Figure 59:
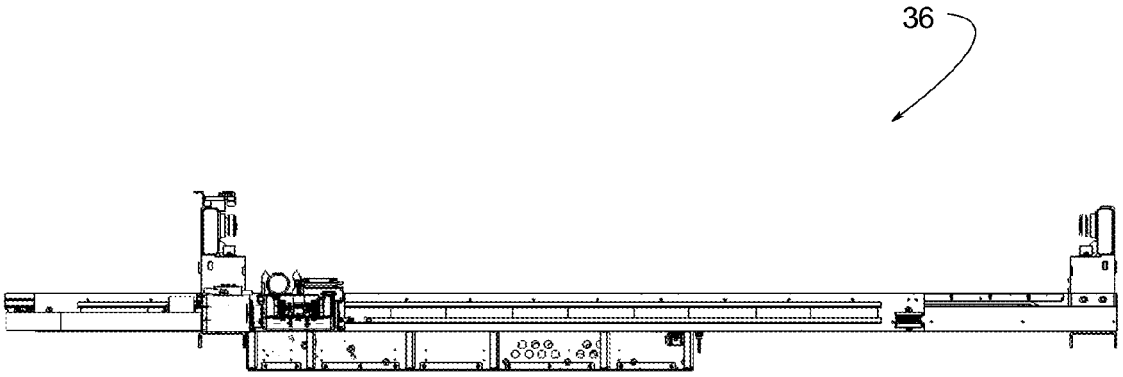
FIG. 59 is a top view of the lower robot 36 with its articulated arm portion retracted.
Figure 60:
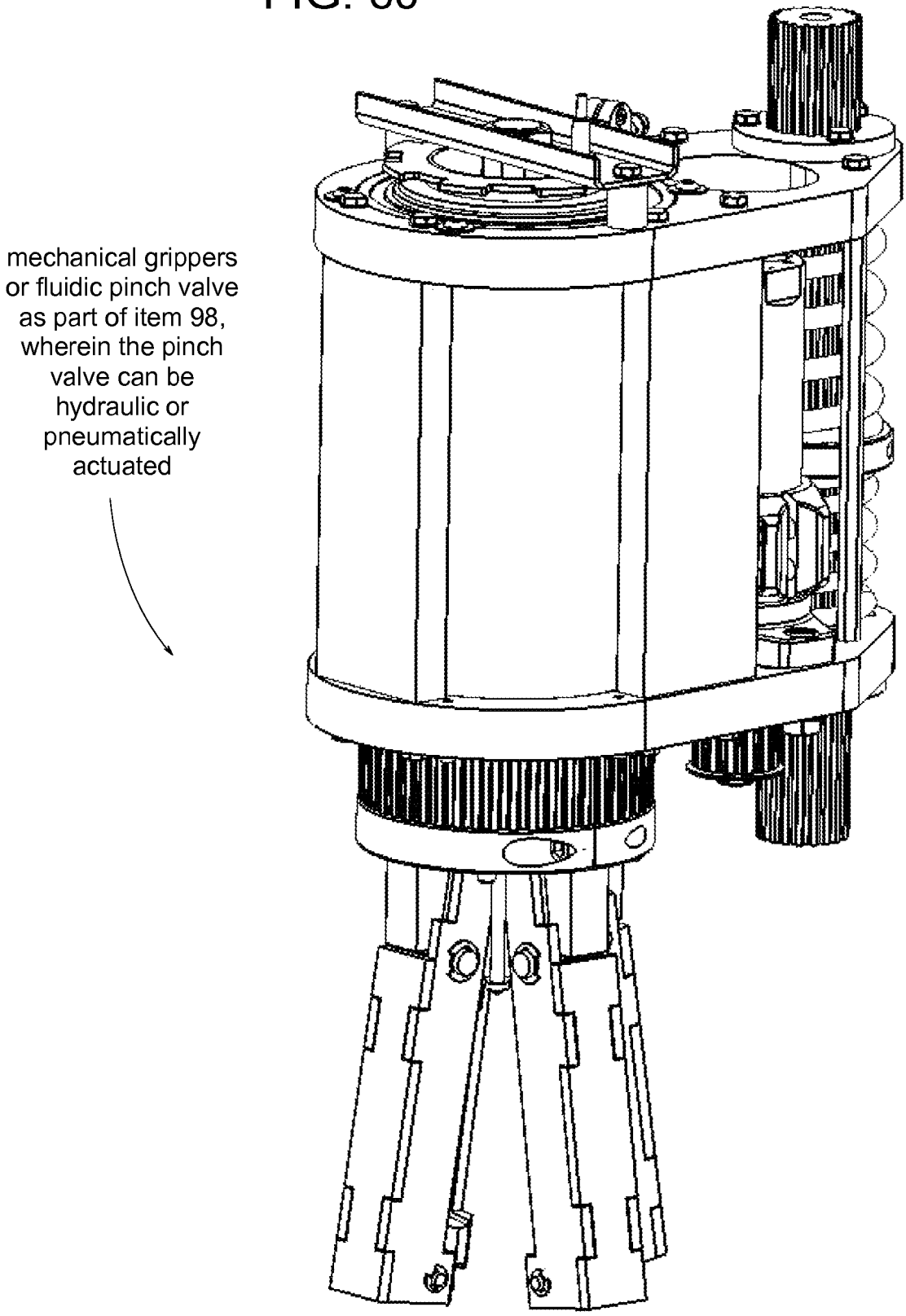
FIG. 60 is a perspective view of a gripper portion of the upper trolley mechanism.
Figure 78:
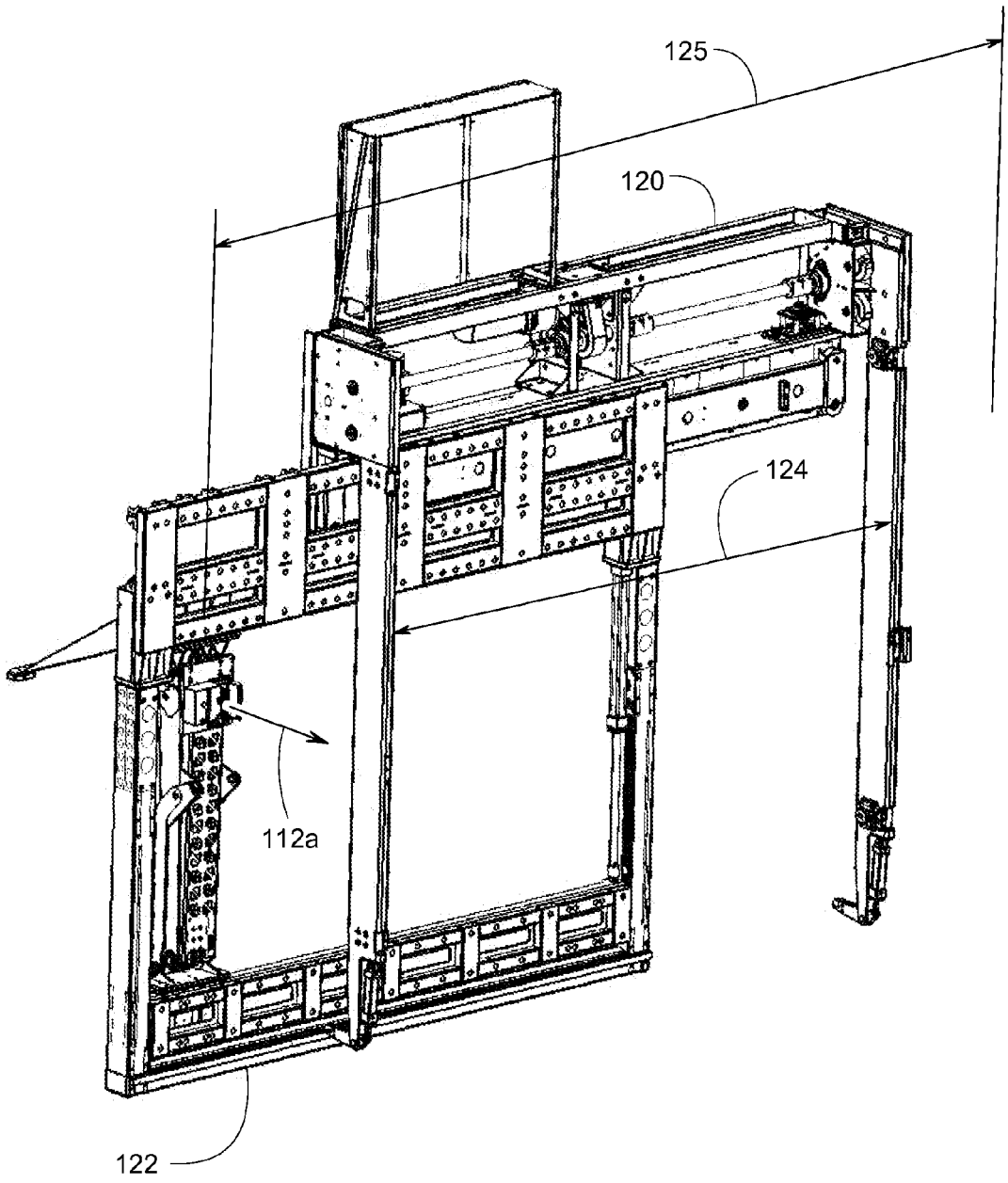
FIG. 78 is a perspective view similar to FIG. 77 but showing the shuttle 122 and the articulated arm both shifted laterally to the other side of carriage 120.

FIGS. 79-98B, with further reference to FIGS. 1-78, illustrate an example method for removing a well string 172 from within a wellbore 14 at a well site 12. In the illustrated example, well site 12 includes a pumpjack 174 with a walking beam 34 and a horse head 176. Pumpjack 174 is used for actuating a reciprocating downhole pump. Wellbore 14 defines a longitudinal centerline 84. Well string 172 when assembled comprises a plurality of shafts 180 interconnected end-to-end, wherein the plurality of shafts 180 includes at least an upper shaft 182 having an upper shaft weight, a lower shaft 184 having a lower shaft weight, and a remaining well string 186 below lower shaft 184. The term, "shaft" means any solid or hollow elongate member used within a wellbore. Examples of shafts include, but are not limited to, sucker rods and tubing. In some examples, upper shaft 182 comprises a plurality of interconnected shaft segments (e.g., two or three). In some examples, upper shaft 182 is a single shaft segment. The same is true for lower shaft 184.

Upper shaft 182 and lower shaft 184 can be anywhere along the full length of the total well string 172. In some examples, shafts 182 and 184 are near the top of well string 172. In some examples, shafts 182 and 184 are near the bottom of well string 172. In some examples, shafts 182 and 184 are at some intermediate elevation along the length of well string 172. The described method for removing well string 172 will explicitly cover the removal of two example shafts 182 and 184 and thus also cover the method for transitioning between the removal of two shafts. The method as described with reference to shafts 182 and 184 also applies to other shafts of well string 172.

The method involves driving a workover vehicle 10 to well site 12. Workover vehicle 10, in some examples, comprises a mast 20, an upper robot 90, a lower robot 36, an upper trolley mechanism 98, and a main trolley 156 carrying an elevator head 106. Mast 20 includes a trolley track system 88 and a transfer track system 86 that are parallel to each other. In some examples, trolley track system 88 is one pair of continuous rails. In some examples, trolley track system 88 comprises an upper set of tracks for upper trolley mechanism 98 and a lower set of tracks for main trolley 156. In some examples, transfer track system 86 is one pair of continuous rails. In some examples, transfer track system 86 comprises an upper set of tracks for upper robot 90 and a lower set of tracks for lower robot 36.

Upper robot 90 comprises an upper carriage 120, an upper shuttle 122 and an articulated upper arm assembly 158. Upper carriage 120 travels vertically along transfer track system 86, as indicated by arrow 198 in FIG. 82A, thus arrow 198 illustrates upper robot 90 selectively ascending and descending along transfer track system 86. Upper shuttle 122 travels along horizontal tracks on upper carriage 120, as indicated by arrows 160 in FIG. 82B. Upper arm assembly 158 travels along horizontal tracks on upper shuttle 122, as indicated by arrows 162 in FIG. 82B. The term, "robot" and derivatives thereof means any computer or microprocessor controlled mechanism for moving a part (e.g., a shaft such as a sucker rod or tubing) in multiple dimensions or directions simultaneously or sequentially.

Likewise, lower robot 36 comprises a lower carriage 121, a lower shuttle 123 and an articulated lower arm assembly 164. Lower carriage 121 travels vertically along transfer track system 86, as indicated by arrow 200 in FIG. 82A, thus arrow 200 illustrates lower robot 36 selectively ascending and descending along transfer track system 86. Lower shuttle 123 travels along horizontal tracks on lower carriage 121, as indicated by arrows 166 in FIG. 82B. Lower arm assembly 164 travels along horizontal tracks on lower shuttle 123, as indicated by arrows 168 in FIG. 82B. The various components of robots 36 and 90 are capable of moving independently and in unison, depending on the need. Arrow 210 of FIG. 83A, for instance, shows lower carriage 121 descending while upper carriage 120 is stationary to vary a vertical separation distance 212 between robots 36 and 90, thus arrow 210 illustrates varying vertical separation distance 212 between upper robot 90 and lower robot 36 as a result of lower robot 36 traveling relative to upper robot 90.

Figure 80:
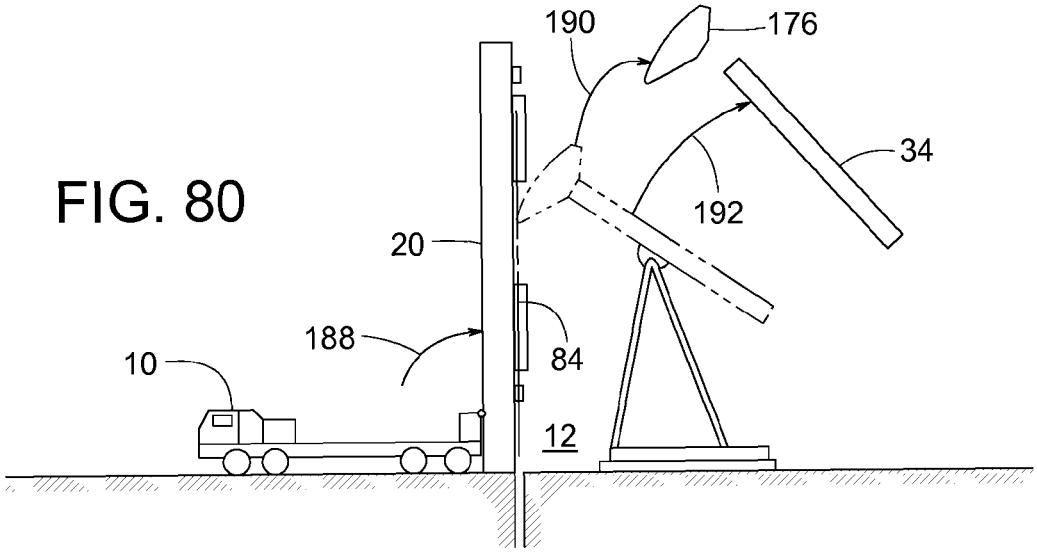
FIG. 80 is a schematic side view similar to FIG. 79 but showing a mast of the workover vehicle being raised.
Figure 81:
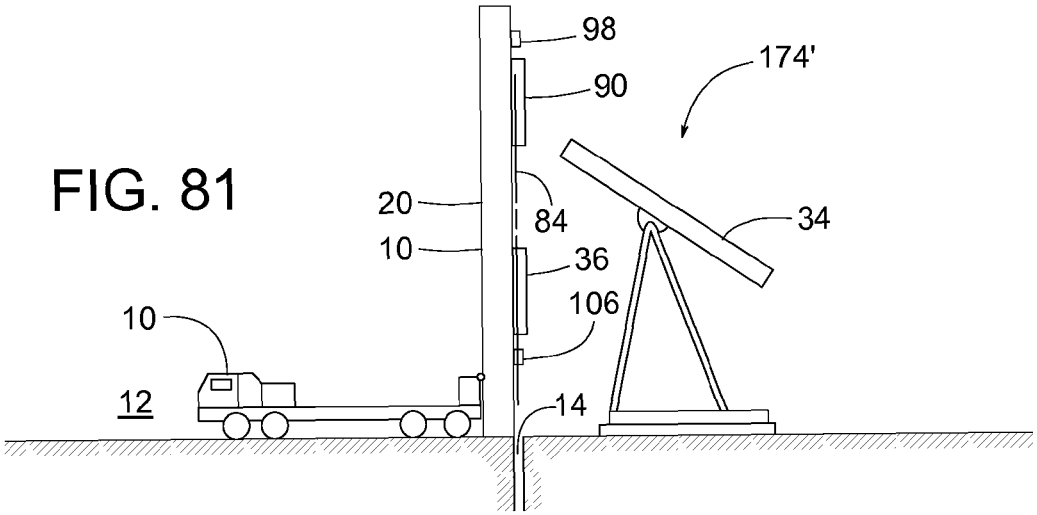
FIG. 81 is a schematic side view similar to FIGS. 79 and 80.

After driving vehicle 10 to well site 12, a mast 20 of vehicle 10 is pivotally raised at well bore 14, as indicated by arrow 188 of FIG. 80. To provide working clearance 48 (FIG. 82A) with adjacent pumpjack 174, horse head 176 plus sometimes walking beam 34 are removed from pumpjack 174, as indicated by arrows 190 and 192 of FIG. 80. FIG. 81, for instance, shows an example where horse head 176 is removed while walking beam 34 is left in place.

Figure 79:
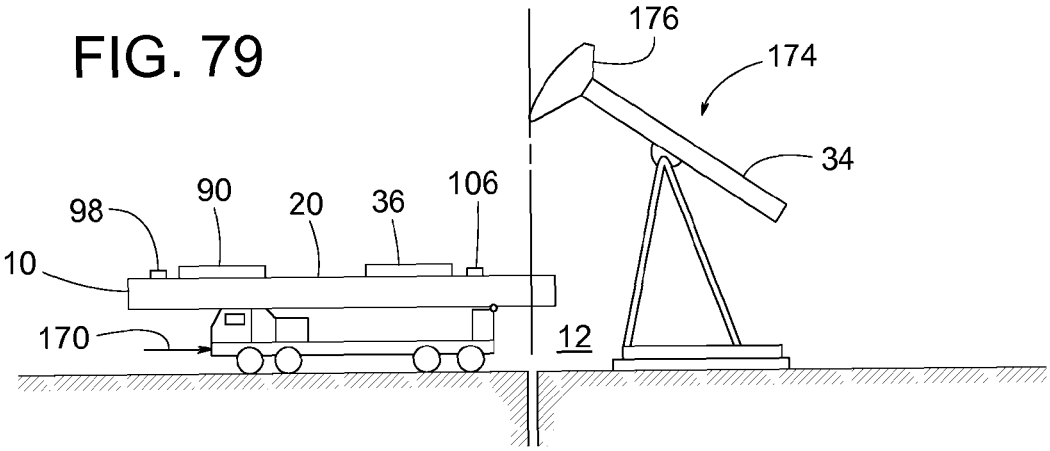
FIG. 79 is a schematic side view of an example workover vehicle driving to and parking at a well site.
Figure 82A:
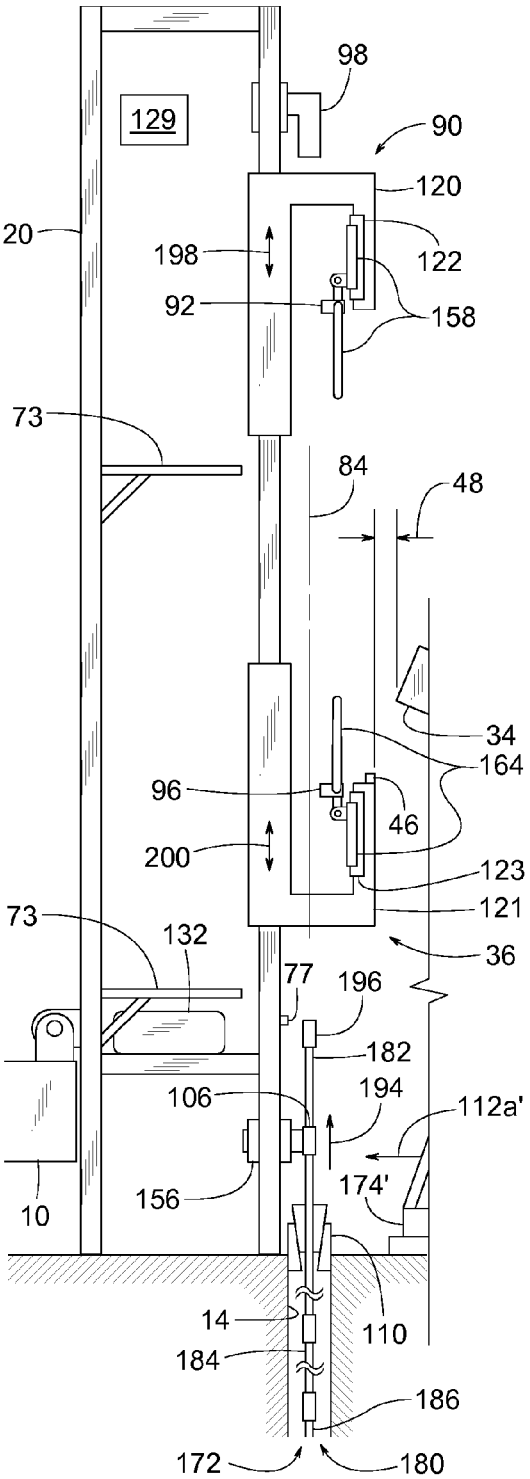
FIG. 82A is a schematic side view of the workover vehicle being used for removing a well string.

In some examples, removing well string 172 involves various actions, which are illustrated in the drawings but not necessarily performed in the following order. Arrow 170 of FIG. 79 represents driving workover vehicle 10 to well site 12, and FIGS. 80, 81 and 82A illustrate leaving at least a portion 174' of pumpjack 174 intact at well site 12. Arrow 170 and FIGS. 79, 80, 81 and 82A represent parking workover vehicle 10 at well site 12 such that longitudinal centerline 84 is interposed between workover vehicle 10 and intact portion 174' of pumpjack 174. An imaginary vector 112*a*' pointing horizontally from intact pumpjack portion 174', passing through longitudinal centerline 84 toward workover vehicle 10 defines a forward direction, and an imaginary horizontal line 112*b* perpendicular to forward direction 112*a*' defines a lateral direction.

Figure 82B:
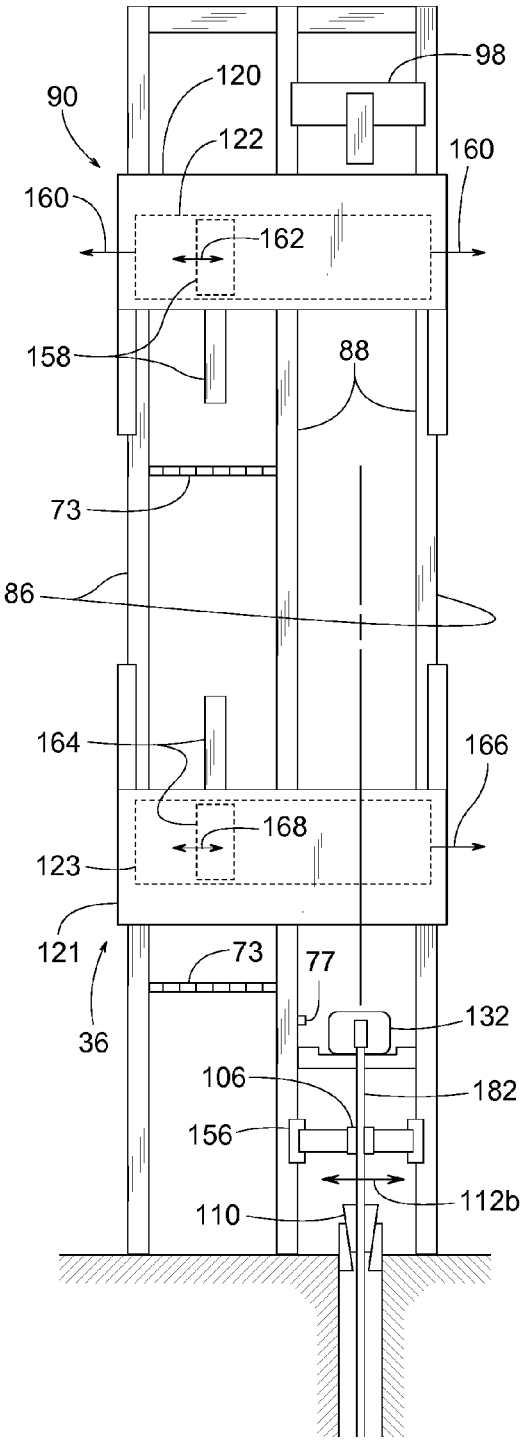
FIG. 82B is a schematic right end view of FIG. 82A.

FIGS. 82A and 82B show a wellhead slip 110 clamping onto upper shaft 182 and supporting most of the weight of upper shaft 182, lower shaft 184 plus the weight of the remaining well string 186. In some examples, wellhead slip 110 comprises a series of wedges circumferentially distributed around well string 172. In some examples, the wedges are selectively clamped (e.g., FIG. 82A) and released (e.g., FIG. 84A) by air-over-hydraulic actuation under command of a controller 129 (e.g., computer, programmable logic controller, etc.).

In some examples, controller 129 controls the movement and timing coordination of generally all of the working components associated with workover vehicle 10. In some examples, controller 129 controls the movement and timing coordination of less than all of the working components associated with workover vehicle 10. Examples of such working components include, but are not limited to, tongs mechanism 132, main trolley 156, elevator head 106, lower robot 36, upper robot 90, upper trolley mechanism 98, various sensors, encoders, motors, piston/cylinders, pumps, hydraulic valves, actuators, pneumatic valves, etc. In some examples, the movement of the various working components is driven by available means examples of which include, but are not limited to, piston/cylinders, electric motors, hydraulic motors, pneumatic motors, chain and sprockets, etc.

Figure 83A:
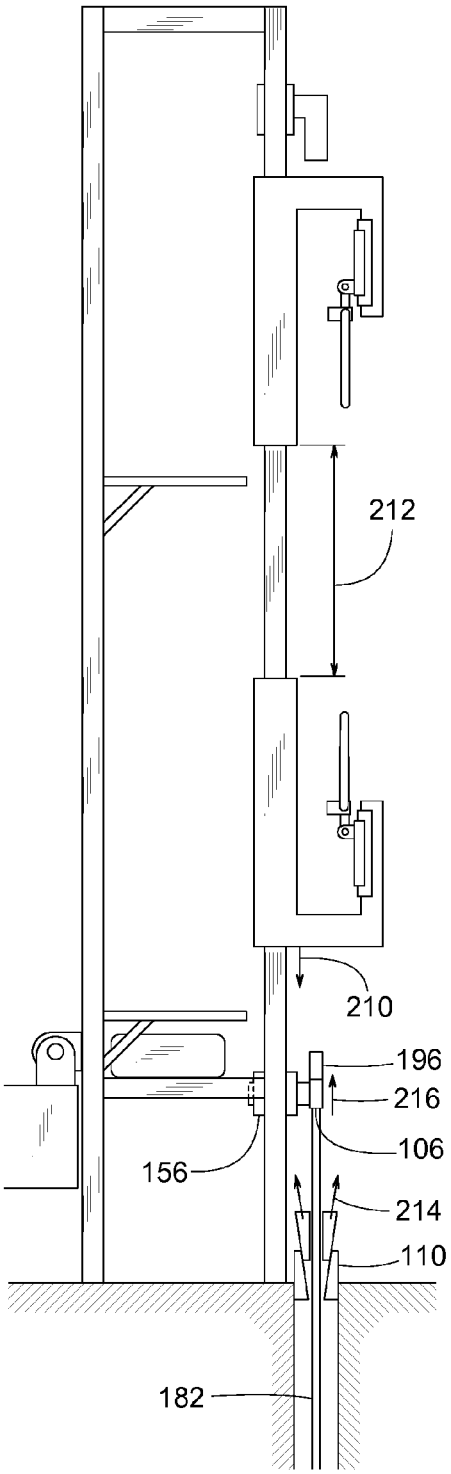
FIG. 83A is another schematic side view of the workover vehicle being used for removing the well string.
Figure 83B:
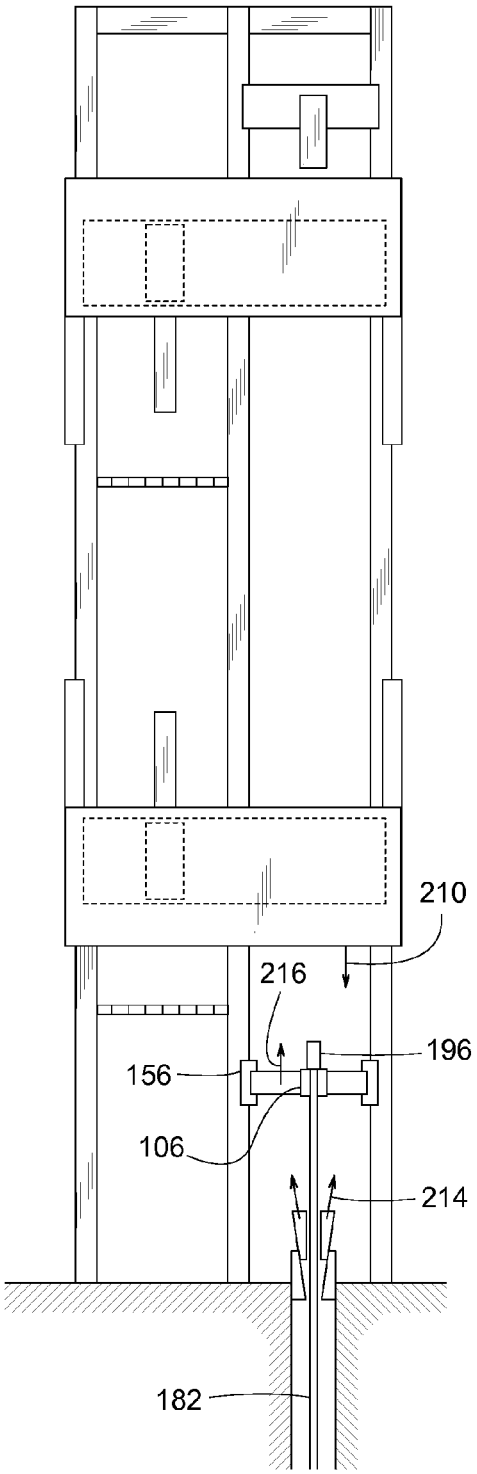
FIG. 83B is a schematic right end view of FIG. 83A.
Figure 86A:
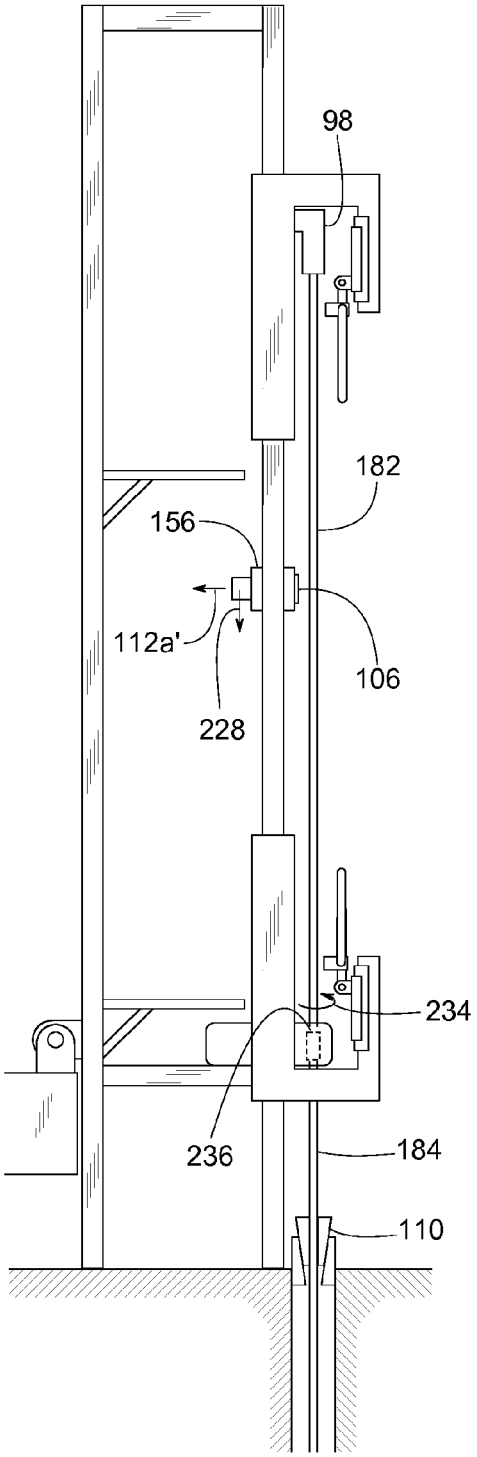
FIG. 86A is another schematic side view of the workover vehicle being used for removing the well string.
Figure 86B:
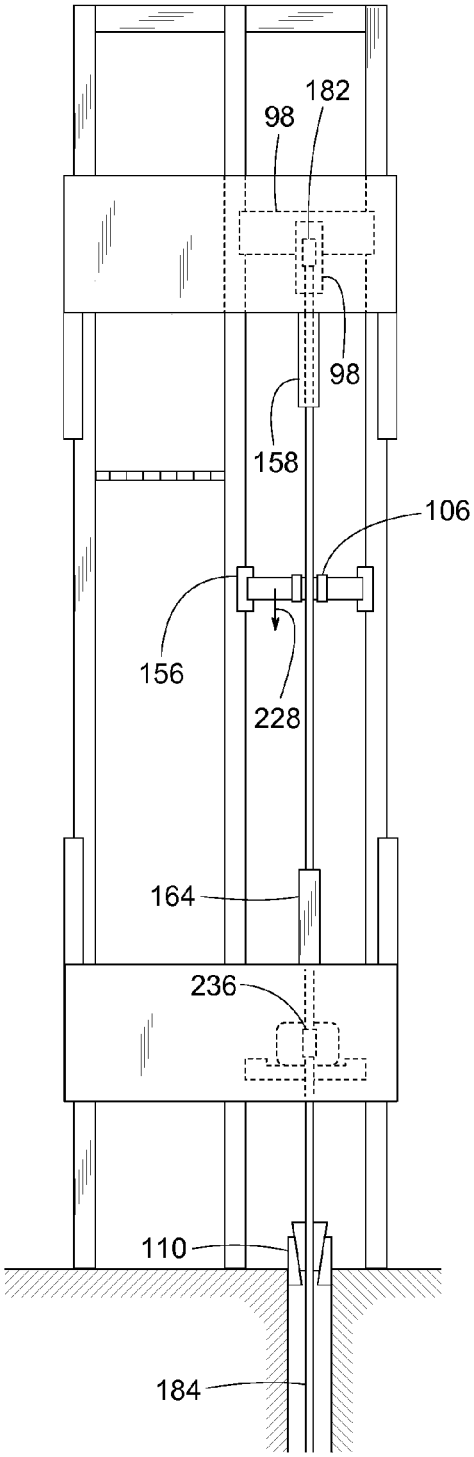
FIG. 86B is a schematic right end view of FIG. 86A.

While wellhead slip 110 is supporting the weight of well string 172, controller 4 commands main trolley 156 to travel upward (arrow 194 of FIG. 82A) along trolley track system 88 until elevator head 106 captures an upper end 196 of upper shaft 182 as shown in FIGS. 83A and 83B. In some examples, upper end 196 is a coupling or collar with internal threads for joining two shafts end-to-end. FIGS. 86A and 86B show the jaws of elevator head 106 retracted and open, and FIGS. 83A and 83B show the jaws of elevator head 106 extended and closed for capturing upper shaft 182. Elevator head 106 is schematically illustrated to represent any device for engaging and lifting a shaft (e.g., shaft 182 and 184). In some examples, elevator head 106 includes jaws for selectively engaging and releasing the upper end of a shaft. In some examples, such jaws clamp onto and capture the shaft or a collar thereon. In some examples, elevator jaws do not clamp onto the shaft or collar thereon but instead hook onto or otherwise capture the upper end of the shaft. Examples of non-clamping elevator jaws include, but are not limited to, a U-shaped holder, latch, hook, fork, yoke, clevis, etc. In some examples, elevator head 106 selectively extends and retracts (in direction 112*a*) relative to main trolley 156.

Figure 84A:
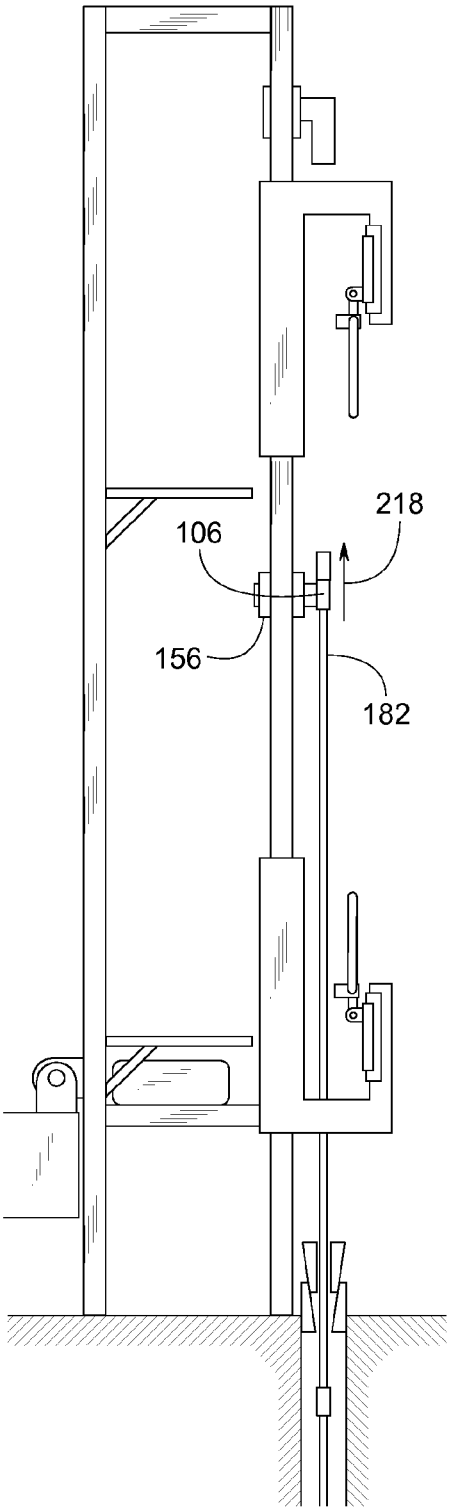
FIG. 84A is another schematic side view of the workover vehicle being used for removing the well string.
Figure 84B:
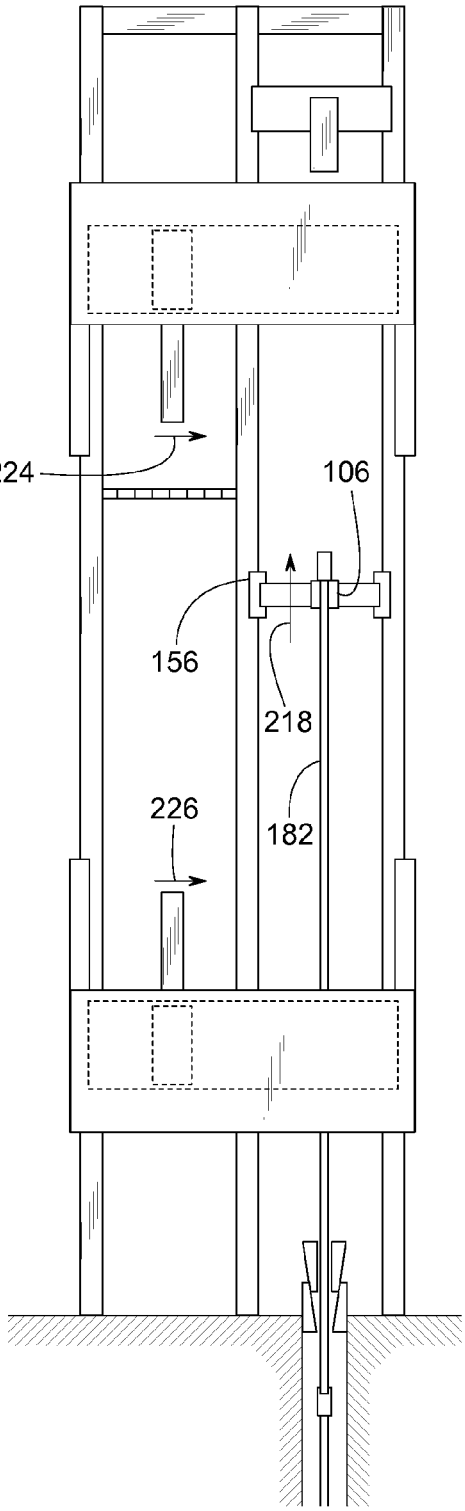
FIG. 84B is a schematic right end view of FIG. 84A.

Referring to FIGS. 83A and 83B, arrows 214 represent wellhead slip 110 releasing upper shaft 182. Arrow 216 represents transferring most of the upper shaft's weight and the lower shaft's weight from wellhead slip 110 to elevator head 106. Arrow 216 of FIGS. 83A and 83B and arrow 218 of FIGS. 84A and 84B represent main trolley 156 traveling upward at a first peak velocity along trolley track system 88, thereby raising well string 172 and lifting upper shaft 182 out from within well bore 14. FIGS. 84A and 84B also show that in some examples articulated upper arm assembly 158 and articulated lower arm assembly 164 translate laterally closer to centerline 84, as indicated by arrows 224 and 226.

To determine when to stop lifting well string 172 and begin the operations shown in FIGS. 85A, 85B, 86A, 86B, 92A, 92B, 93A and 93B, some examples of workover vehicle 10 include a coupling sensor 77 (see FIGS. 82A and 82B) for sensing when a well string joint is at a predetermined desired elevation. Sensor 77 enables the automation of the well string removal method without the necessity of manual intervention between each cycle (one cycle being the removal of one well string shaft). In some examples, joint sensor 77 is a non-contact proximity sensor (e.g., Hall Effect, optical detection, ultrasonic detection, laser, etc.), that provides a signal to controller 129 upon sensing the proximity of an enlarged-diameter section of well string 172, wherein such an enlarged-diameter section is evidence of a joint. The step of sensing a joint (first joint, second joint, etc.) is at a predetermined desired elevation is illustrated in FIGS. 61B and 63A by way of the encircled action labeled, "Sensor detects collar: stop."

Figure 85A:
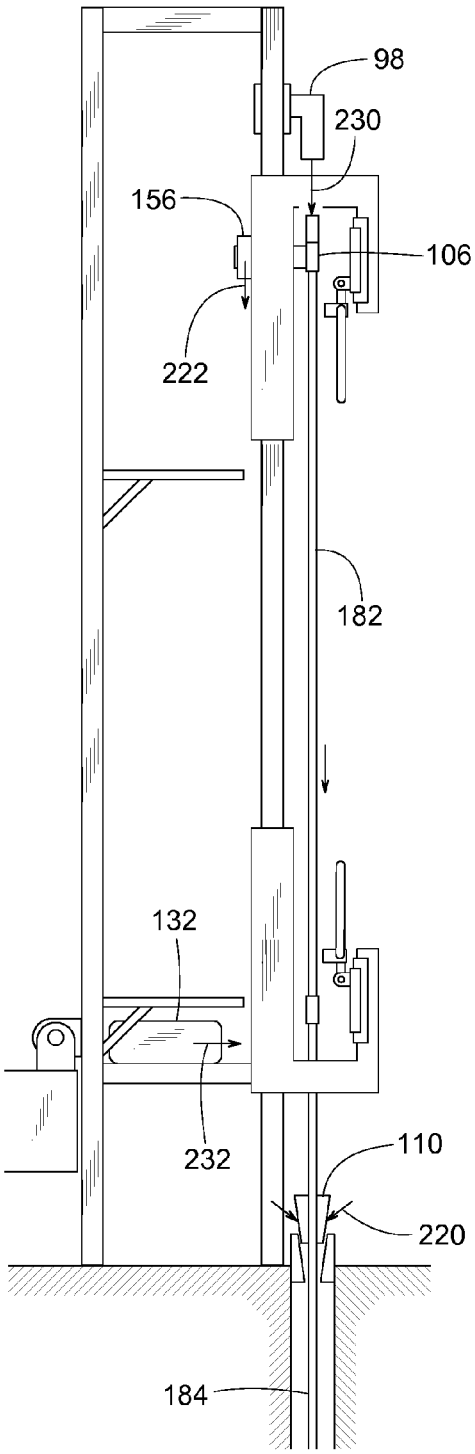
FIG. 85A is another schematic side view of the workover vehicle being used for removing the well string.
Figure 85B:
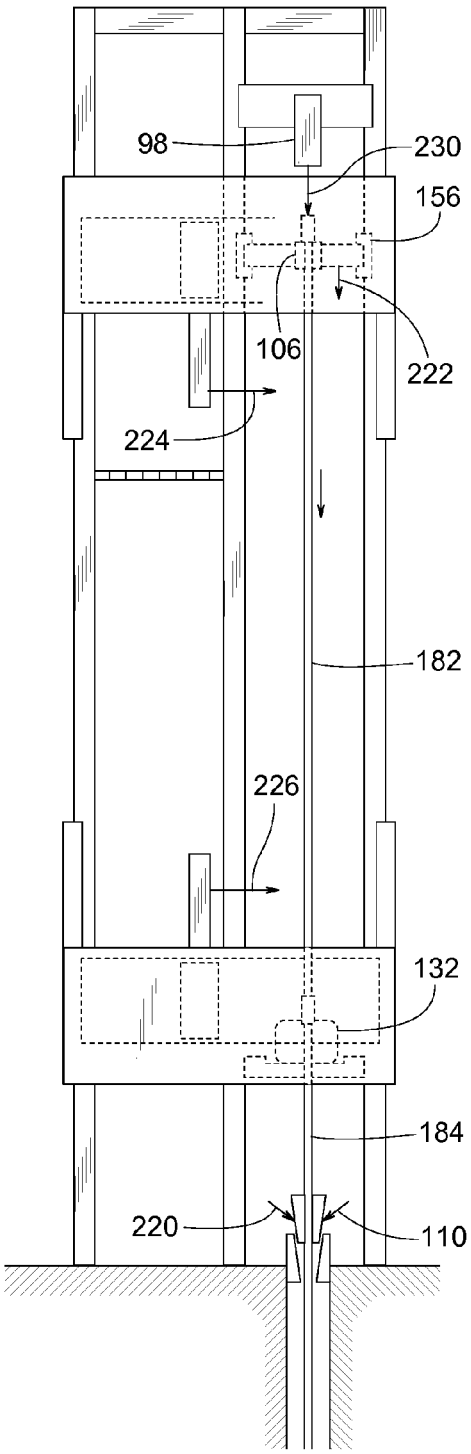
FIG. 85B is a schematic right end view of FIG. 85A.

Referring to FIGS. 85A and 85B, arrows 220 represent wellhead slip 110 clamping onto lower shaft 184. Arrow 222 represents main trolley 156 momentarily lowering well string 172 while well head slip 110 is clamping onto lower shaft 184. During the well string's relatively short perceptible descent (e.g., about 4 inches or even as little as a fraction of an inch) the wedges of wellhead slip 110 become tightly wedged against lower shaft 184. The wedges becoming sufficiently tight results in wellhead slip 110 holding lower shaft 184 at a substantially constant elevation for a first period, as shown in FIGS. 86A and 86B.

After briefly lowering well string 172 and during the first period, elevator head 106 releases upper shaft 182, thereby transferring most of the upper shaft's weight and the lower shaft's weight from elevator head 106 to wellhead slip 110, as illustrated by arrows 222 and 228 of FIGS. 85A, 85B, 86A and 86B and additionally illustrated by elevator head 106 being shown retracted in forward direction 112*a*' (FIG. 86A) and being shown open (FIG. 86B) while wellhead slip 110 is shown clamped tightly against lower shaft 184. To help stabilize the upper end of upper shaft 182, upper trolley mechanism 98 (which is above elevator head 106) travels downward (arrow 230 of FIGS. 85A and 85B) along trolley track system 88 to engage upper shaft 182, as shown in FIGS. 86A and 86B.

Arrow 232 of FIG. 85A represents tongs mechanism 132 extending, and arrow 234 of FIG. 86A represents tongs mechanism 132 unscrewing a first joint 236 connecting upper shaft 182 to lower shaft 184. Tongs mechanism 132 is schematically illustrated to represent any powered tool suitable for unscrewing joints, collars or couplings of a well string 172. In some examples, tongs mechanism 132 includes an actuator (e.g., a hydraulic cylinder) for selectively extending (arrow 232) and retracting (arrow 246) relative to centerline 84.

In some examples, to save overall cycle time, elevator head 106 descends while tongs 132 is unscrewing joint 236. Arrow 228 represents main trolley 156 lowering elevator head 106 while lower shaft 184 is at a substantially constant elevation and while tongs mechanism 132 is unscrewing joint 236. To further save cycle time, in some examples, robots 36 and/or 90 are repositioned or are traveling while main trolley 156 is raising or lowering elevator head 106. FIG. 85B, for example, shows arrows 222 and 224 that when such movement occurs simultaneously, arrows 222 and 224 illustrate main trolley 156 lowering elevator head 106 while the robotic system is moving end effectors 92 and/or 96 between shaft storage area 73 and longitudinal centerline 84. In some examples, robots 36 and/or 90 are repositioned or are traveling while tongs mechanism 132 is unscrewing joint 236.

Figure 87A:
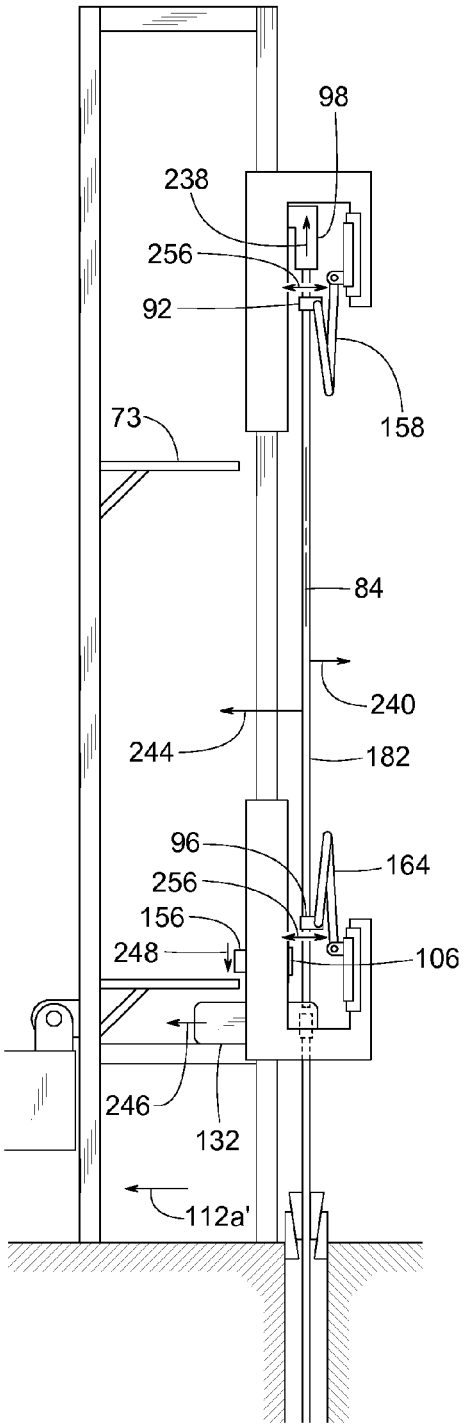
FIG. 87A is another schematic side view of the workover vehicle being used for removing the well string.
Figure 87B:
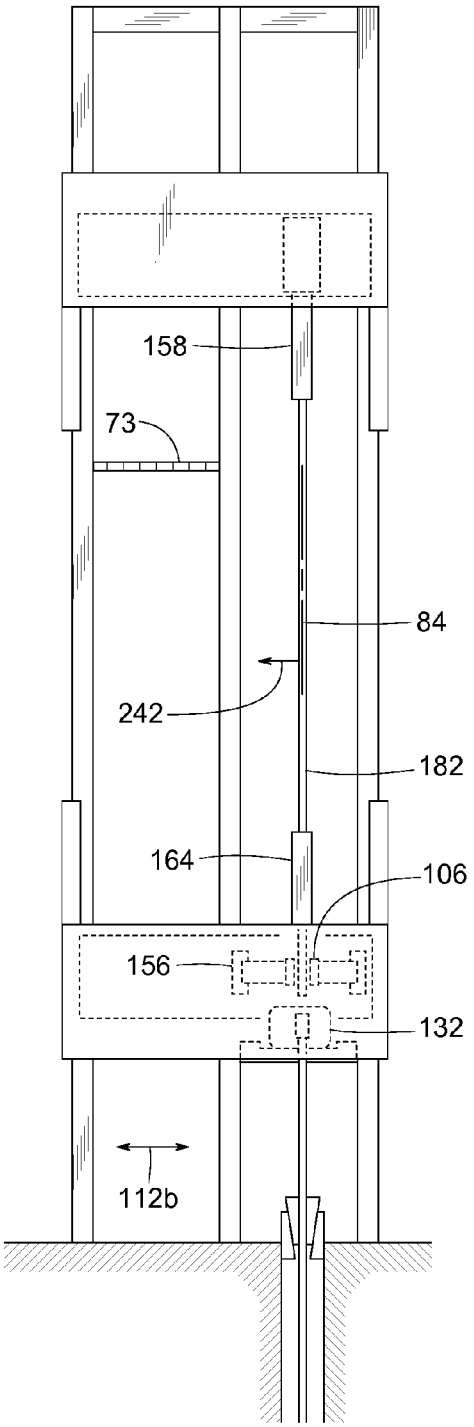
FIG. 87B is a schematic right end view of FIG. 87A.
Figure 88A:
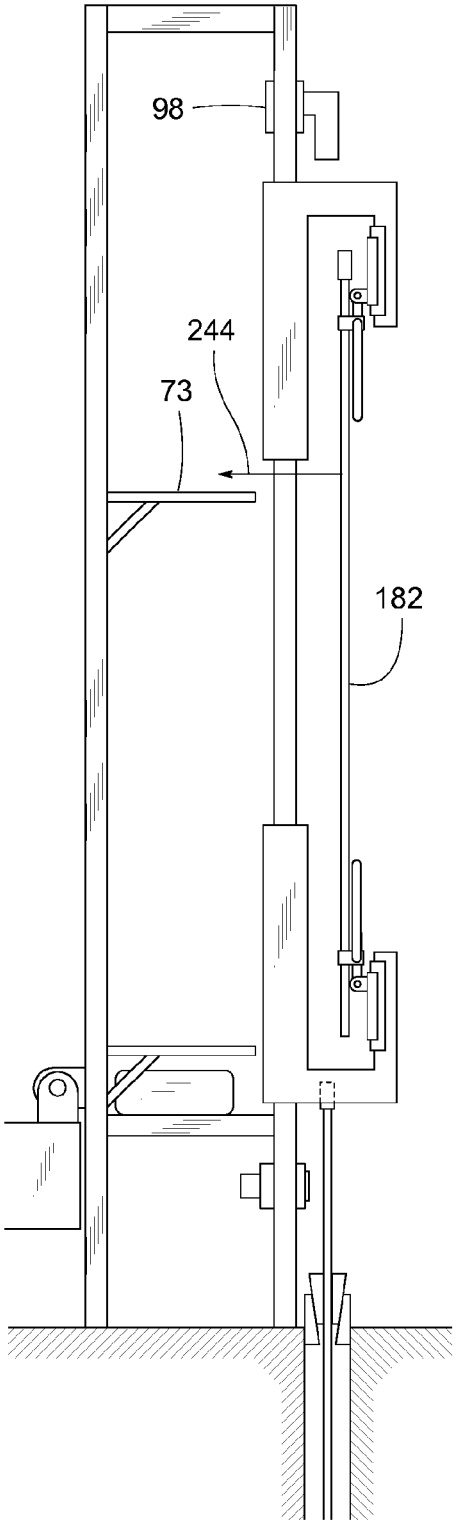
FIG. 88A is another schematic side view of the workover vehicle being used for removing the well string.
Figure 88B:
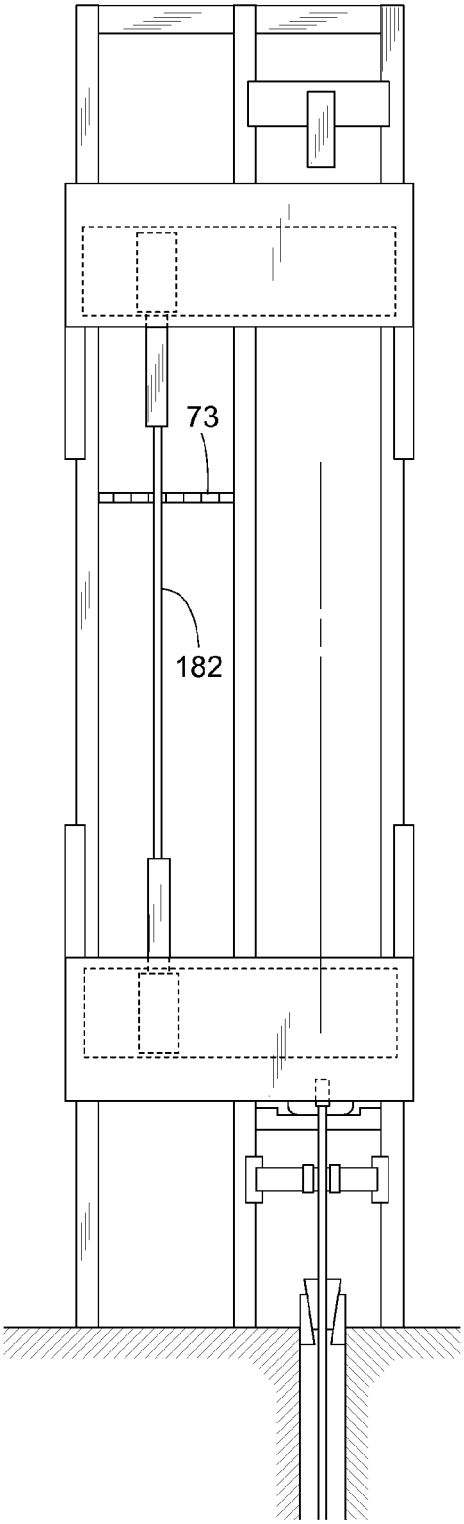
FIG. 88B is a schematic right end view of FIG. 88A.
Figure 89A:
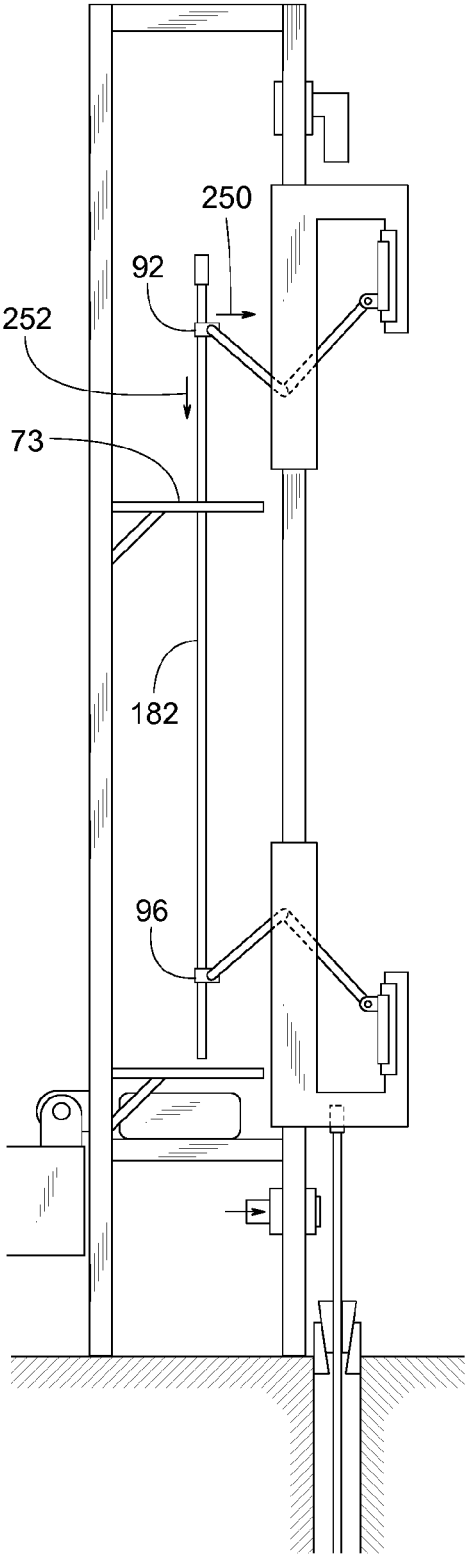
FIG. 89A is another schematic side view of the workover vehicle being used for removing the well string.
Figure 89B:
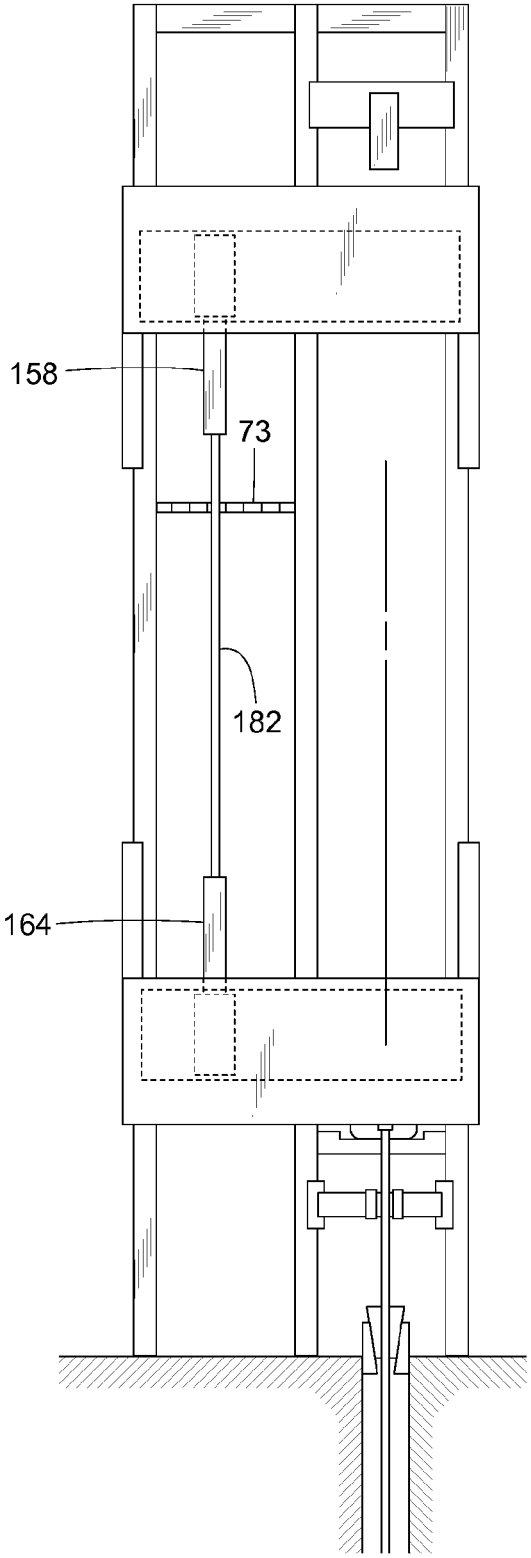
FIG. 89B is a schematic right end view of FIG. 89A.

After unscrewing first joint 236, after end effectors 92 and/or 96 gripping upper shaft 182, and after upper trolley mechanism 98 disengages 238 upper shaft 182, the robotic system (i.e., robots 36 and/or 90) transfers upper shaft 182 from longitudinal centerline 84 of well bore 14 to a shaft storage area 73 that is horizontally spaced apart from centerline 84, wherein the robotic system transferring upper shaft 182 from centerline 84 to shaft storage area 73 involves moving upper shaft 182 in translation in forward direction 112*a*' and lateral direction 112*b*. Such translation allows the robotic system to avoid the danger and high rotational inertia associated with pivoting or swinging relatively long and heavy shafts. Examples of shaft storage area 73 include, but are not limited to, tubing storage rack 72 and rod storage rack 74. FIG. 87A shows articulated arm assemblies 158 and 164 extending and end effectors 92 and 96 gripping upper shaft 182 while upper trolley mechanism 98 is above end effector 92 and/or 96 and while elevator head 106 is below end effector 92 and/or 96. Arrows 256 of FIG. 87A represent robots 36 and 90 selectively engaging and releasing upper shaft 182 via the robot's end effectors 92 and 96.

In transferring upper shaft 182 from centerline 84 to shaft storage area 73, arrow 246 represents tongs 132 retracting to provide clearance for main trolley 156 to descend (arrow 248) below tongs 132 and to provide some clearance for upper shaft 182 to travel to shaft storage area 73. Arrow 240 represents arm assemblies 158 and 164 retracting, whereby shaft 182 translates in a rearward direction (opposite to forward direction 112*a*') for creating clearance during subsequent lateral translation. Arrow 242 represents end effectors 92 and 96 translating (e.g., via relative lateral movement between arm 158 and upper shuttle 122 and/or via relative lateral movement between upper shuttle 122 and upper carriage 120), whereby shaft 182 translates in lateral direction 112*b* toward shaft storage area 73. Arrow 244 represents arm assemblies 158 and 164 extending, whereby shaft 182 translates from its position shown in FIG. 88A to its position shown in FIG. 89A. Arrows 250 and 252 represent end effectors 92 and 96 releasing upper shaft 182 at shaft storage area 73.

Figure 90A:
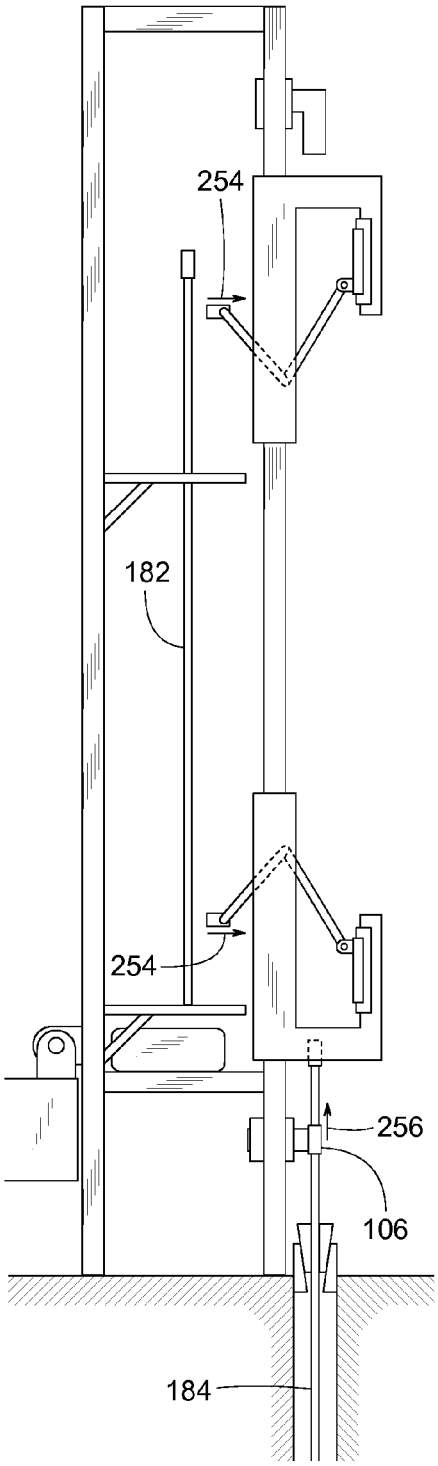
FIG. 90A is another schematic side view of the workover vehicle being used for removing the well string.
Figure 90A:
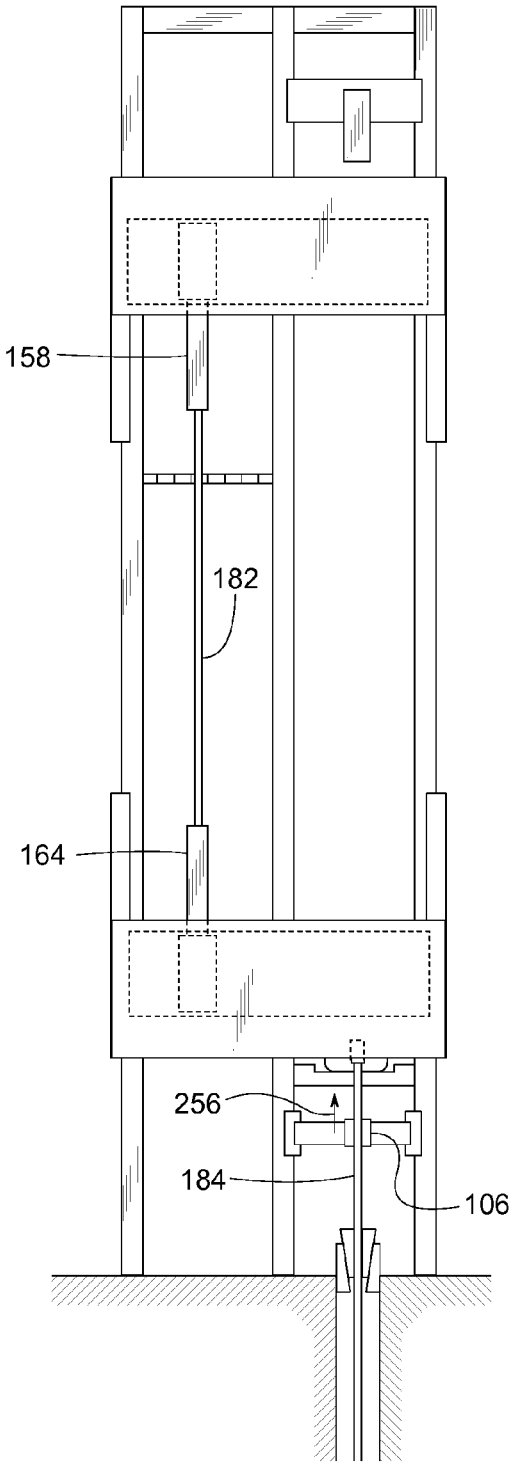
Figure 91A:
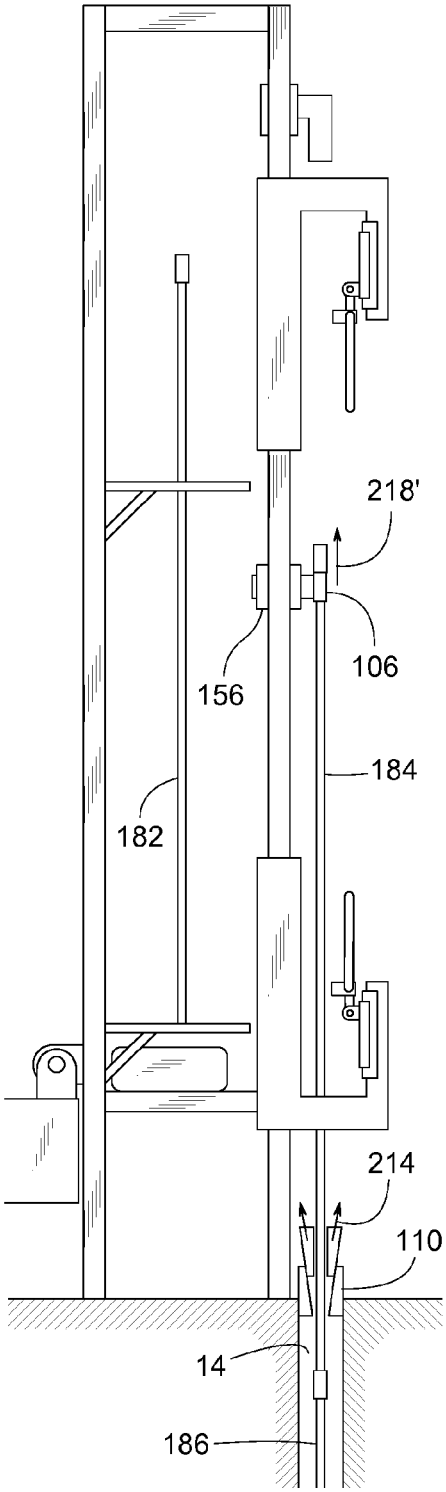
FIG. 91A is another schematic side view of the workover vehicle being used for removing the well string.
Figure 91B:
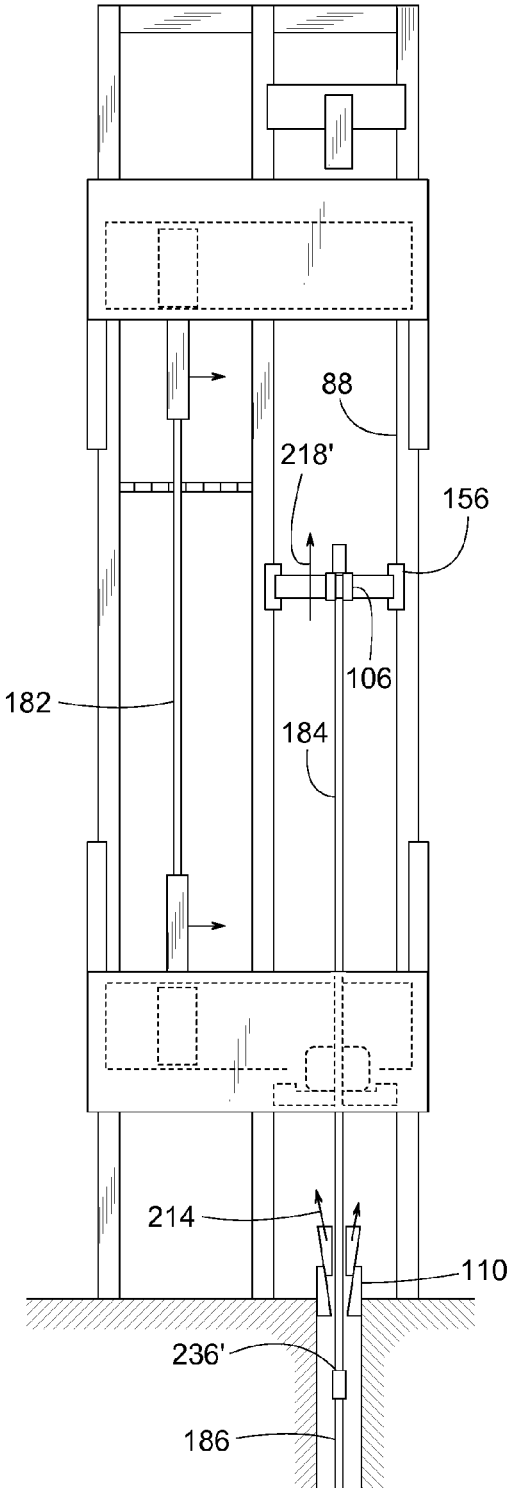
FIG. 91B is a schematic right end view of FIG. 91A.

Referring to FIGS. 90A, 90B, 91A and 91B, arrow 254 represents robotic arms 158 and 164 retracting after leaving upper shaft 182 at shaft storage area 73. At this point, after having removed upper shaft 182, workover vehicle 10 prepares for removing lower shaft 184 from the remaining well string 172. In FIGS. 90A and 90B, arrow 256 represents elevator head 106 capturing the upper end of lower shaft 184. In FIGS. 91A and 91B, arrows 214 represent wellhead slip 110 releasing lower shaft 184, thereby transferring most of the lower shaft's weight to elevator head 106. Arrow 218' of FIGS. 91A and 91B represents main trolley 156 traveling upward at a second peak velocity along trolley track system 88, thereby lifting the remaining shaft string 186 and lifting lower shaft 184 out from within well bore 14. To reduce well string disassembly time by taking advantage of the well string's diminishing weight as additional shafts are removed, in some examples, said second peak velocity (see arrow 218' of FIG. 91A) is greater than said first peak velocity (see arrow 218 of FIG. 84A).

Figure 92A:
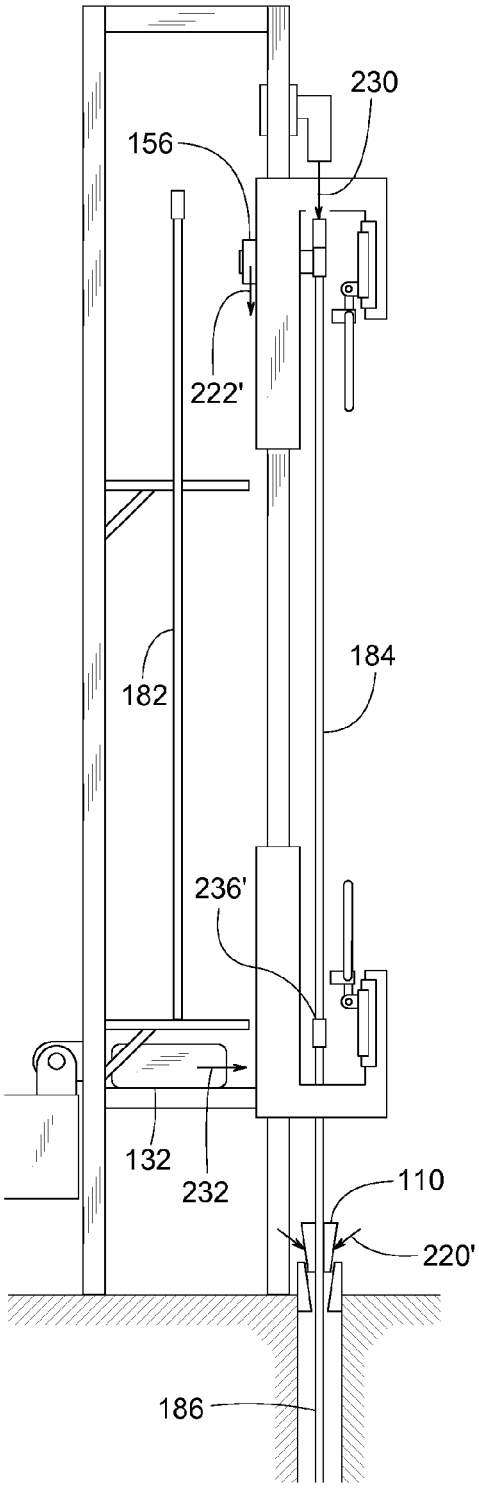
FIG. 92A is another schematic side view of the workover vehicle being used for removing the well string.
Figure 92B:
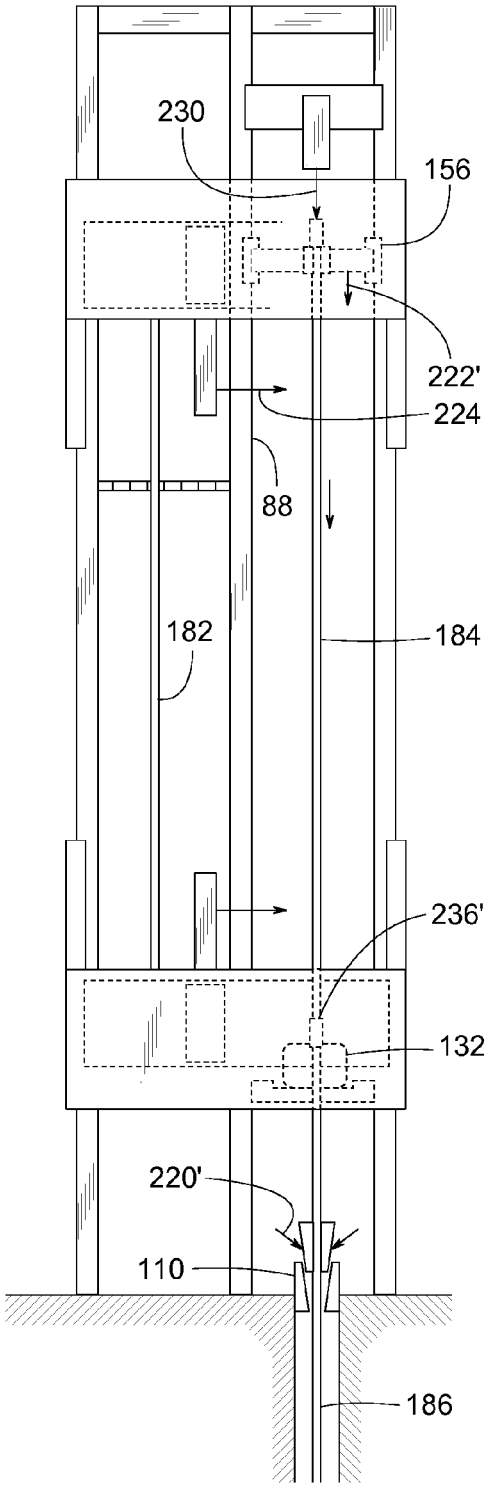
FIG. 92B is a schematic right end view of FIG. 92A.

In FIGS. 92A and 92B, arrows 220' represents wellhead slip 110 clamping onto the remaining shaft string 186. Arrow 222' represents main trolley 156 momentarily lowering lower shaft 184 and the remaining shaft string 186 while wellhead slip 110 is clamping onto the remaining shaft string 186. During the well string's relatively short descent, e.g., about 4 inches, the wedges of wellhead slip 110 become tightly wedged against the remaining shaft string 186. The wedges becoming sufficiently tight results in wellhead slip 110 holding the remaining shaft string 186 at a substantially fixed elevation for a second period, as shown in FIGS. 93A and 93B.

Figure 93A:
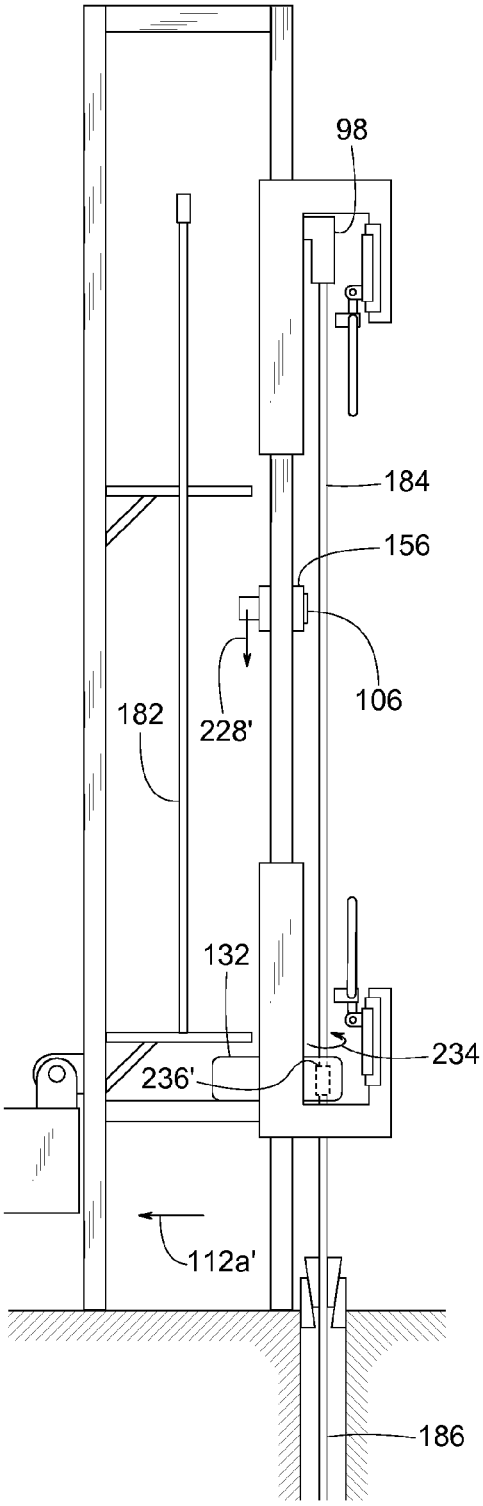
FIG. 93A is another schematic side view of the workover vehicle being used for removing the well string.
Figure 93B:
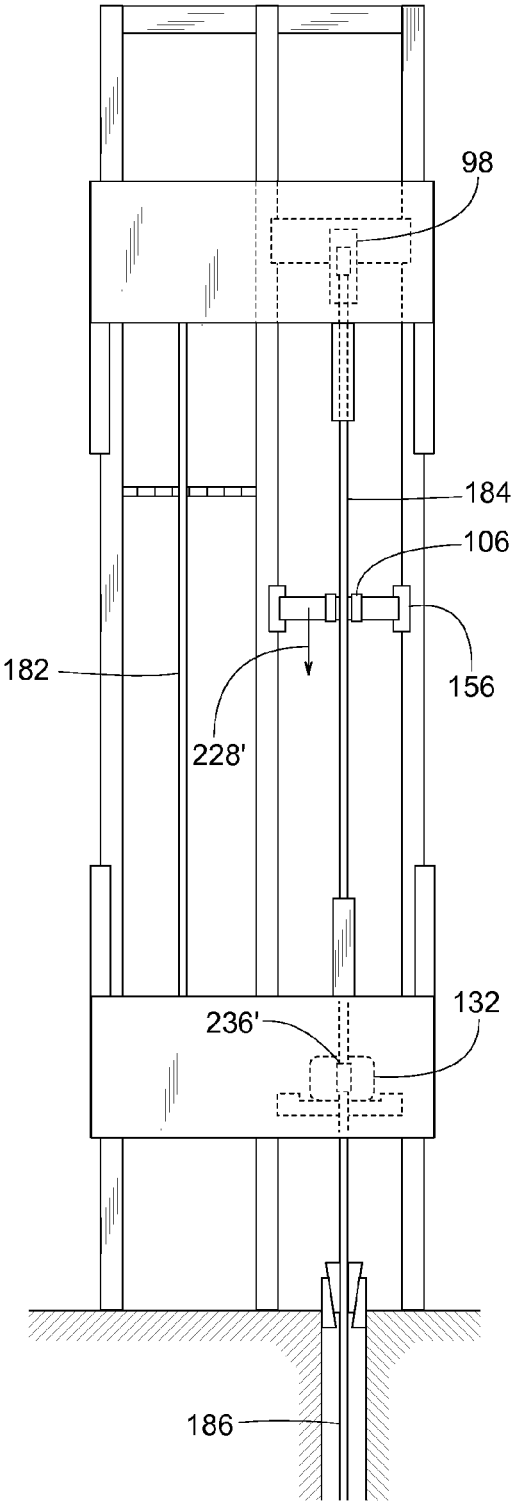
FIG. 93B is a schematic right end view of FIG. 93A.

After briefly lowering well string 172 and during the second period, elevator head 106 releases lower shaft 184, thereby transferring most of the lower shaft's weight and the weight of the remaining shaft string 186 from elevator head 106 to wellhead slip 110, as illustrated by arrows 222' and 228' of FIGS. 92A, 92B, 93A and 93B and additionally illustrated by elevator head 106 being shown retracted in forward direction 112*a*' (FIG. 93A) and being shown open (FIG. 93B) while wellhead slip 110 is shown clamped tightly against the remaining shaft string 186. To help stabilize the upper end of lower shaft 182, upper trolley mechanism 98 (which is above elevator head 106) travels downward (arrow 230 of FIGS. 92A and 92B) along trolley track system 88 to engage the upper end of lower shaft 184, as shown in FIGS. 93A and 93B.

Arrow 232 of FIG. 92A represents tongs mechanism 132 extending, and arrow 234 of FIG. 93A represents tongs mechanism 132 unscrewing a second joint 236' connecting lower shaft 184 to the remaining shaft string 186. In some examples, to save overall cycle time, elevator head 106 descends while tongs 132 is unscrewing joint 236'. Arrow 228' represents main trolley 156 lowering elevator head 106 while the remaining shaft string 186 is at a substantially constant elevation and while tongs mechanism 132 is unscrewing joint 236'.

Figure 94A:
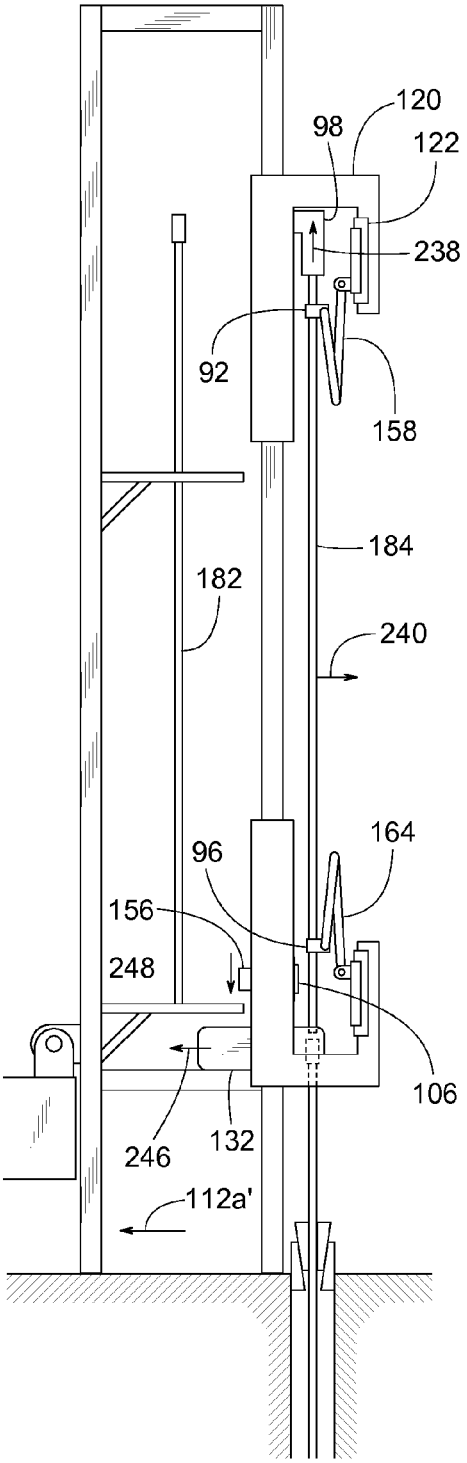
FIG. 94A is another schematic side view of the workover vehicle being used for removing the well string.
Figure 94B:
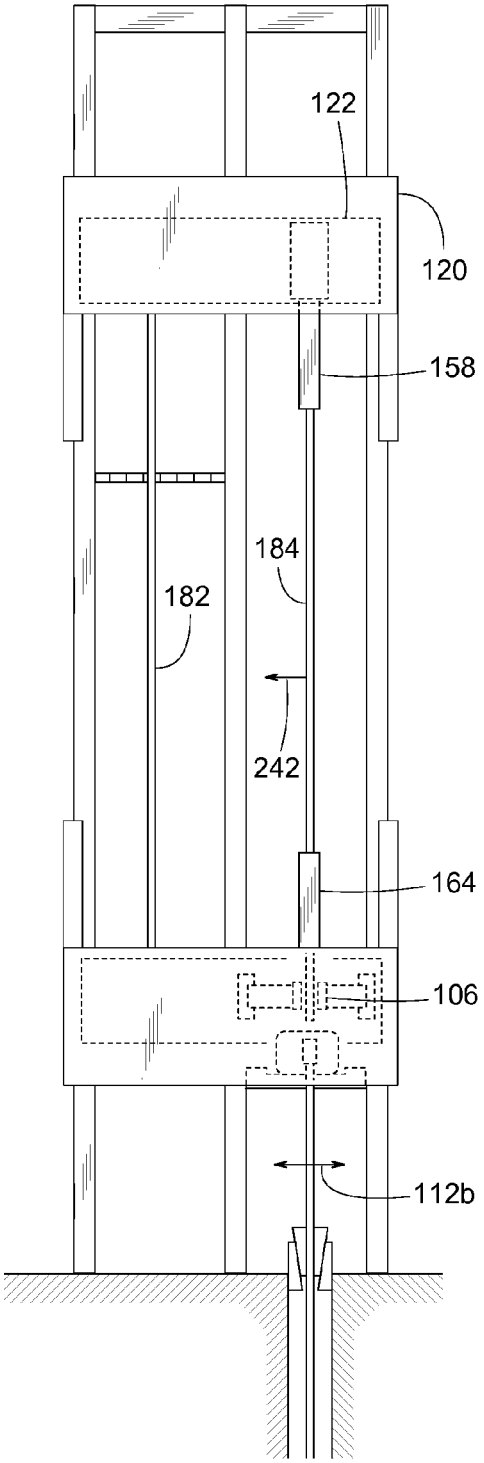
FIG. 94B is a schematic right end view of FIG. 94A.
Figure 95A:
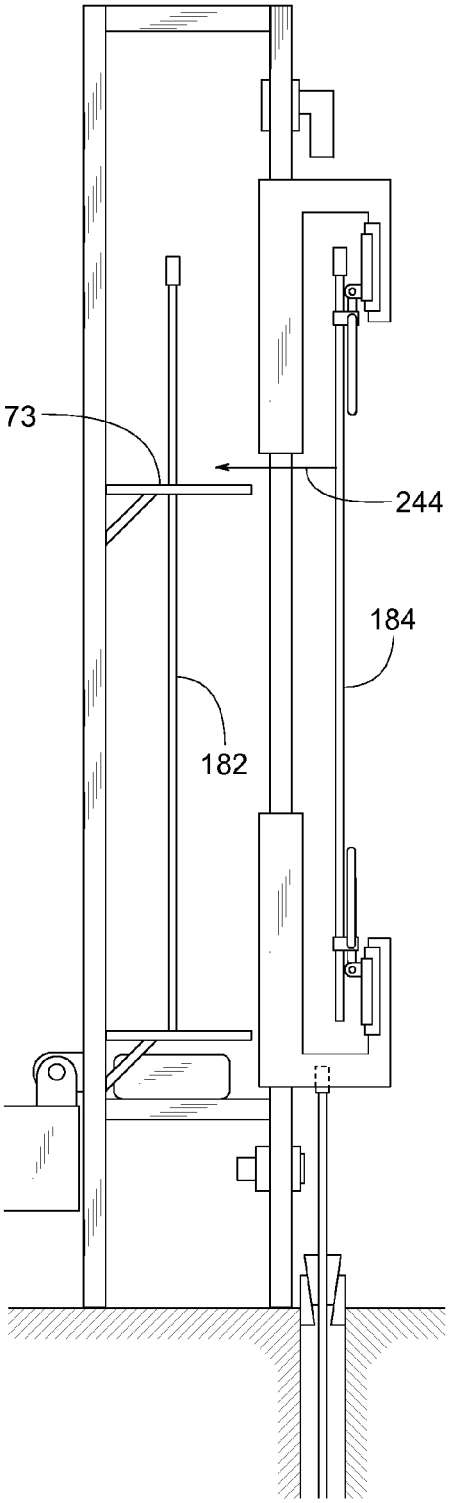
FIG. 95A is another schematic side view of the workover vehicle being used for removing the well string.
Figure 95B:
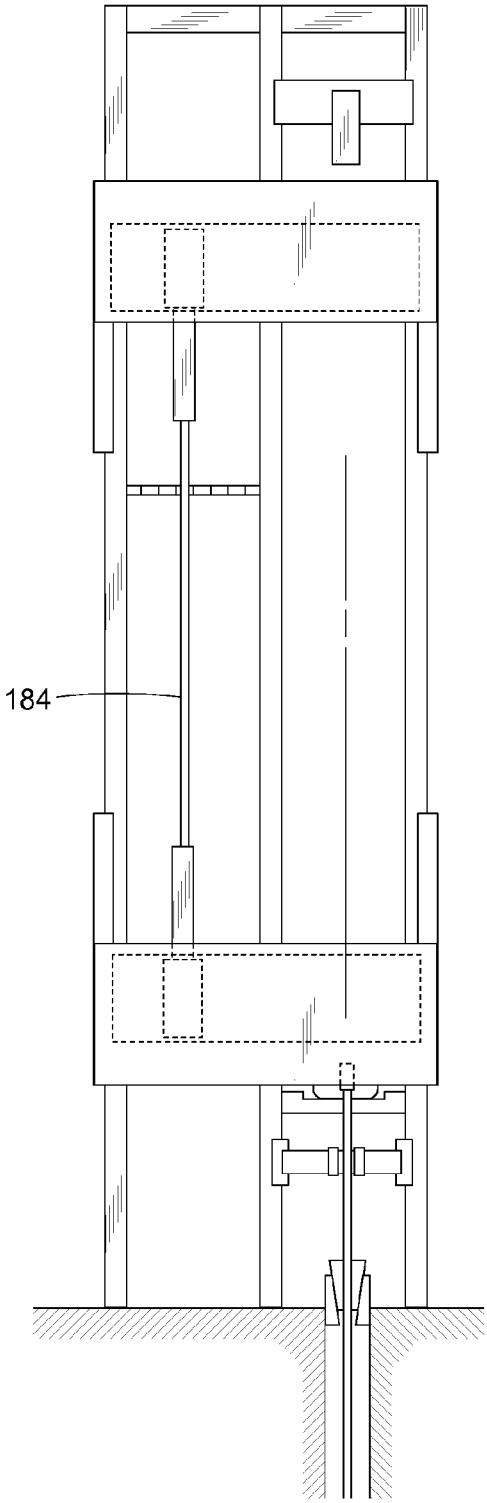
FIG. 95B is a schematic right end view of FIG. 95A.
Figure 96A:
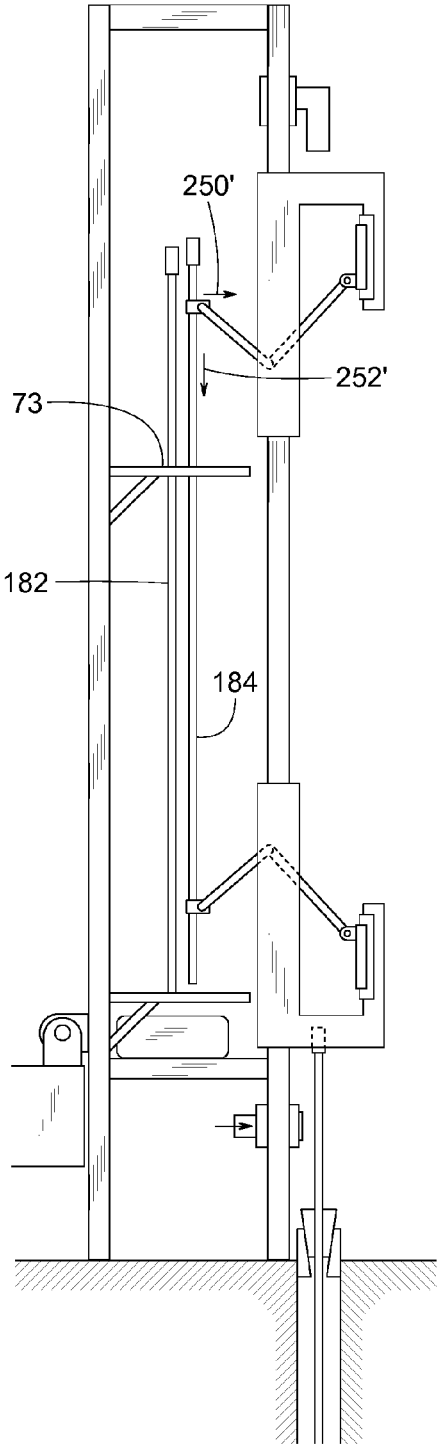
FIG. 96A is another schematic side view of the workover vehicle being used for removing the well string.
Figure 96B:
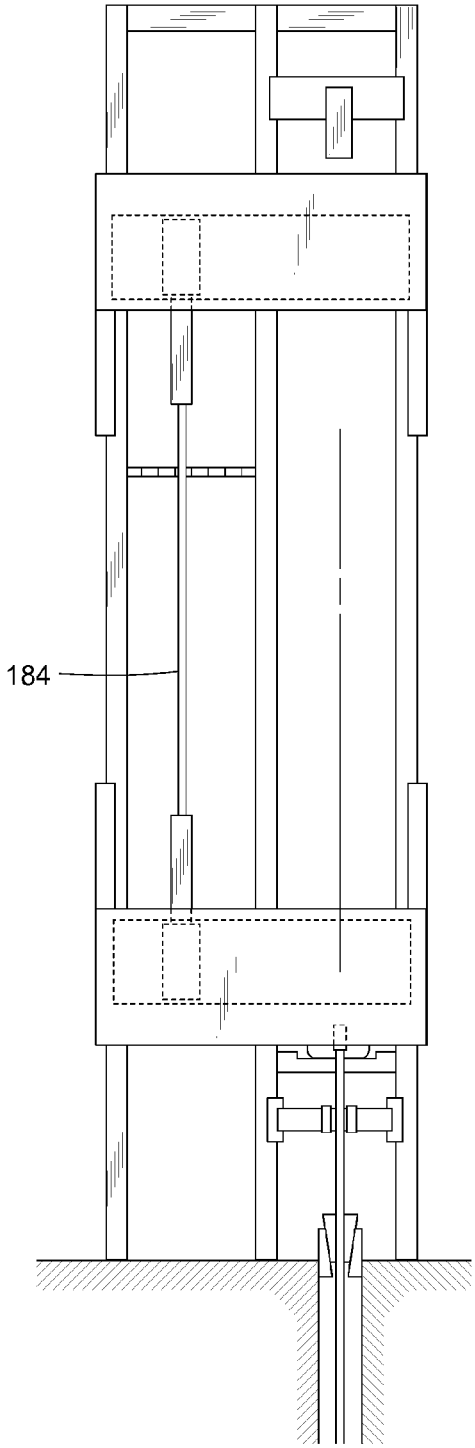
FIG. 96B is a schematic right end view of FIG. 96A.
Figure 97A:
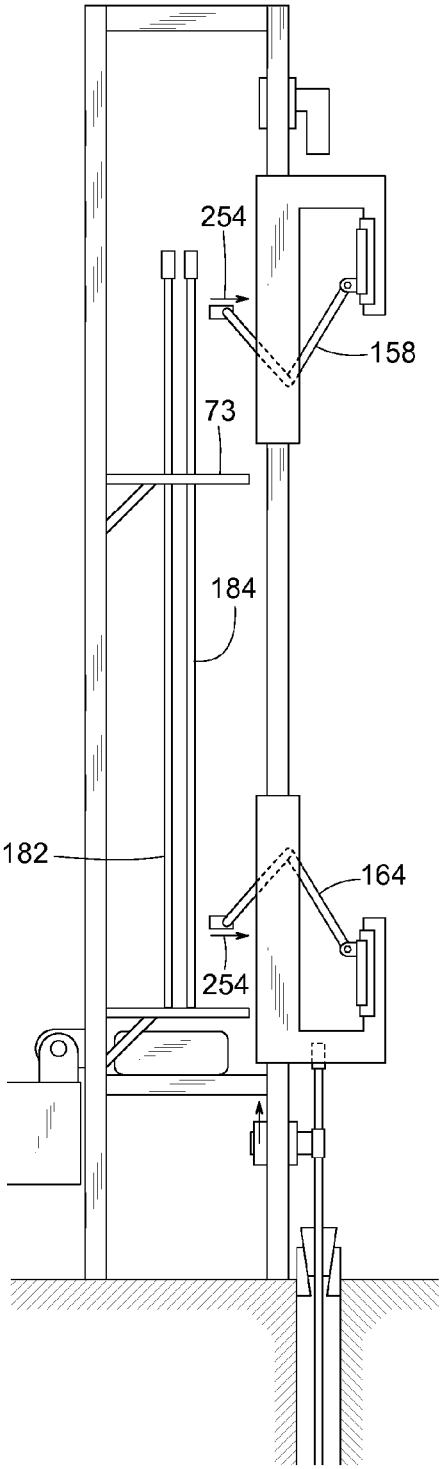
FIG. 97A is another schematic side view of the workover vehicle being used for removing the well string.
Figure 97B:
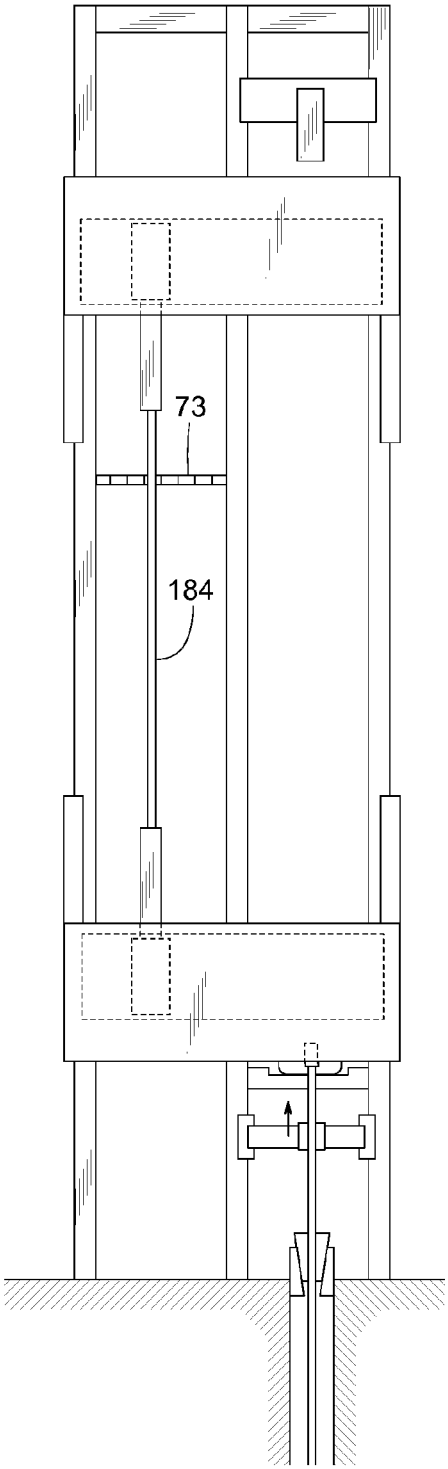
FIG. 97B is a schematic right end view of FIG. 97A.
Figure 98A:
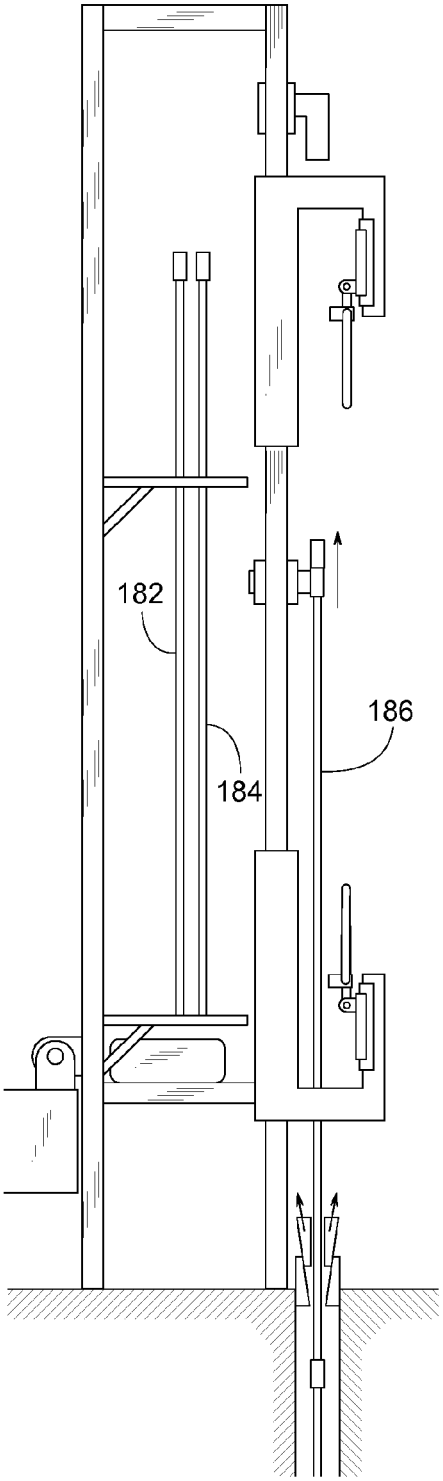
FIG. 98A is another schematic side view of the workover vehicle being used for removing the well string.
Figure 98B:
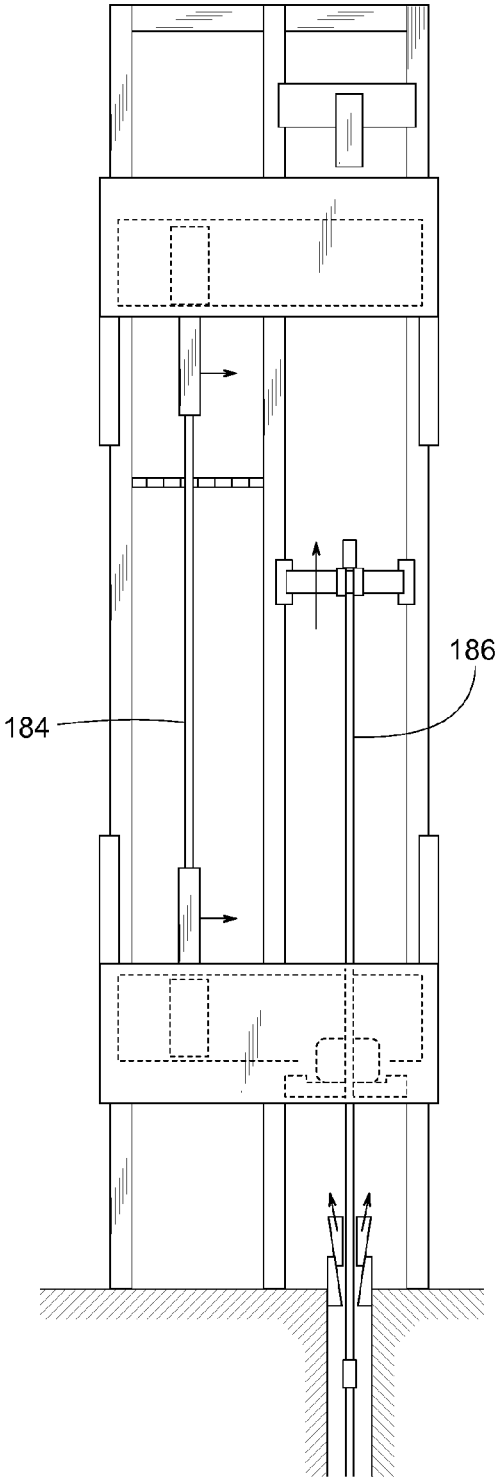
FIG. 98B is a schematic right end view of FIG. 98A.

After unscrewing second joint 236', after end effectors 92 and/or 96 gripping lower shaft 184, and after upper trolley mechanism 98 disengages 238 lower shaft 184, the robotic system (i.e., robots 36 and/or 90) transfers lower shaft 184 from longitudinal centerline 84 of well bore 14 to shaft storage area 73, wherein the robotic system transferring lower shaft 184 from centerline 84 to shaft storage area 73 involves moving lower shaft 184 in translation in forward direction 112*a*' and lateral direction 112*b*. FIG. 94A shows articulated arm assemblies 158 and 164 extending and end effectors 92 and 96 gripping lower shaft 182 while upper trolley mechanism 98 is above end effector 92 and/or 96 and while elevator head 106 is below end effector 92 and/or 96.

In transferring lower shaft 184 from centerline 84 to shaft storage area 73, arrow 246 (FIG. 94A) represents tongs 132 retracting to provide clearance for main trolley 156 to descend (arrow 248) below tongs 132 and to provide some clearance for lower shaft 184 to travel to shaft storage area 73. Arrow 240 represents arm assemblies 158 and 164 retracting, whereby shaft 184 translates in a rearward direction (opposite to forward direction 112*a*') for creating clearance during subsequent lateral translation. Arrow 242 (FIG. 94B) represents end effectors 92 and 96 translating (e.g., via relative lateral movement between arm 158 and upper shuttle 122 and/or via relative lateral movement between upper shuttle 122 and upper carriage 120), whereby shaft 184 translates in lateral direction 112*b* toward shaft storage area 73. Arrow 244 (FIG. 95A) represents arm assemblies 158 and 164 extending, whereby shaft 184 translates from its position shown in FIG. 95A to its position shown in FIG. 96A. Arrows 250' and 252' (FIG. 96A) represent end effectors 92 and 96 releasing lower shaft 184 at shaft storage area 73. Referring to FIGS. 97A, 97B, 98A and 98B, arrow 254 represents robotic arms 158 and 164 retracting after leaving lower shaft 184 at shaft storage area 73.

More specifically, additionally and/or alternatively, some example embodiments are described under the following underlined subtitles (1)-(24):

(1) X,Y Frame Translation after Deploying Outriggers and Leveling

Some example embodiments include a workover method involving the use of a workover vehicle 10 at a well site 12, wherein the well site comprises a wellbore 14, and the workover vehicle comprises a sub frame 16 on vehicle chassis 18 with a mast 20 attached to the sub frame, the workover method comprising:

parking 22 the workover vehicle at the well site;

deploying 24 a plurality of outriggers 26 of the workover vehicle;

leveling 28 the sub frame;

horizontally shifting 30 the sub frame relative to the chassis and the wellbore;

pivoting the mast upward; and further comprising an optical sensor 32 (e.g., a camera or laser) assisting in aligning a reference point of the sub frame to the wellbore.

(2) Lower Robot Avoids Walking Beam as Mast is Raised

Some example embodiments include a workover method involving a workover vehicle 10, a wellbore 14, and a walking beam 34 associated with the wellbore, wherein the workover vehicle comprises a mast 20 and a robot 36, the workover method comprising:

positioning the workover vehicle in proximity with the wellbore and the walking beam;

positioning the robot at a predetermined safe location on the mast;

pivoting 40 the mast to an upright orientation at a location 38 proximate the walking beam, wherein the robot at the predetermined safe location clears the walking beam as the mast pivots to the upright orientation; and moving 42 the robot from the predetermined safe location to an operative location 44 on the mast.

(3) Detect Interference with Walking Beam

Some example embodiments include a workover system for use at a wellbore 14 associated with a walking beam 34, the workover system comprising:

a workover vehicle 10;

a mast 20 extending upright from the workover vehicle;

a robot 36 mounted for vertical movement along the mast; and a sensor 46 (e.g., proximity sensor, limit switch, photoelectric eye, etc.) establishing and/or determining whether a predetermined minimum clearance 48 exists between the robot and the walking beam or the portion 174' of pumpjack 174 that is left intact at well site 12.

(4) Tilting Oil Tank

Some example embodiments include a workover system, comprising:

a vehicle bed 50;

a mast 20 mounted to the vehicle bed, the mast being moveable selectively to a lowered position and a raised position;

a main trolley 52 mounted for vertical movement along the mast when the mast is in the raised position, the main trolley being moveable from a descended position to an elevated position;

a hydraulic tank 54 mounted to the vehicle bed, the hydraulic tank being moveable selectively between a transport position and an operative position, the hydraulic tank defining a tank outlet 56, the tank outlet being at a hydraulic pressure that is greater when the hydraulic tank is in the operative position than when the hydraulic tank is in the transport position;

a hydraulic pump 58 mounted to the vehicle bed, the hydraulic pump defining a suction inlet 60 connected in fluid communication with the tank outlet; and a hydraulic drive unit 62 connected to move the lower trolley from the descended position to the elevated position, wherein the hydraulic tank contains more hydraulic fluid when the hydraulic tank is in the transport position than when the hydraulic tank is in the operative position.

(5) Mast Layout

Some example embodiments include a workover system for handling at least one of a plurality of tubes 64 and a plurality of rods 66 at a well site 12 that includes a wellbore 14, the workover system comprising:

a mast 20 comprising a plurality of outer corner posts 68 distributed along an outer periphery 70 of the mast, the plurality of outer corner posts defining a footprint of the mast;

a tubing storage rack 72 for holding the plurality of tubes in a generally upright orientation, the tubing storage rack being mostly within the footprint; and a rod storage rack 74 for holding the plurality of rods in a generally upright orientation, the rod storage rack being mostly beyond the footprint, and further comprising a lay-down storage area 76 for storing at least one of a first portion of the plurality of rods and a second portion of the plurality of tubes, the lay-down storage area being disposed mostly beyond the footprint, and further comprising a rack cover 78 disposed above at least one of the tubing storage rack and the rod storage rack, and further comprising a camera 80 disposed above at least one of the tubing storage rack and the rod storage rack, and further comprising a robot 36 attached to the mast with a portion 82 of the robot extending beyond the footprint, the wellbore defining a vertical centerline 84 that is interposed between the footprint of the mast and the portion of the robot, and further comprising:

a wider track 86 borne by the mast, the wider track lying along a first imaginary plane 94;

a narrower track 88 borne by the mast;

an upper robot 90 mounted for vertical travel along the wider track, the upper robot having an upper end effector 92 moveable selectively to within the footprint and beyond the footprint, the upper end effector being moveable to pass through the first imaginary plane;

a lower robot 36 mounted for vertical travel along the wider track, the lower robot having a lower end effector 96 moveable selectively to within the footprint and beyond the footprint, the lower end effector being moveable to pass through the first imaginary plane;

an upper trolley 98 mounted for vertical movement along the narrower track;

a lower main trolley 100 mounted for vertical movement along the narrower track; and a robotic jib 102 pivotally attached the mast.

(6) Fold-up Racks for Transport

Some example embodiments include a workover system comprising:

a workover vehicle 10 being selectively configurable to a operative configuration and a transport configuration;

a mast 20 attached to the workover vehicle, the mast defining a longitudinal centerline 104, the mast being substantially vertical in the operative configuration, the mast being laid down in the transport configuration; and a rod storage rack 74/74' pivotally attached to the mast, the rod storage rack 74 being substantially perpendicular to the longitudinal centerline when the workover vehicle is in the operative configuration, the rod storage rack 74' being substantially parallel to the longitudinal centerline when the workover vehicle is in the transport configuration.

(7) Robotic Jib-Deployed and Transport Positions

Some example embodiments include a workover system, comprising:

a workover vehicle 10 being selectively configurable to a operative configuration and a transport configuration;

a mast 20 attached to the workover vehicle, the mast comprising a plurality of outer corner posts 68 distributed along an outer periphery of the mast, the plurality of outer corner posts 68 defining a footprint of the mast, the mast being substantially vertical in the operative configuration, the mast being laid down in the transport configuration; and a robotic jib 102 attached to the mast, the robot jib being disposed mostly within the footprint when the workover vehicle is in the transport configuration, the robot jib being most beyond the footprint when the workover vehicle is in the operative configuration.

(8) Set and Update Overload Weight Limit & Minimal Oil Discharge Pressure

Some example embodiments include a workover method comprising:

determining a first anticipated maximum load for a well string;

during a first period, shortening the well string to create a shorter well string;

determining a second anticipated maximum load for the shorter well string;

during a second period, shortening the shorter well string to create an even shorter well string;

establishing a first oil pressure limit based on the first anticipated maximum load for the well string;

establishing a second oil pressure limit based on the second anticipated maximum load for the shorter well string;

during the first and second period, discharging oil at a discharge pressure that varies;

limiting the discharge pressure to the first oil pressure limit during the first period; and limiting the discharge pressure to the second oil pressure limit during the second period, wherein the first oil pressure limit is greater than the second oil pressure limit, wherein the second oil pressure limit is less than a minimum discharge pressure necessary to handle the first anticipated maximum load for the well string, and further comprising:

establishing an upper maximum velocity limit (e.g., 6 ft/sec) for an elevator that is generally unloaded;

establishing a lower maximum velocity limit (e.g., 2 ft/sec) for the elevator when the elevator is carrying a load; and establishing a maximum acceleration limit (e.g., 0.1 g) for the elevator.

(9) Log Snag Points POOH

Some example embodiments include a workover method comprising:

supplying oil at a pressure that varies;

using the pressure as means for raising an elevator 106 connected to a well string 108;

monitoring an elevation of the elevator, wherein the elevation increases while raising the elevator;

monitoring the pressure while raising the elevator;

if the pressure experiences a certain spike in pressure, a controller noting the elevation at which the certain spike occurred; and determining a location within the wellbore based on the elevation at which the certain spike occurred.

Some example embodiments include a workover method comprising:

determining a first anticipated maximum load for a well string;

during a first period, shortening the well string to create a shorter well string;

determining a second anticipated maximum load for the shorter well string;

during a second period, shortening the shorter well string to create an even shorter well string;

establishing a first oil pressure limit based on the first anticipated maximum load for the well string;

establishing a second oil pressure limit based on the second anticipated maximum load for the shorter well string;

during the first and second period, discharging oil at a discharge pressure that varies;

limiting the discharge pressure to the first oil pressure limit during the first period; and limiting the discharge pressure to the second oil pressure limit during the second period, wherein the first oil pressure limit is greater than the second oil pressure limit, wherein the second oil pressure limit is less than a minimum discharge pressure necessary to handle the first anticipated maximum load for the well string.

(10) Detect RIH Stack-Out

Some example embodiments include a workover method for handling a well string 108 through the use of an elevator 106 carried by a lower trolley 52 that travels along a mast 20, the workover method comprising:

the elevator suspending the well string;

a sensor (e.g., an encoder) determining whether the elevator is descending;

monitoring at least one of: cable tension, crown load strain and hydraulic pressure;

identifying a notable decrease in at least one of: cable tension, crown load strain and hydraulic pressure; and determining a stack-out condition in the event of the notable decrease occurring while the elevator is descending.

(11) Push/Pull Cable and Sheaves

Some example embodiments include a workover method for handling at least one of a tubing string and a rod string, the workover method involving the use of a workover vehicle 10, a mast 20 attached to the workover vehicle, a main trolley 52 attached to the mast, an elevator 106 attached to the main trolley, a large hydraulic cylinder 152, a small hydraulic cylinder 154, the workover method comprising:

during a first period, suspending the tubing string and not the rod string from the elevator;

while the tubing string is suspended from the elevator, extending the large hydraulic cylinder and not the small hydraulic cylinder to lift the elevator and the tubing string;

during a second period, suspending the rod string and not the tubing string from the elevator; and while the rod string is suspended from the elevator, extending the large hydraulic cylinder and the small hydraulic cylinder to lift the elevator and the rod string, and further comprising:

during a third period, having the elevator be disengaged from both the tubing string and the rod string; and during the third period, retracting at least one of the large hydraulic cylinder and the small hydraulic cylinder to forcibly lower by hydraulic pressure the main trolley and the elevator.

(12) Sense Slip and Elevator Weights to Detect Well String Freefall

Some example embodiments include a workover method for handling a well string 108 that under normal operating conditions has a weight carried by at least one of a wellhead slip 110 and an elevator 106, wherein the wellhead slip is at a wellhead 112 of a wellbore 14, and the elevator is carried by a main trolley 52 mounted for vertical travel along a mast 20 at the well site 12, the workover method comprising:

sensing a first weight carried by the wellhead slip;

sensing a second weight carried by the elevator; and identifying a freefall hazard based on a sum of the first weight and the second weight being less than a predetermined minimum, wherein the predetermined minimum varies as a function of a length of the well string.

(13) Upper Gripper Functions with Lost Hydraulic Pressure

Some example embodiments include a workover system for handling a separated section of a well string 108 at a well site 12 that includes a wellbore 14, the workover system comprising:

a workover vehicle 10;

a hydraulic power unit 62 supplying active hydraulic pressure;

a hydraulic storage system 114 maintaining stored hydraulic pressure;

a mast 20 extending upright from the workover vehicle;

a main trolley 52 mounted for vertical travel along the mast;

an elevator 106 carried by the main trolley;

an upper robot 90 mounted for vertical travel along the mast; and an upper end effector 92 borne by the upper robot, the upper end effector being mounted for two-dimensional horizontal travel 112*a* and 112*b* relative to the mast, the upper end effector having a full grip mode, a backup grip mode and a release mode, the upper end effector in the full grip mode engaging the separated section under impetus of the active hydraulic pressure, the upper end effector in the backup grip mode engaging the separated section under impetus of the stored hydraulic pressure, the upper end effector in the release mode disengaging the separated section, wherein the hydraulic storage system includes a pilot-operated check valve 116 and an accumulator 118, and further comprising a less urgent backup pressure alarm and a more urgent low pressure alarm.

(14) Independent Traveling Upper Robot, Lower Robot, Main Trolley and Upper Trolley Some example embodiments include a workover system for handling a well string 108 at a well site 12 that includes a wellbore 14, the workover system comprising:

a workover vehicle 10;

a mast 20 mounted to the workover vehicle;

an upper robot 90 mounted for vertical travel along the mast;

a lower robot 36 mounted for vertical travel along the mast, the lower robot being movable relative to the upper robot;

an upper trolley 98 mounted for vertical travel along the mast, the upper trolley being movable relative to the upper robot and the lower robot; and a lower trolley 52 mounted for vertical travel along the mast, the lower trolley being movable relative to the upper robot, the lower robot and the upper trolley.

(15) Tube/Rod Gap and Dual Track Translation Provides Robots with Greater Side Travel Some example embodiments include a workover system for handling a well string member 64 or 66, the workover system comprising:

a workover vehicle 10;

a mast 20 attached to the workover vehicle;

a carriage 120 mounted for travel in a vertical direction 112*c* along the mast;

a shuttle 122 mounted to the carriage, the shuttle being movable in a lateral direction relative to the carriage, the lateral direction being substantially perpendicular to the vertical direction;

an end effector 92 carried by the shuttle, the end effector being movable in the lateral direction relative to the shuttle, the end effector being further movable in an in-out direction 112*a* relative to the shuttle, the in-out direction being substantially perpendicular to the lateral direction and the vertical direction, wherein the carriage has a maximum width 124 in the lateral direction, the end effector having a maximum travel distance 125 in the lateral direction, the maximum travel distance being greater than the maximum width, wherein the shuttle and the carriage define therebetween a passageway 126 for the well string member, the passageway lying substantially perpendicular to the in-out direction, the passageway extending a lateral distance in the lateral direction, the lateral distance being greater than the maximum width of the carriage.

(16) Robots can Pick from Rack or from Robotic Jib

Some example embodiments include a workover method for handling a well string member 64 or 66, the workover method involving the use of a workover vehicle 10, a mast 20, a storage rack 74 attached to the mast, a robotic jib 102 attached to the mast, an upper robot 90 attached to the mast wherein the upper robot includes an end effector 92, the workover method comprising:

pivoting the mast relative to the workover vehicle;

pivoting 135 the robotic jib relative to the mast;

moving the upper robot vertically along the mast; and transferring the well string member selectively between: (a) the end effector and the robotic jib, and (b) the end effector and the storage rack.

(17) Sort Well String Members

Some example embodiments include a workover method for handling a plurality of well string members 64 or 66 associated with a wellbore 14, the plurality of well string members includes at least one of a better well string member, a worse well string member and a seriously flawed well string member, the workover method involves the use of at least one of a workover vehicle 10, a mast 20 attached to the workover vehicle, an elevator 106 mounted for vertical travel along the mast, a robot 90 mounted for vertical travel along the mast, a first storage area, a second storage area and a third storage area, the workover method comprising:

during a first period, the elevator extracting the plurality of well string members out from within the wellbore;

during the first period, electronically inspecting the plurality of well string members;

generating a plurality of readings as a consequence of electronically inspecting the plurality of well string members, identifying the better well string member based on the plurality of readings;

identifying the worse well string member based on the plurality of readings;

the robot transferring the better well string member from the elevator to the first storage area;

the robot transferring the worse well string member from the elevator to the second storage area; and during a second period, lowering at least some of the plurality of well string members into the wellbore such that the better well string member is below the worse well string member, wherein the step of electronically inspecting the plurality of well string member involves the use of at least one of an ultrasonic sensor, Hall effect sensor, means for sensing a magnetic flux field, and a camera, and further comprising automatically marking (e.g., painting) at least one of the better well string member and the worse well string member, and further comprising:

identifying the seriously flawed well string member based on the plurality of readings; and the robot transferring the seriously flawed well string member from the elevator toward the third storage area.

(18) Sense Load on Well String Member to Detect Well String Member Encountering Floor Some example embodiments include a workover method for handling a well string member 64 or 66, the workover method involving at least one of a controller 129, a robot 90 with an end effector 92, and a storage rack 72 with a floor 128, comprising:

under command of the controller, the end effector lowering the well string member into the storage rack;

sensing a weight carried by the end effector;

while sensing the weight carried by the end effector, sensing an appreciable decrease in the weight as the end effector lowers the well string member into the storage rack; and in response to sensing the appreciable decrease in the weight, the controller determining that the well string member has encountered the floor of the storage rack.

(19) Means for Detecting Upper End of Variable Length Tubing During RIH

Some example embodiments include a workover method, comprising:

storing the well tubing member 64 in a storage rack 72;

under command of the controller, the end effector mechanism 92 ascending at a higher speed toward the shoulder of the well tubing member;

the end effector mechanism sensing the shoulder;

upon sensing the shoulder, the end effector mechanism decelerating to a lower speed;

the end effector mechanism engaging the shoulder; and the end effector lifting the well tubing member out from within the storage rack.

(20) Sense Break-out

Some example embodiments include a workover method for unscrewing a tubing joint 130 and a rod joint 138, the workover method involving at least one of a controller, a tongs mechanism 132, an upper trolley mechanism 98 above the tongs mechanism, a first sensor 136 in communication with the controller, and a second sensor 134 in communication with the controller, the workover method comprising:

the tongs mechanism unscrewing the tubing joint;

while unscrewing the tubing joint, the first sensor sensing an abrupt upward movement of the tongs mechanism;

in response to sensing the abrupt upward movement of the tongs mechanism, the controller recognizing the tubing joint has separated;

the upper trolley mechanism unscrewing the rod joint;

while unscrewing the rod joint, the second sensor sensing an abrupt upward movement of the upper trolley mechanism; and in response to sensing the abrupt upward movement of the upper trolley mechanism, the controller recognizing the rod joint has separated.

(21) Upper Trolley Screws/Unscrews Rods

Some example embodiments include a workover method for unscrewing a tube 64 at a tubing joint 130 and a rod 66 at a rod joint 138, the workover method involving at least one of a tongs mechanism 132 and an upper trolley mechanism 98 above the tongs mechanism, the workover method comprising:

the tongs mechanism unscrewing the tubing joint;

while unscrewing the tubing joint via the tongs mechanism, the upper trolley mechanism stabilizing 140 an upper tube end 142 of the tube;

during a first period, the tongs mechanism partially unscrewing the rod joint; and during a second period following the first period, the upper trolley mechanism finishing unscrewing 144 the rod joint, wherein the upper trolley member includes a pinch valve for gripping and turning the rod.

Some example embodiments include a workover method for screwing together a tube 64 at a tubing joint 130 and a rod 66 at a rod joint 138, the workover method involving at least one of a tongs mechanism 132 and an upper trolley mechanism 98 above the tongs mechanism, the workover method comprising:

the tongs mechanism screwing together the tubing joint;

while screwing together the tubing joint via the tongs mechanism, the upper trolley mechanism stabilizing 140 an upper tube end of the tube;

during a first period, the upper trolley mechanism partially screwing 114 together the rod joint; and during a second period following the first period, the tongs mechanism finishing screwing together the rod joint.

(22) Brush-clean Box End, Lube Pin End

Some example embodiments include a workover system for the handling and treating a well string member 64 or 66 that includes internal threads and external threads, the workover system being operable at a wellbore 14 that defines a longitudinal centerline 84, the workover system comprising:

a workover vehicle having a storage rack area 72 or 74;

a robot system attached to the workover vehicle, the robot system 36 and 90 transferring the well string member between the storage rack area and the longitudinal centerline of the wellbore such that the internal threads travel along an upper path and the external threads travel along a lower path;

a powered cleaner 146 proximate the upper path; and a powered lubricator 148 proximate the lower path.

(23) Overall Logic Sequence: POOH/RIH Simultaneous with Rack Transfer

Some example embodiments include a workover method 150 for removing a well string from a wellbore, wherein the well string includes an upper well string member and a lower well string member, the wellbore defines a longitudinal centerline, the workover method involving the use of a workover vehicle that includes at least one of a tongs mechanism, a mast, a work area, a storage rack, a main trolley with an elevator, an upper trolley mechanism, a robotic system with an end effector, and a robotic jib, the workover method comprising:

aligning the work area of the workover vehicle with the longitudinal centerline of the wellbore;

the tongs mechanism unscrewing the upper well string member from the lower well string member concurrently with the main trolley descending;

the tongs mechanism unscrewing the upper well string member from the lower well string member concurrently with the upper trolley mechanism stabilizing the upper well string member;

the end effector taking the upper well string member from the upper trolley mechanism;

the robotic system transferring the upper well string member to the storage rack; and the elevator lifting the well string concurrently with the end effector translating in a lateral direction that is perpendicular to the longitudinal centerline of the wellbore.

Figure 61:
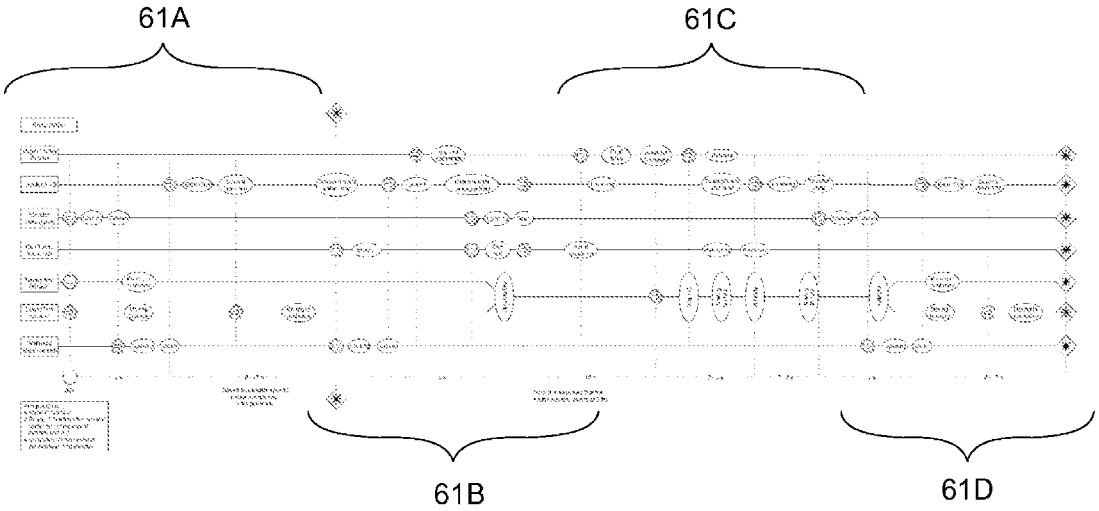
FIG. 61 is a timing chart showing the workover system's sequence of operation in pulling sucker rods 66 out from within the wellbore. Various method steps are plotted versus a horizontal time reference that progresses generally from left to right. The chart shows several horizontal lines of method steps, wherein each line show a series of sequentially performed method steps, and a comparison of the horizontal lines identifies which method steps can occur simultaneously to minimize the overall cycle time. Completion of one cycle of method steps ending at the far right column of asterisks initiates a subsequent cycle that begins at the two left asterisks. Encircled hollow arrows function as a gate that blocks work flow from left to right through the arrow until the gate is opened by completion of a method step tied to the arrow via a dotted line. The encircled hollow arrows are analogous to a transistor or SCR that is triggered open by input to its gate terminal (dotted line).
Figure 61A:
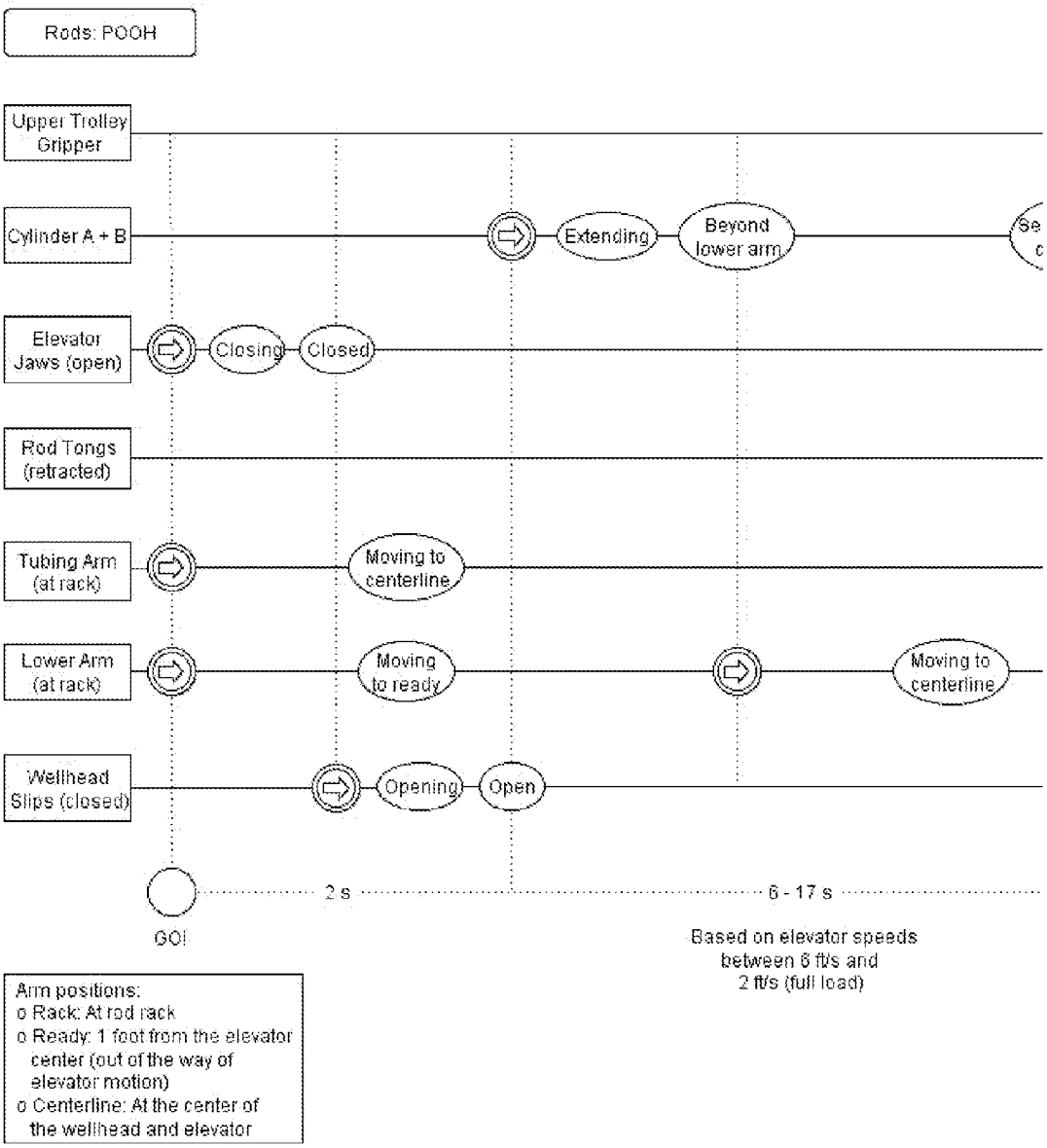
FIGS. 61A, 61B, 61C and 61D are enlarged views of the corresponding 61A, 61B, 61C and 61D portions identified in FIG. 61.
Figure 61B:
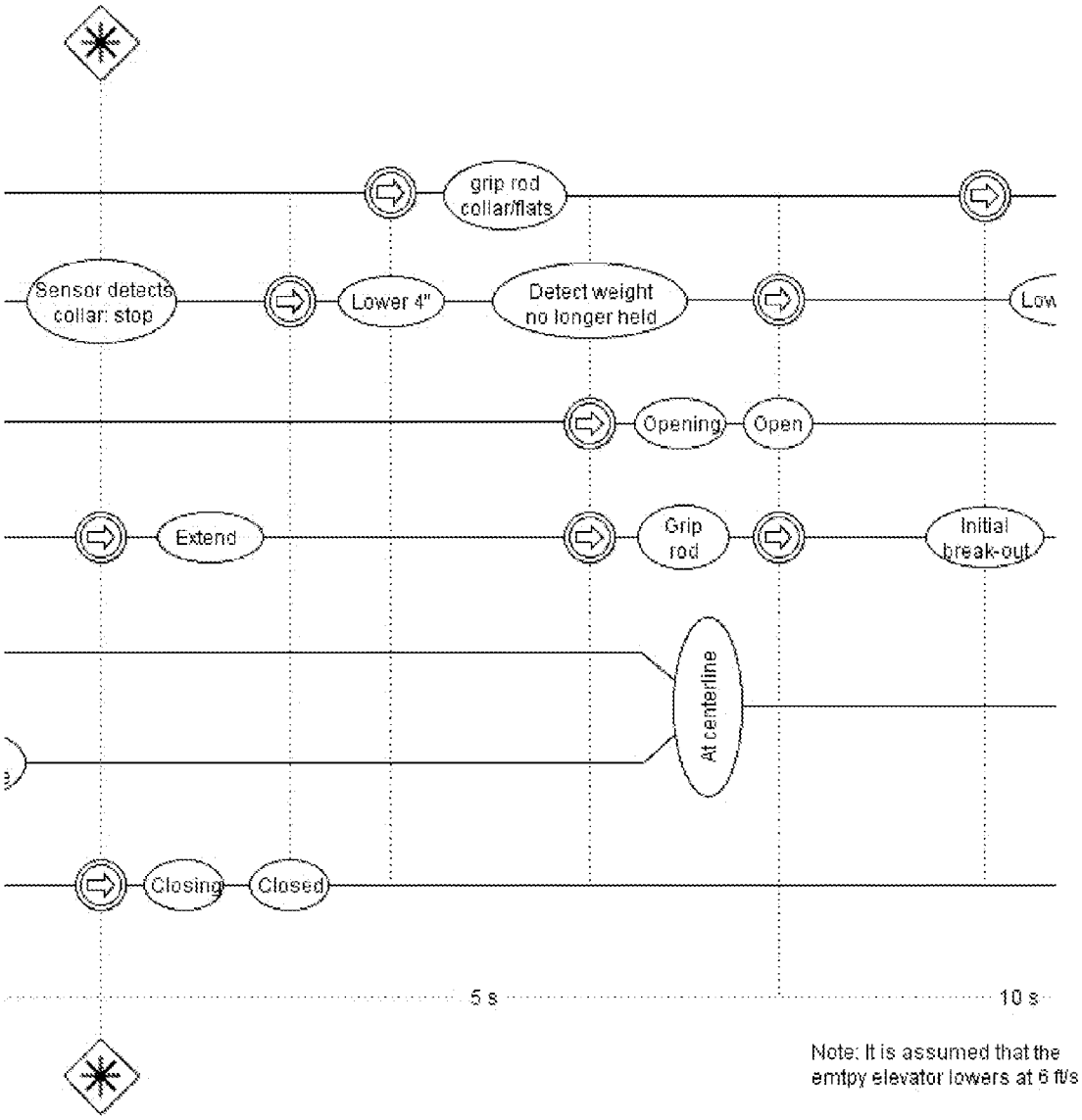
Figure 61C:
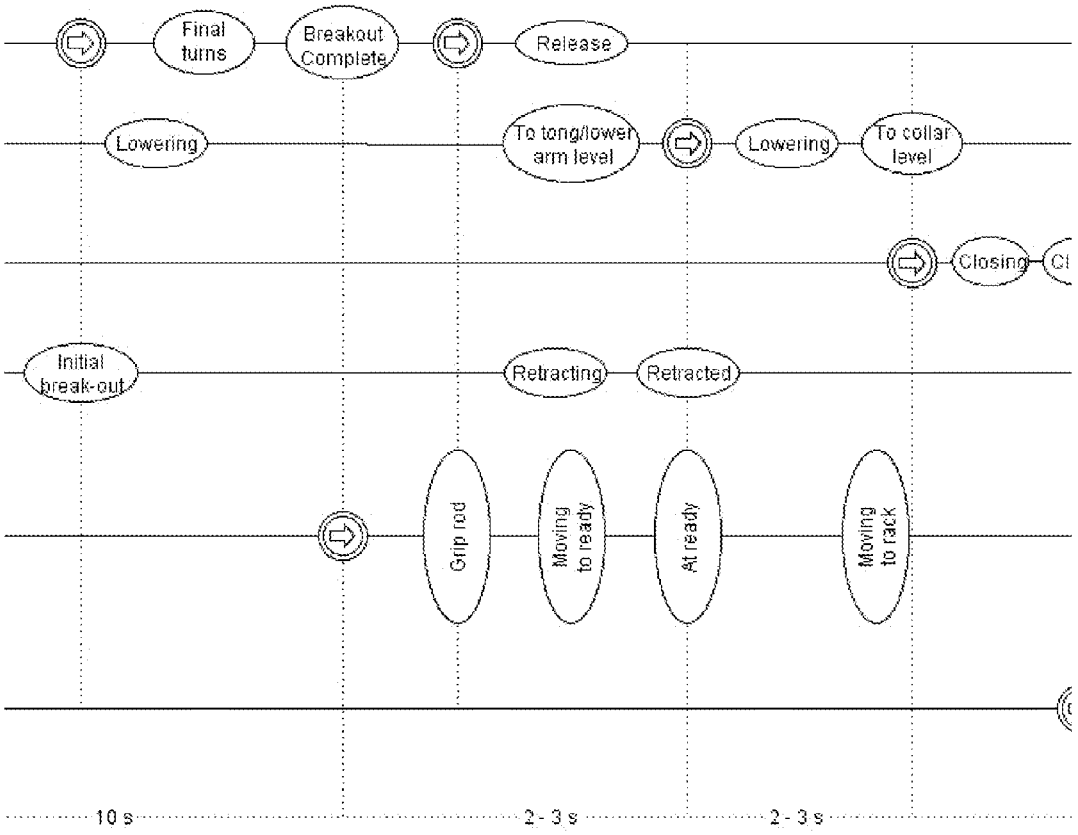
Figure 61D:
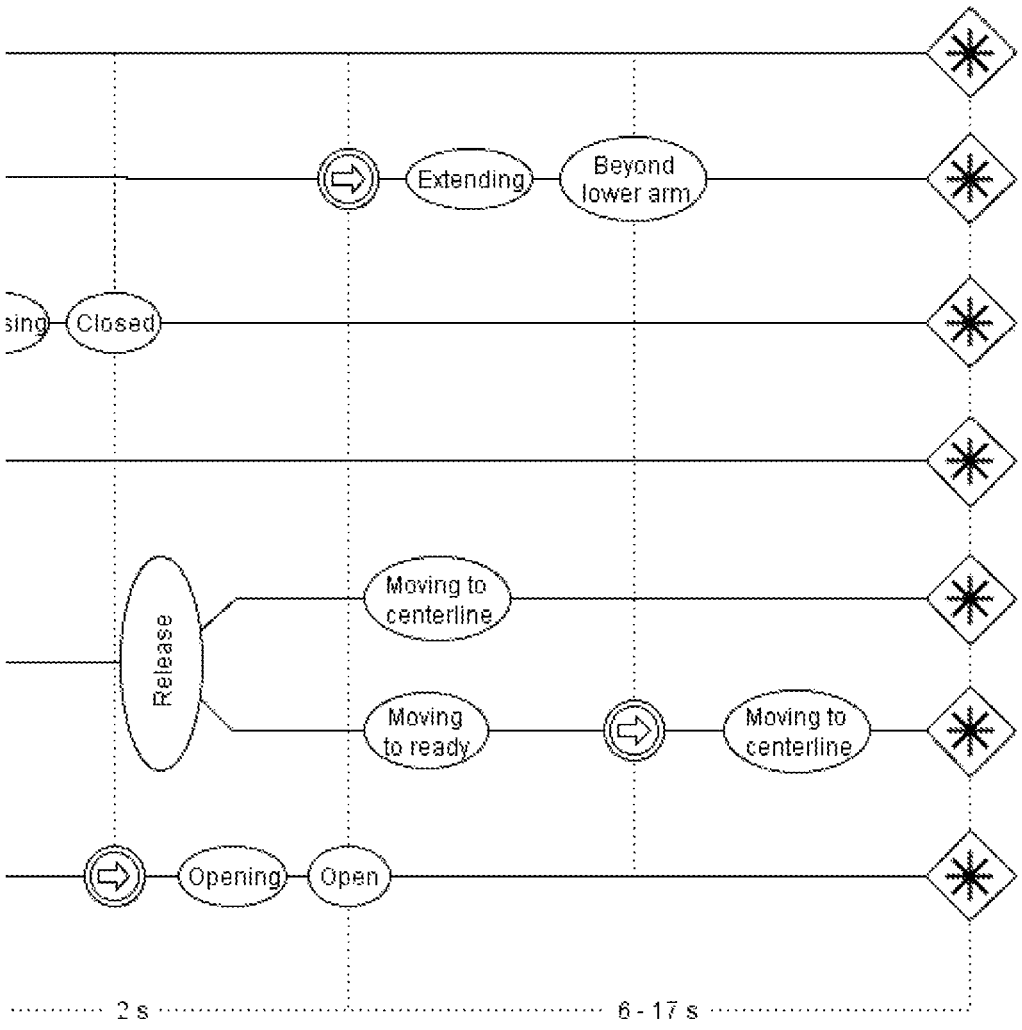

With reference to FIGS. 61, 61A, 61C, 61D and particularly the far left blocks of FIGS. 61 and 61A, "Rods POOH" means rods pulling out of hole, i.e., removing sucker rods. "Upper Trolley Gripper" refers to upper trolley mechanism 98. "Cylinder A+B" refers to the actuators for raising and lowering main trolley 156, wherein "extending" corresponds to lifting main trolley 156, and "lowering" corresponds to main trolley 156 descending. "Elevator Jaws" refers to the elevator head 106, wherein "closed" means elevator head 106 is configured and positioned to capture the upper end of a shaft, and "open" means elevator head 106 is retracted and configured to release the shaft's upper end. "Rod Tongs" refers to tongs mechanism 132, wherein "extend" corresponds to arrow 232 (FIG. 85A) and "retracting" corresponds to arrow 246 (FIG. 87A). "Tubing Arm" refers to arm assembly 158 of upper robot 90. "Lower Arm" refers to arm assembly 164 of lower robot 36. "Wellhead Slips" refers to wellhead slip 110.

Figure 62:
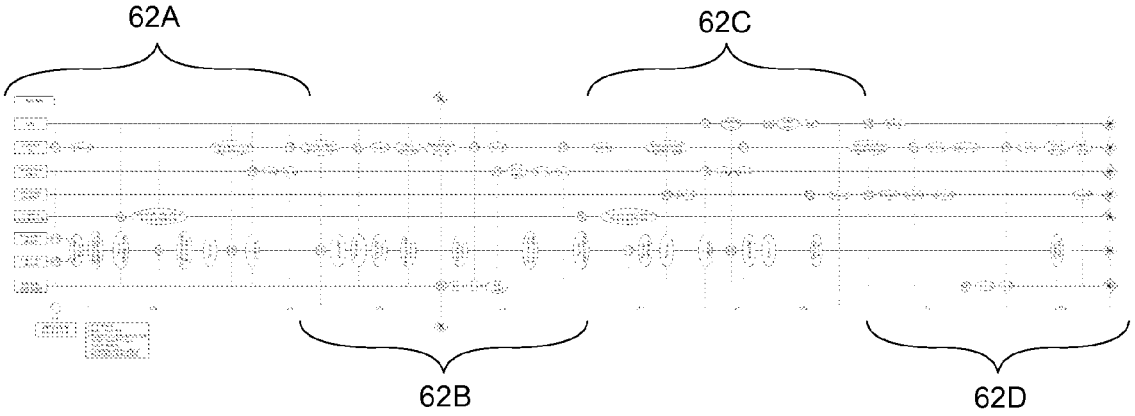
FIG. 62 is a timing chart similar to FIG. 61 but showing the steps involved in inserting sucker rods 66 in the wellbore.
Figure 62A:
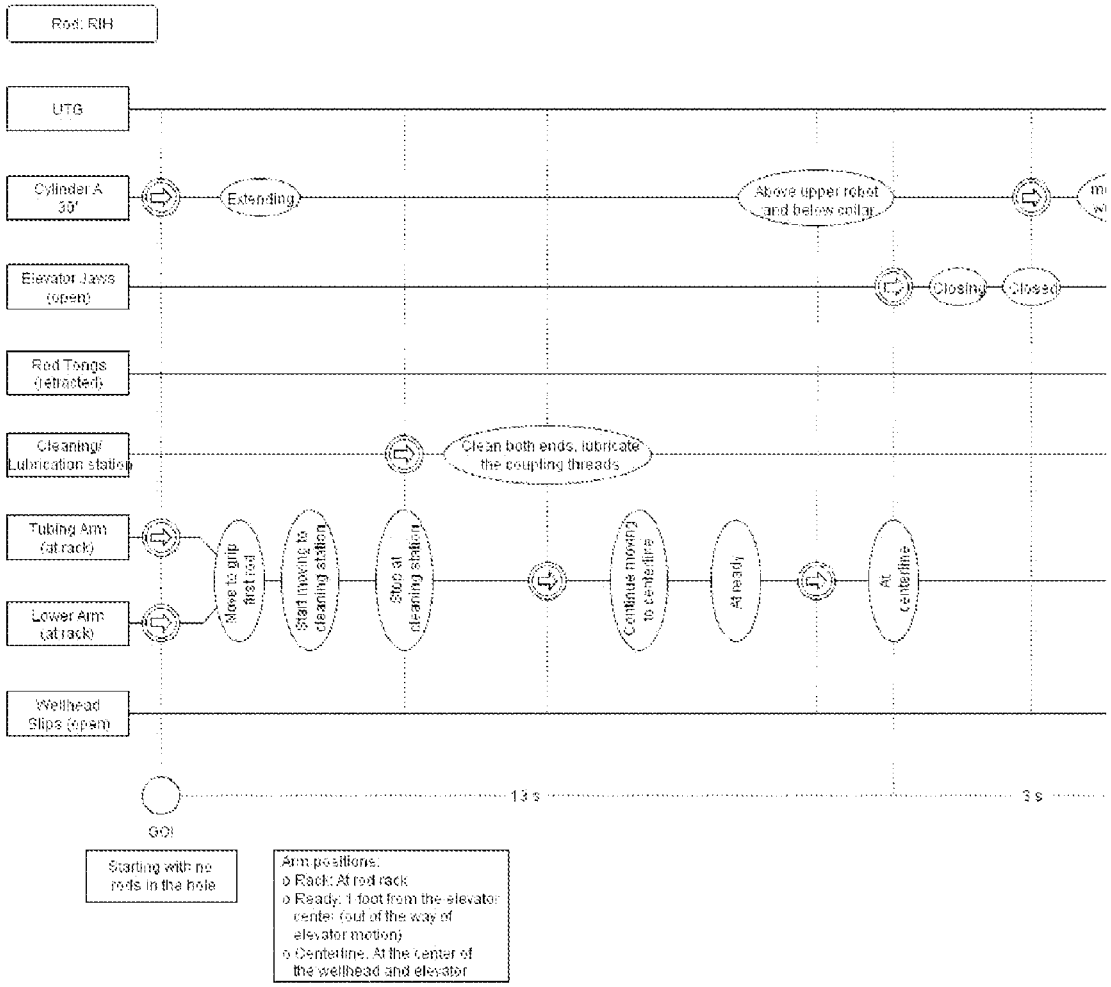
FIGS. 62A, 62B, 62C and 62D are enlarged views of the corresponding 62A, 62B, 62C and 61D portions identified in FIG. 62.
Figure 62B:
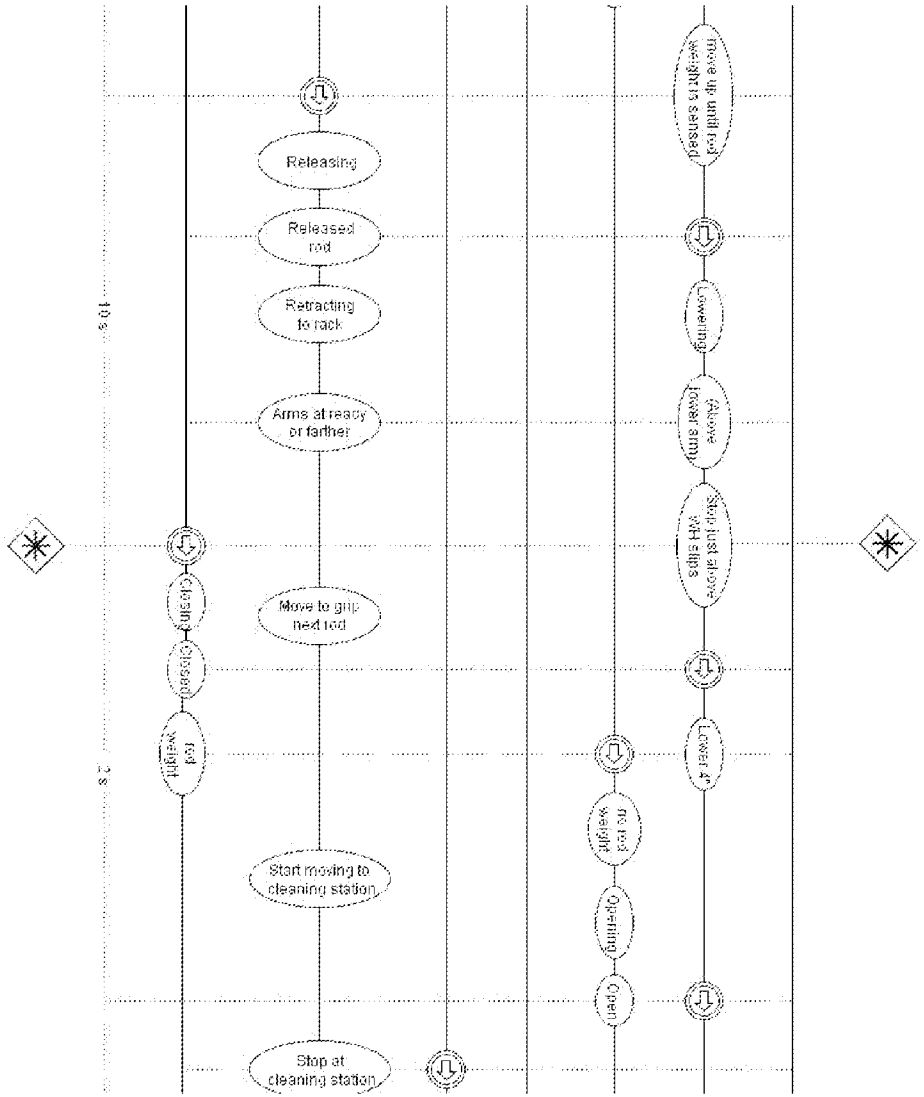
Figure 62C:
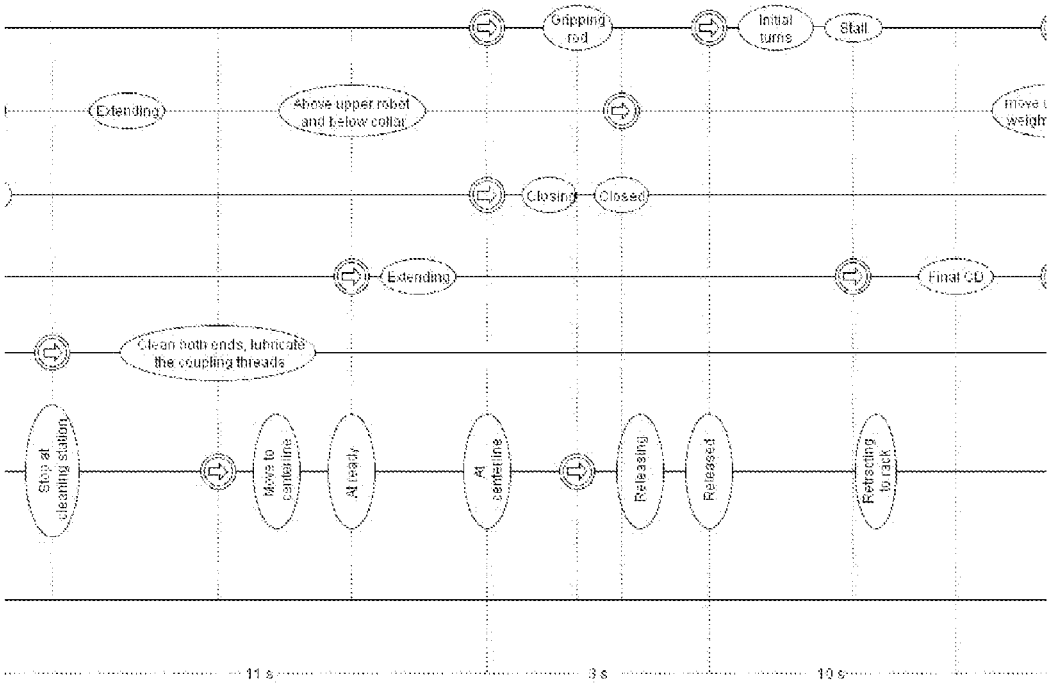
Figure 62D:
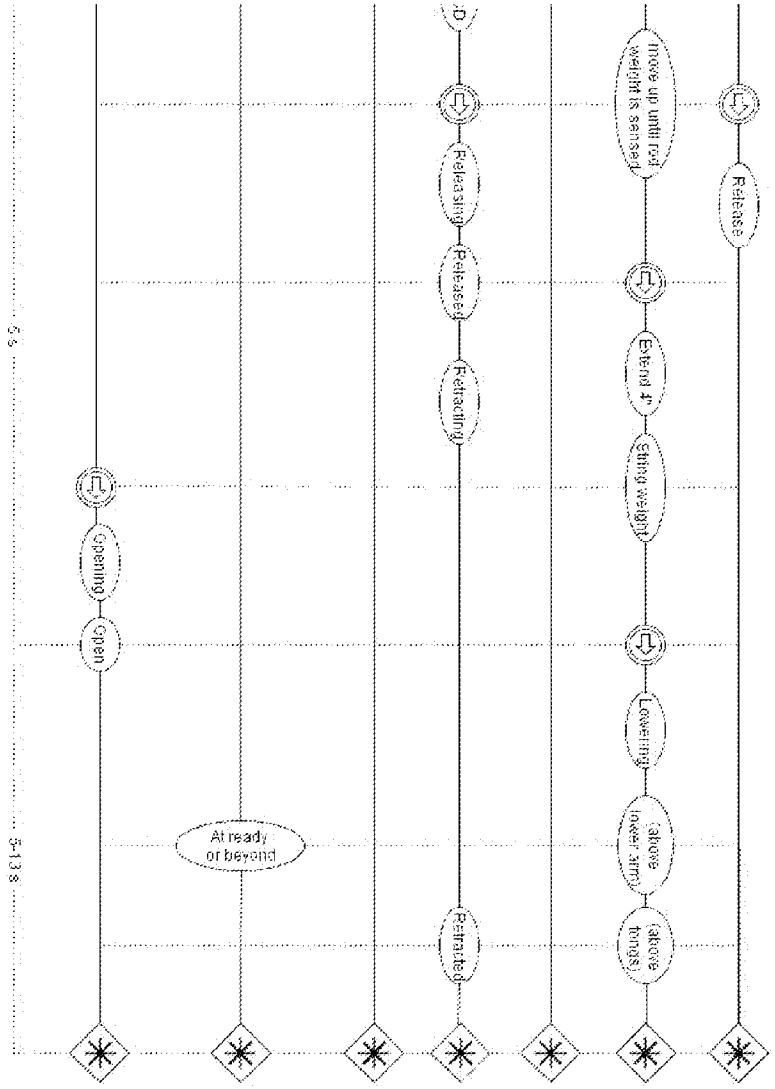

With reference to FIGS. 62, 62A, 62C, 62D and particularly the far left blocks of FIGS. 62 and 62A, "Rods RIH" means rods running in hole, i.e., installing sucker rods. "UTG" refers to upper trolley mechanism 98. "Cylinder A 30" refers to the actuator for raising and lowering main trolley 156, wherein Cylinder-A extending corresponds to lifting main trolley 156, and Cylinder-A lowering corresponds to main trolley 156 descending. "Elevator Jaws" refers to the elevator head 106, wherein "closed" means elevator head 106 is configured and positioned to capture the upper end of a shaft, and "open" means elevator head 106 is retracted and configured to release the shaft's upper end. "Rod Tongs" refers to tongs mechanism 132, wherein "extend" corresponds to arrow 232 (FIG. 85A) and "retracting" corresponds to arrow 246 (FIG. 87A). "Cleaning Lubrication Station" refers to cleaning or lubricating the upper and lower ends of a shaft. "Tubing Arm" refers to arm assembly 158 of upper robot 90. "Lower Arm" refers to arm assembly 164 of lower robot 36. "Wellhead Slips" refers to wellhead slip 110.

Figure 63:
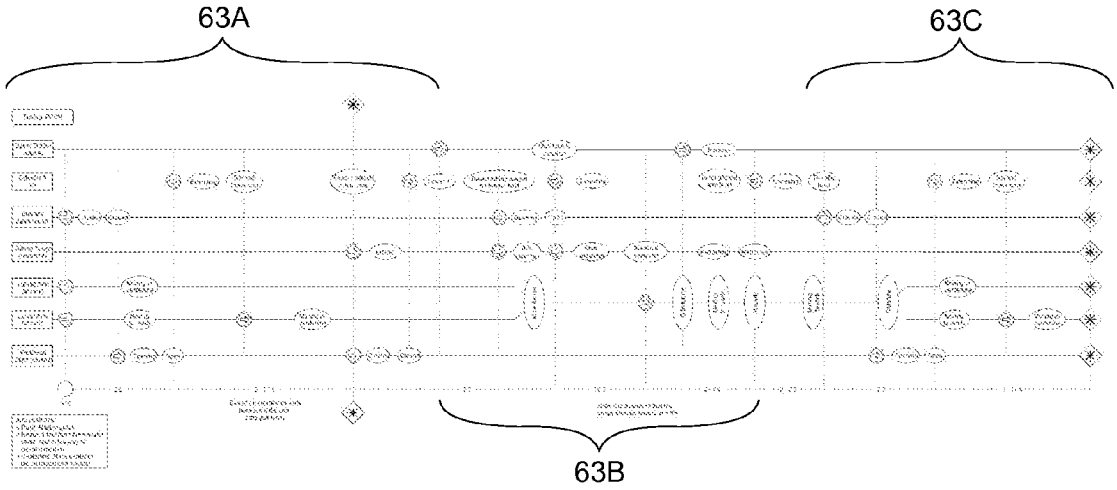
FIG. 63 is a timing chart similar to FIG. 61 but showing the steps involved in removing tubing 64 out from with the wellbore.
Figure 63A:
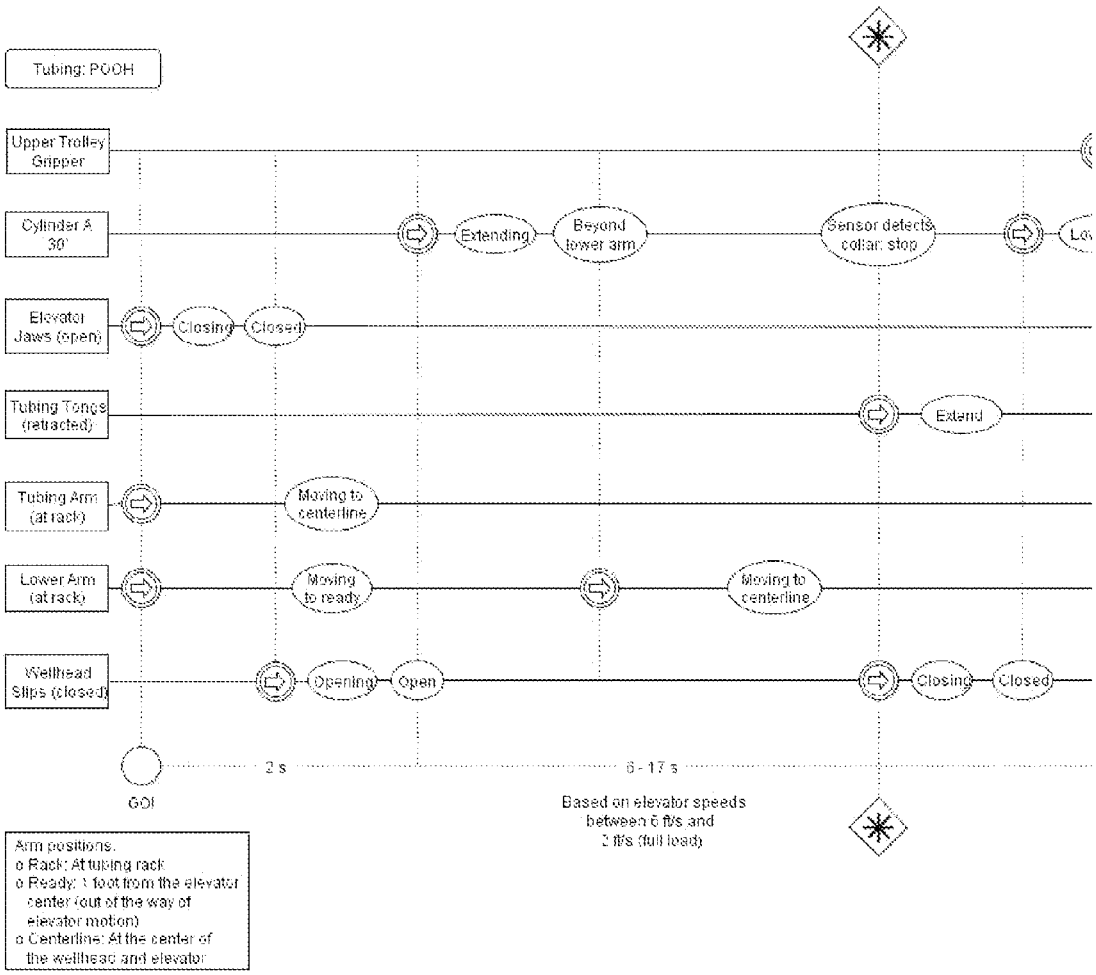
FIGS. 63A, 63B and 63C are enlarged views of the corresponding 63A, 63B and 63C portions identified in FIG. 63.
Figure 63B:
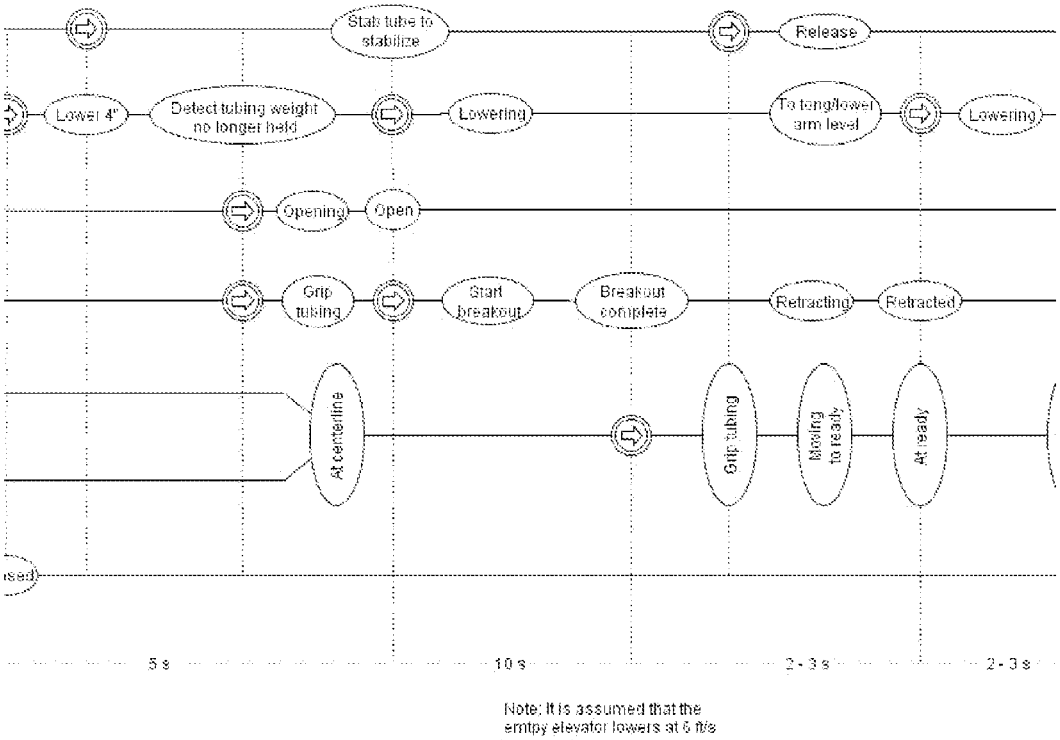
Figure 63C:
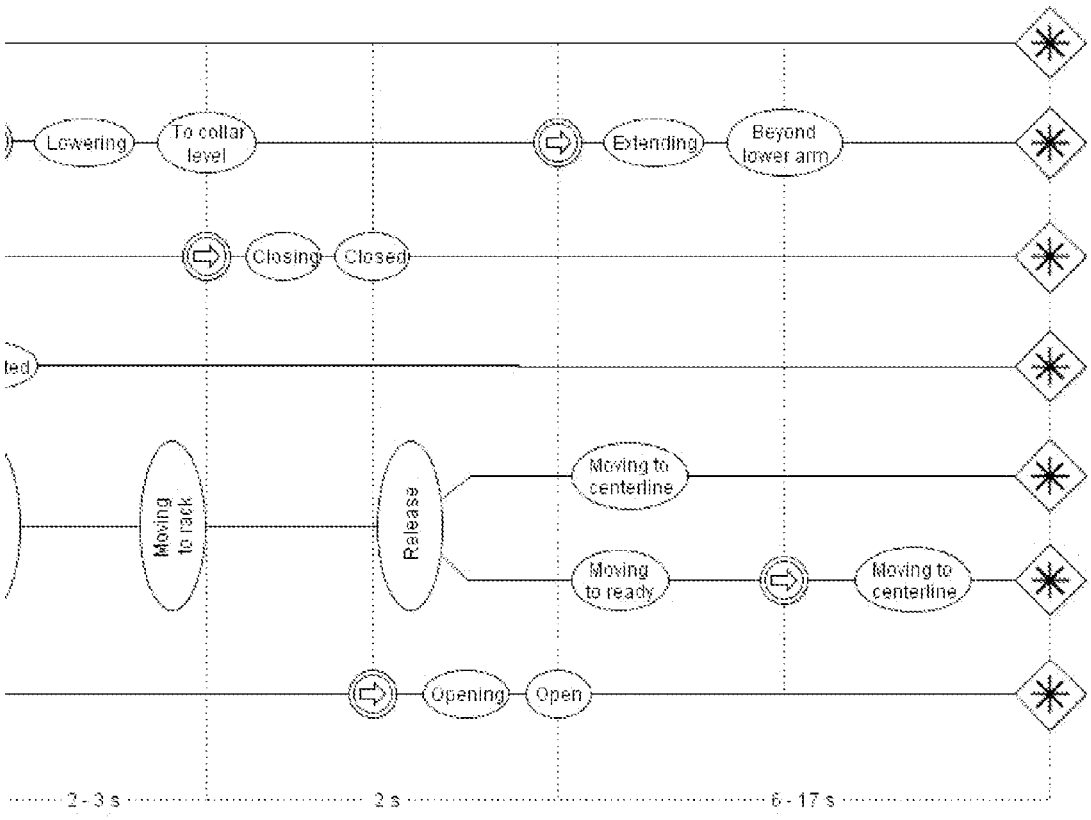

With reference to FIGS. 63, 63A, 63B, 63C and particularly to the far left blocks in FIGS. 63 and 63A, "Tubing POOH" means tubing pulling out of hole, i.e., removing tubing. "Upper Trolley Gripper" refers to upper trolley mechanism 98. "Cylinder A 30" refers to the actuator for raising and lowering main trolley 156, wherein Cylinder-A extending corresponds to lifting main trolley 156, and Cylinder-A lowering corresponds to main trolley 156 descending. "Elevator Jaws" refers to the elevator head 106, wherein "closed" means elevator head 106 is configured and positioned to capture the upper end of a shaft, and "open" means elevator head 106 is retracted and configured to release the shaft's upper end. "Tubing Tongs" refers to tongs mechanism 132, wherein "extend" corresponds to arrow 232 (FIG. 85A) and "retracting" corresponds to arrow 246 (FIG. 87A). "Tubing Arm" refers to arm assembly 158 of upper robot 90. "Lower Arm" refers to arm assembly 164 of lower robot 36. "Wellhead Slips" refers to wellhead slip 110.

Figure 64:
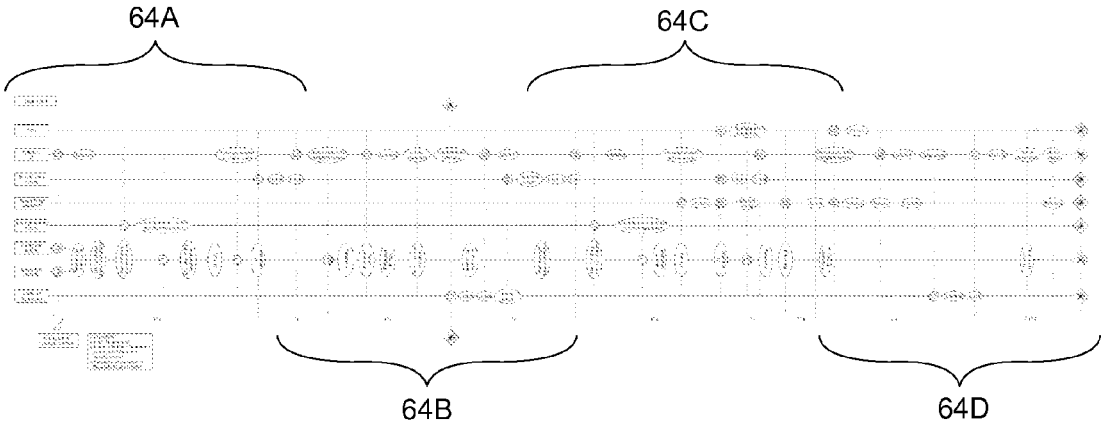
FIG. 64 is a timing chart similar to FIG. 61 but showing the steps involved in inserting tubing member 66 in the wellbore.
Figure 64A:
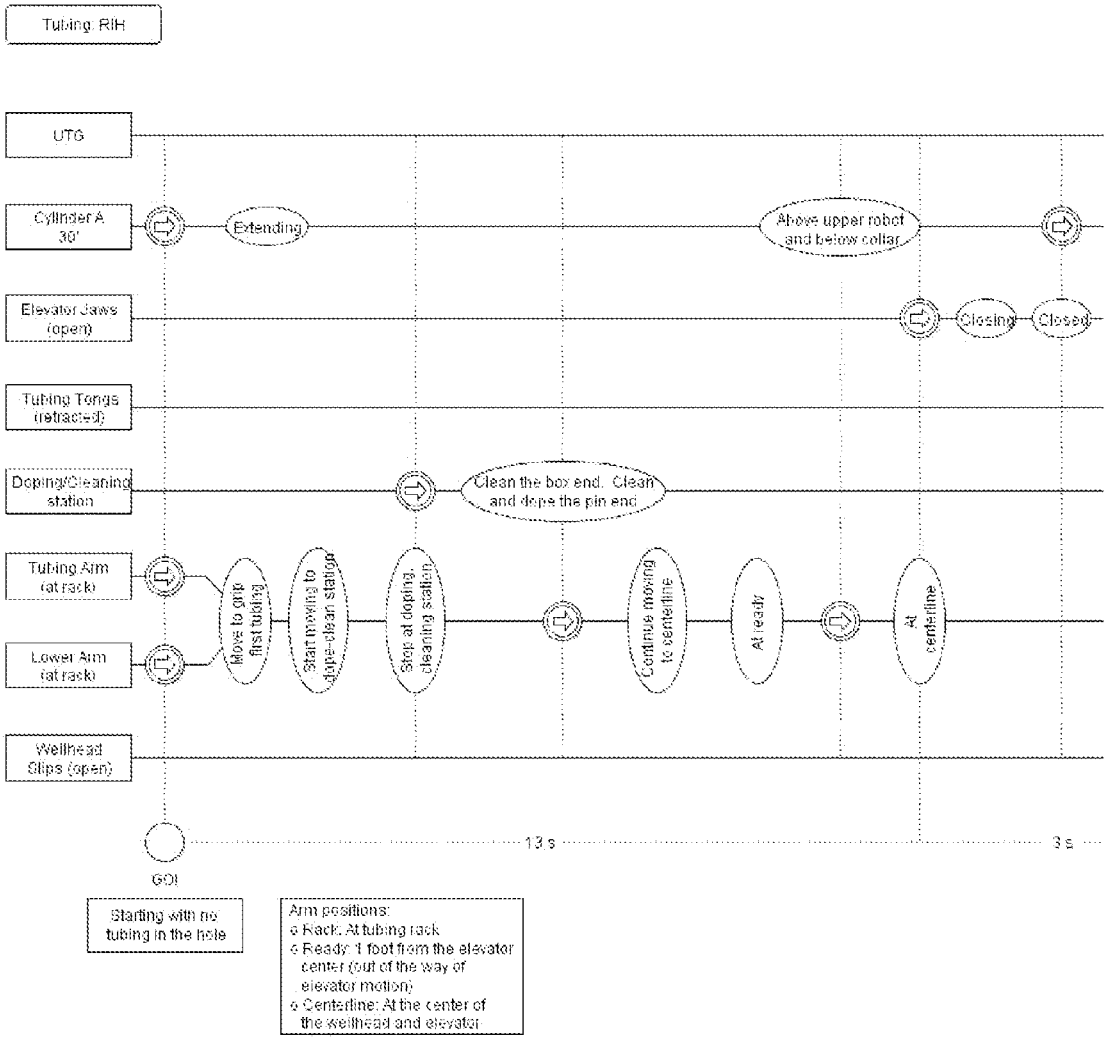
FIGS. 64A, 64B, 64C and 64D are enlarged views of the corresponding 64A, 64B, 64C and 61D portions identified in FIG. 64.
Figure 64B:
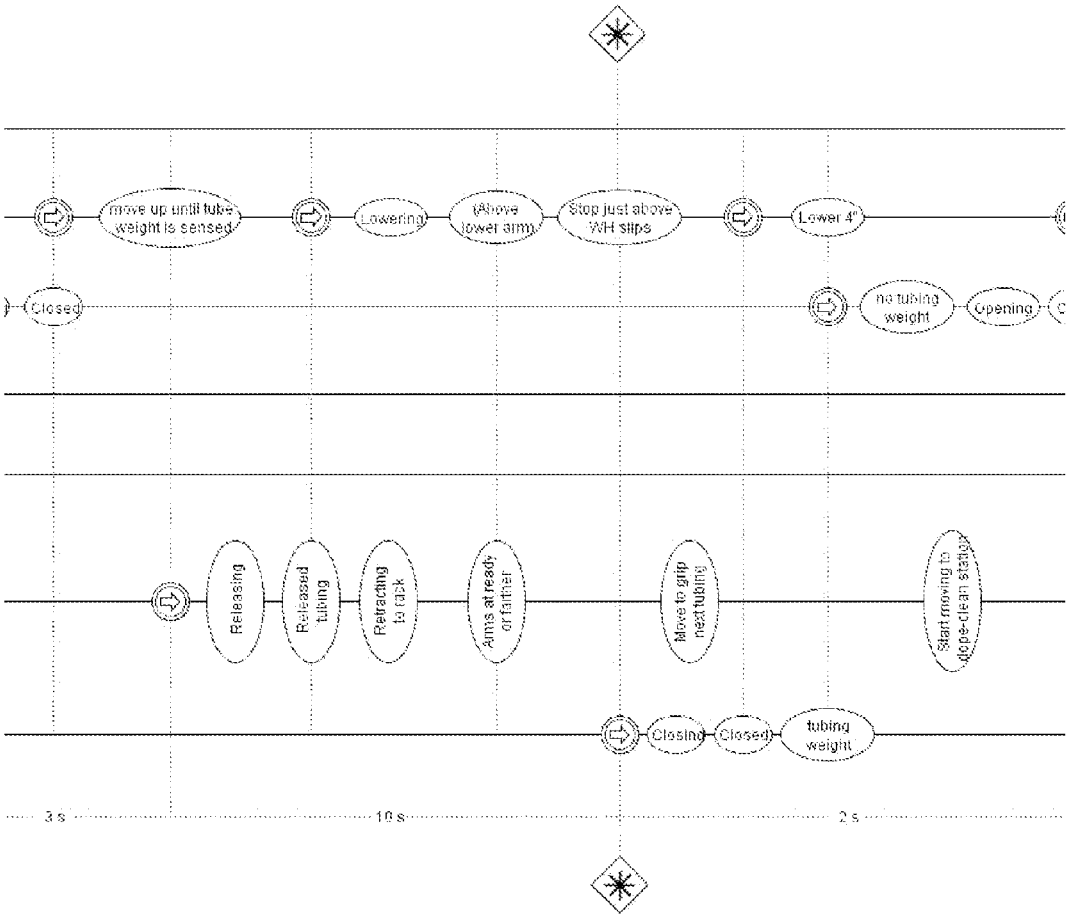
Figure 64C:
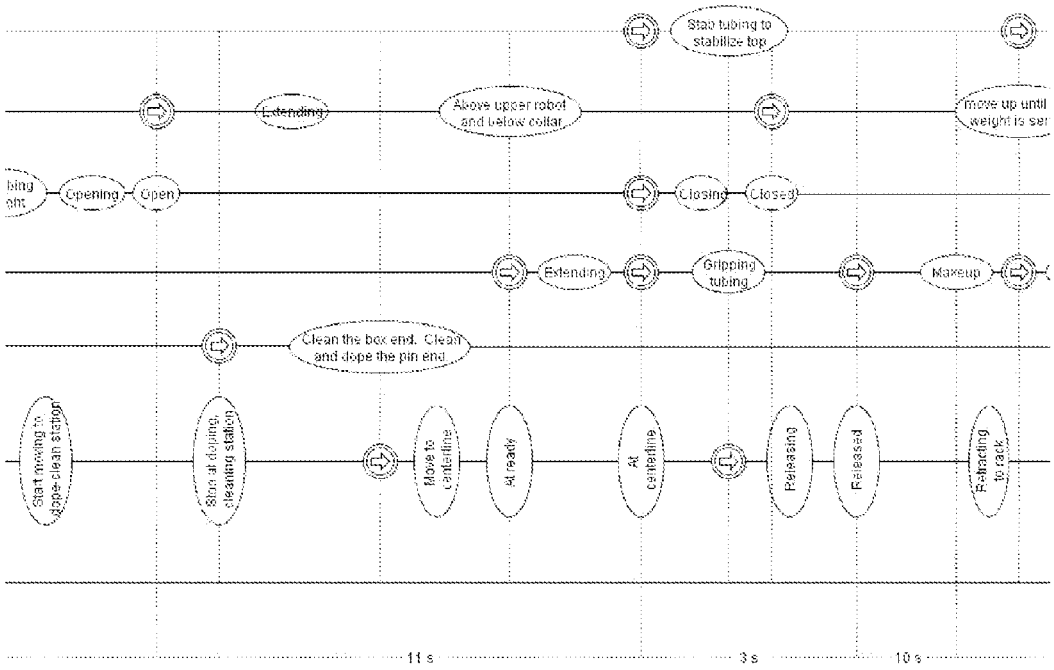
Figure 64D:
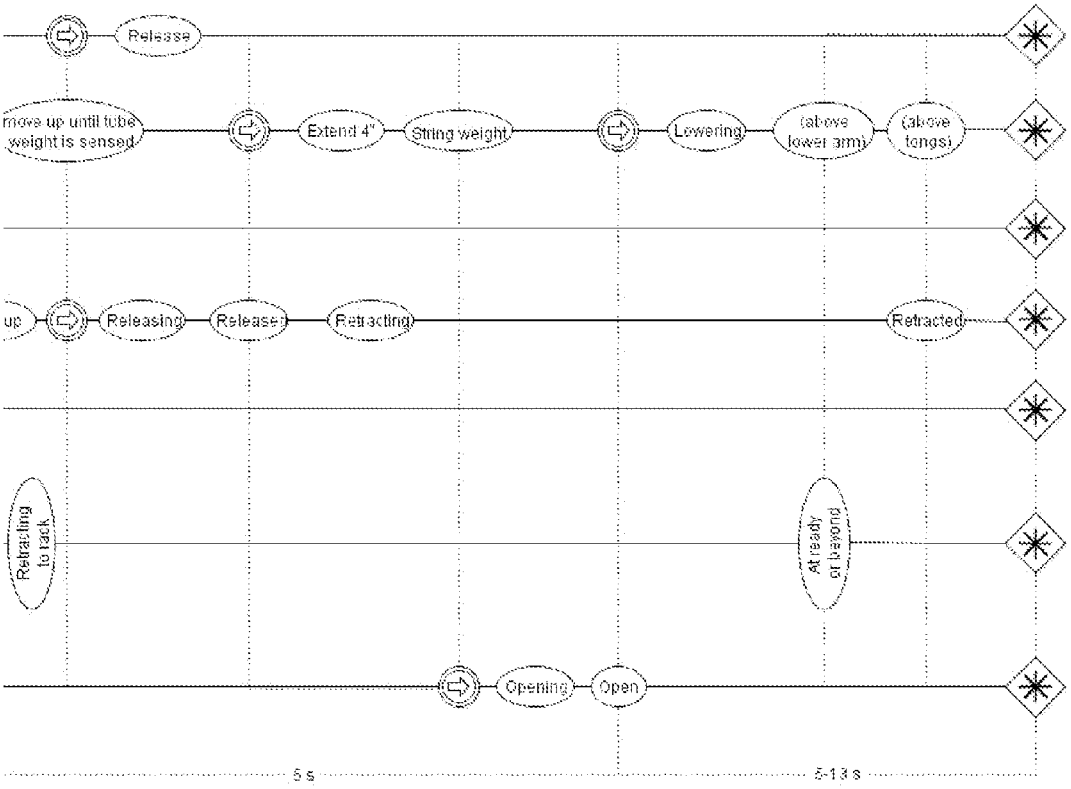
Figure 65:
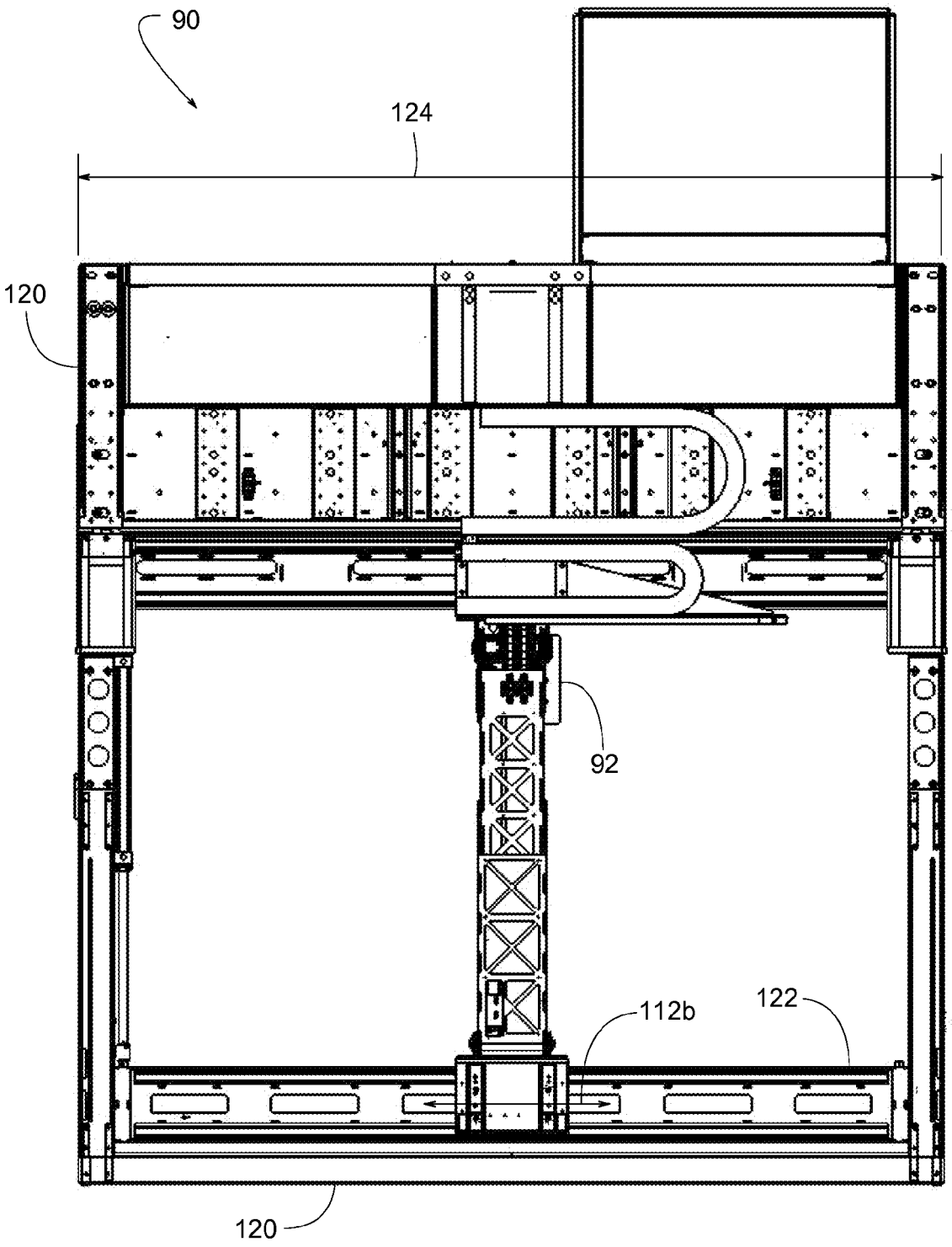
FIG. 65 is a back view of the upper robot 90 with its articulated arm portion that holds end effector 92.
Figure 66:
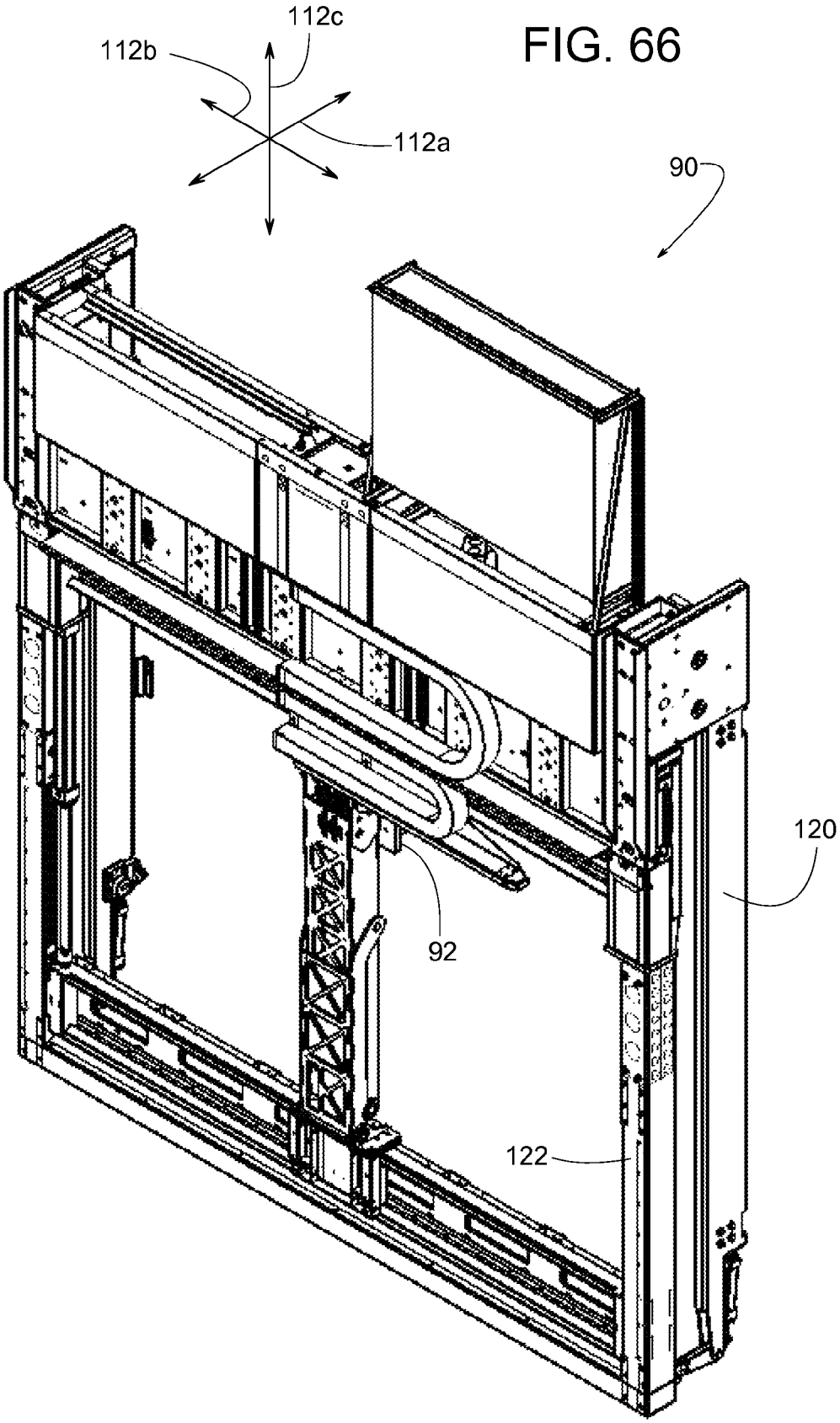
FIG. 66 is a perspective view of the upper robot 90.
Figure 67:
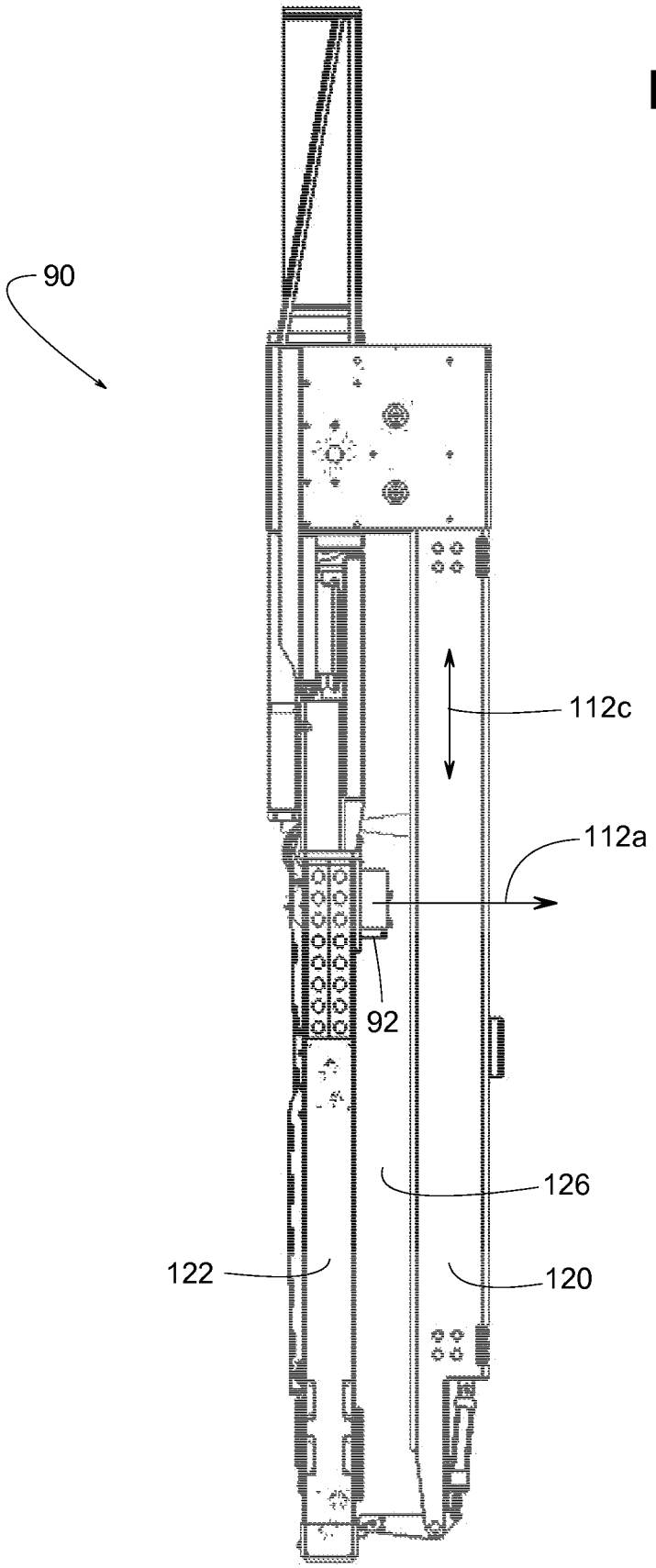
FIG. 67 is a side view of the FIG. 65.
Figure 68:
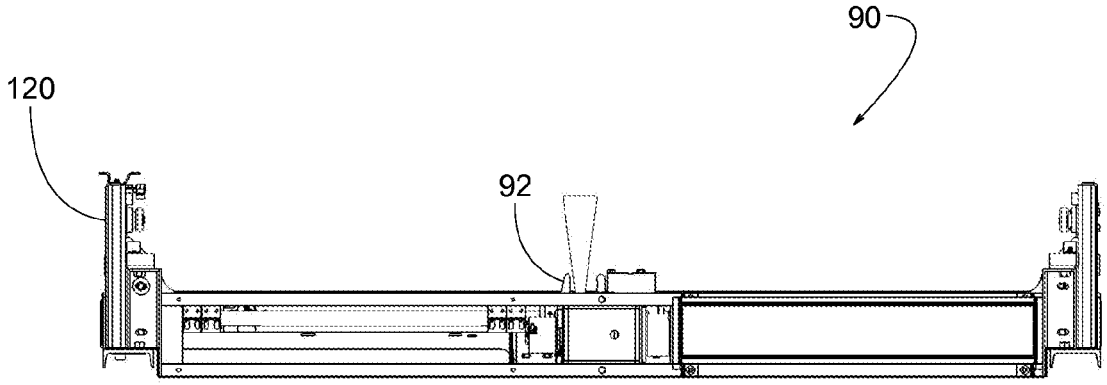
FIG. 68 is a top view of FIG. 65.
Figure 69:
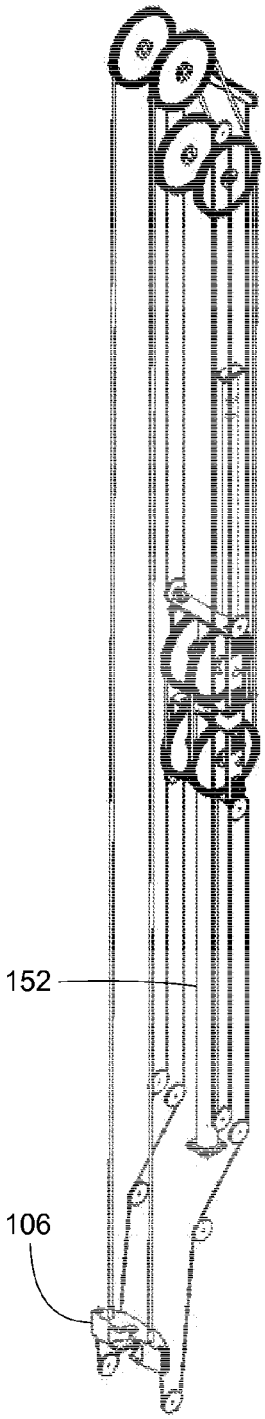
FIG. 69 is a perspective view of a hydraulic drive system that drives the vertical travel of the main trolley which carries elevator 106. The hydraulic drive system comprises a larger cylinder 152, a smaller cylinder 154 and a plurality of sheaves and cables.
Figure 70:
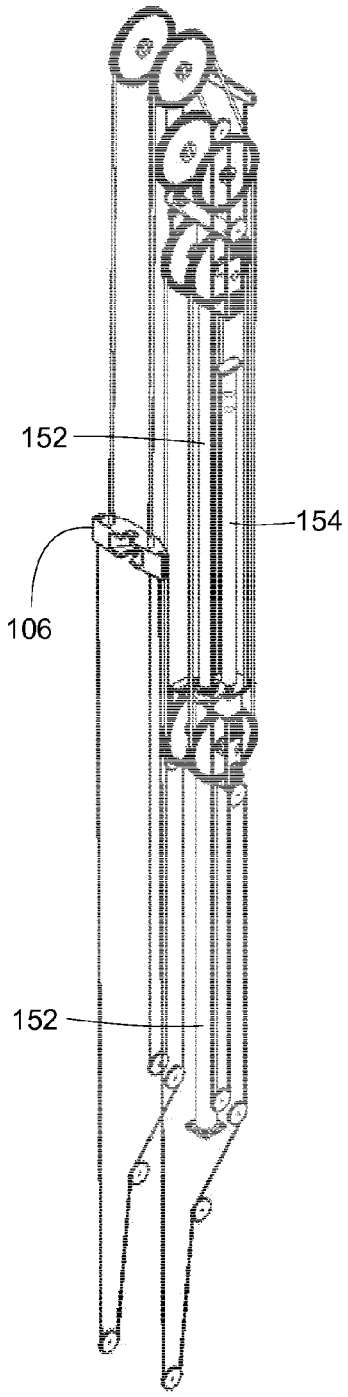
FIG. 70 is a perspective view similar to FIG. 69 but showing the larger cylinder 152 extended to raise elevator 106 to an intermediate height.
Figure 71:
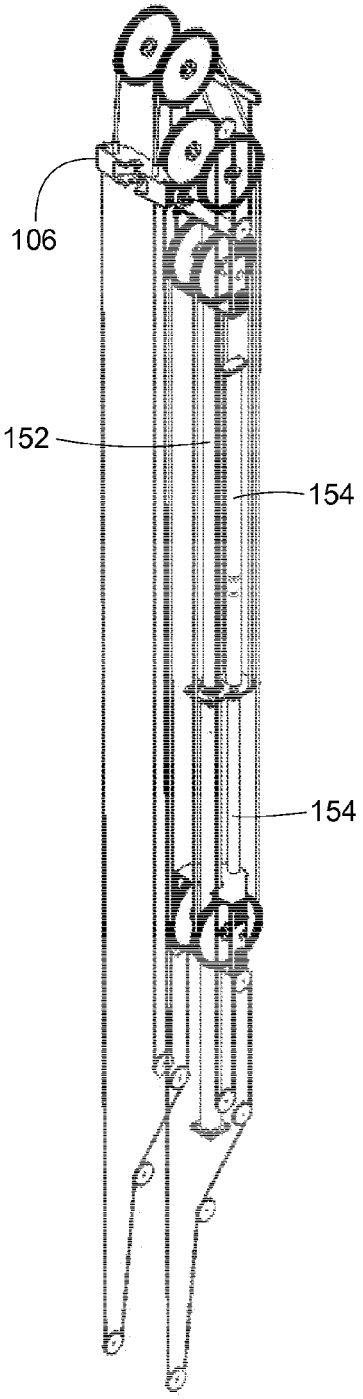
FIG. 71 is a perspective view similar to FIG. 70 but showing the both cylinders extended to raise elevator 106 to its uppermost position.
Figure 72:
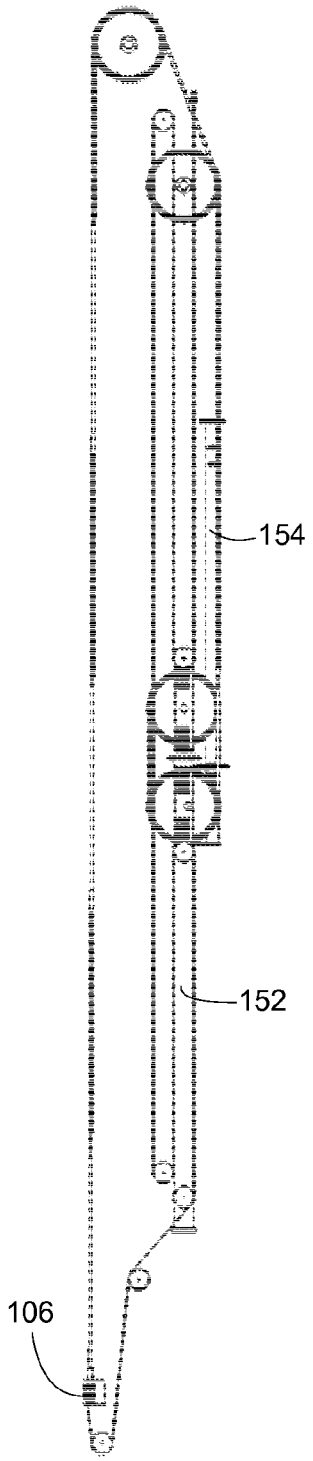
FIGS. 72, 73 and 74 are side views corresponding to FIGS. 69, 70 and 71 respectively.
Figure 73:
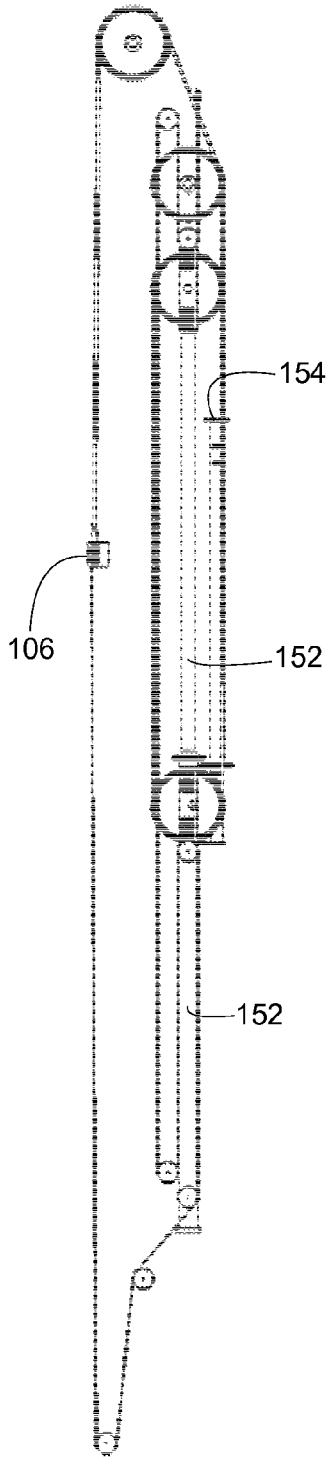
Figure 74:
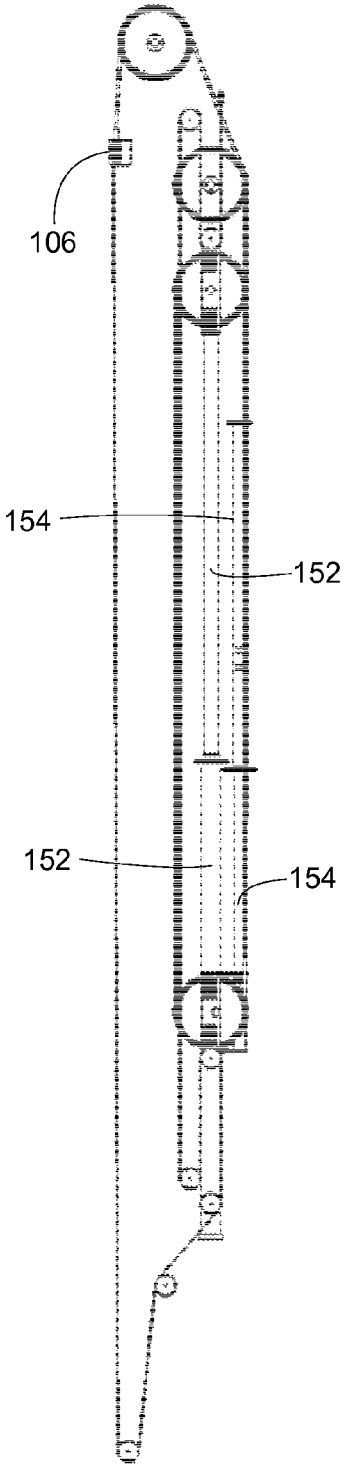
Figure 75:
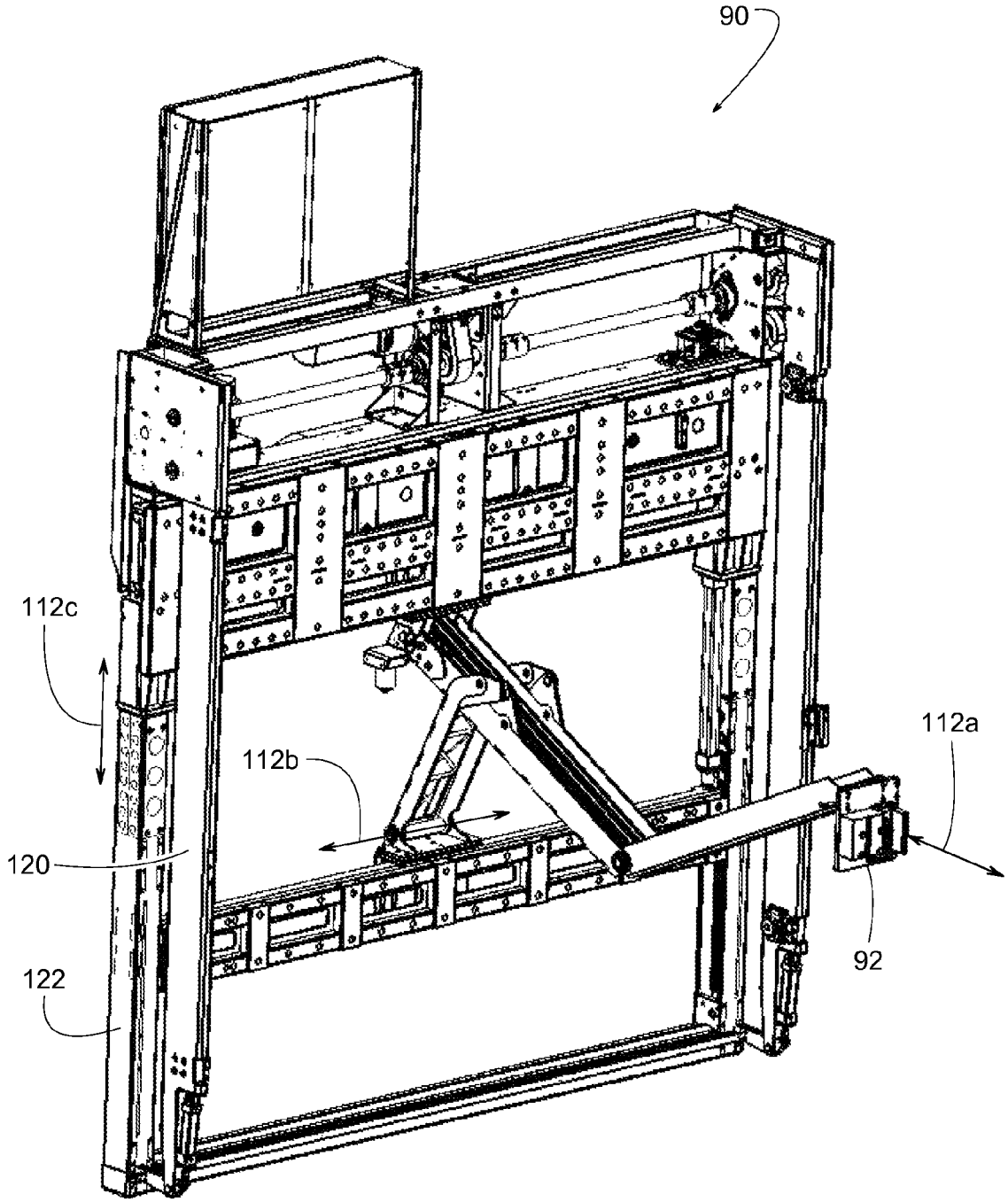
FIG. 75 is a perspective view showing the upper robot 90 with its articulated arm extended and its end effector 92 at a laterally centered position.
Figure 76:
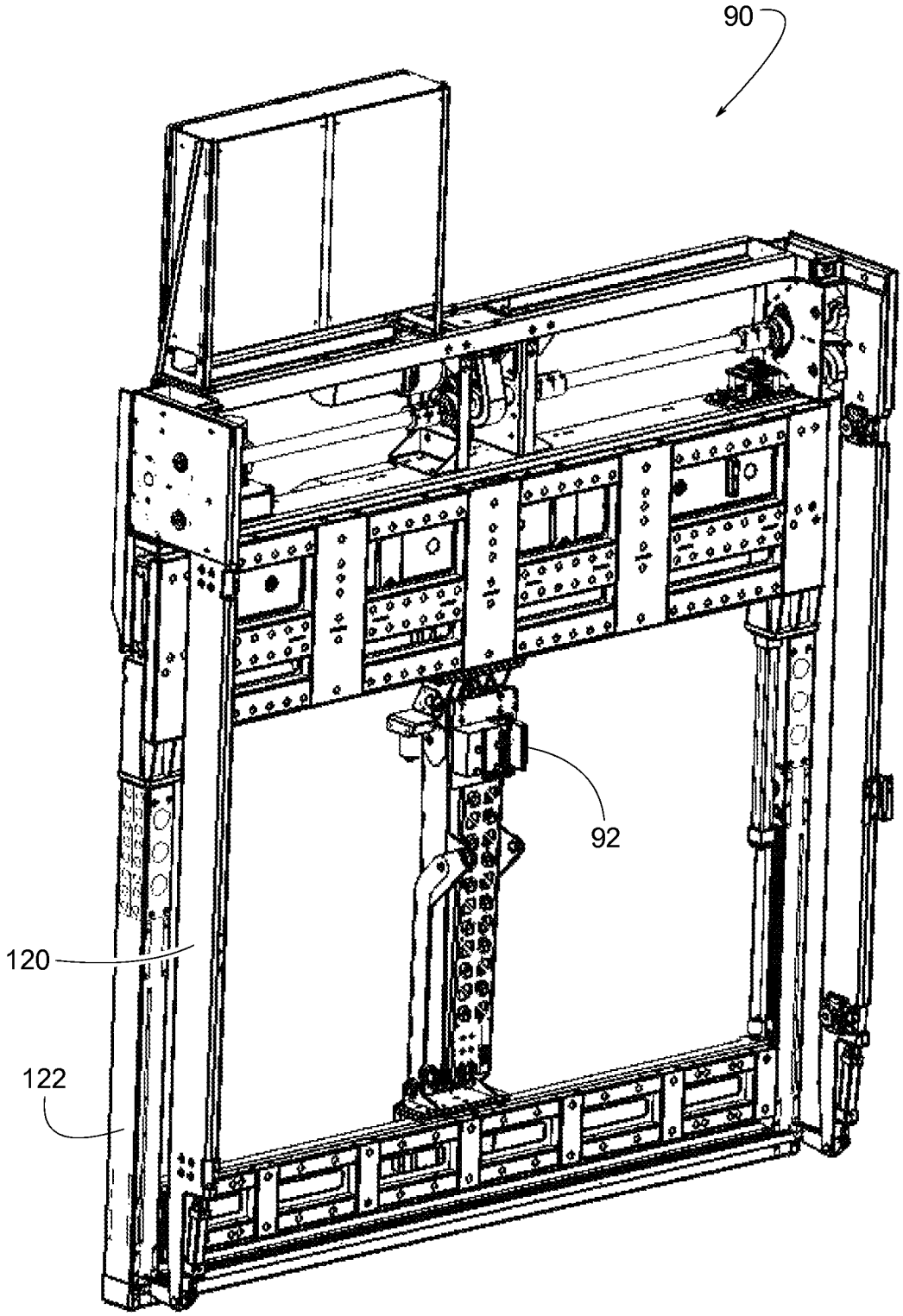
FIG. 76 is a perspective view similar to FIG. 75 but showing the articulated arm retracted.
Figure 77:
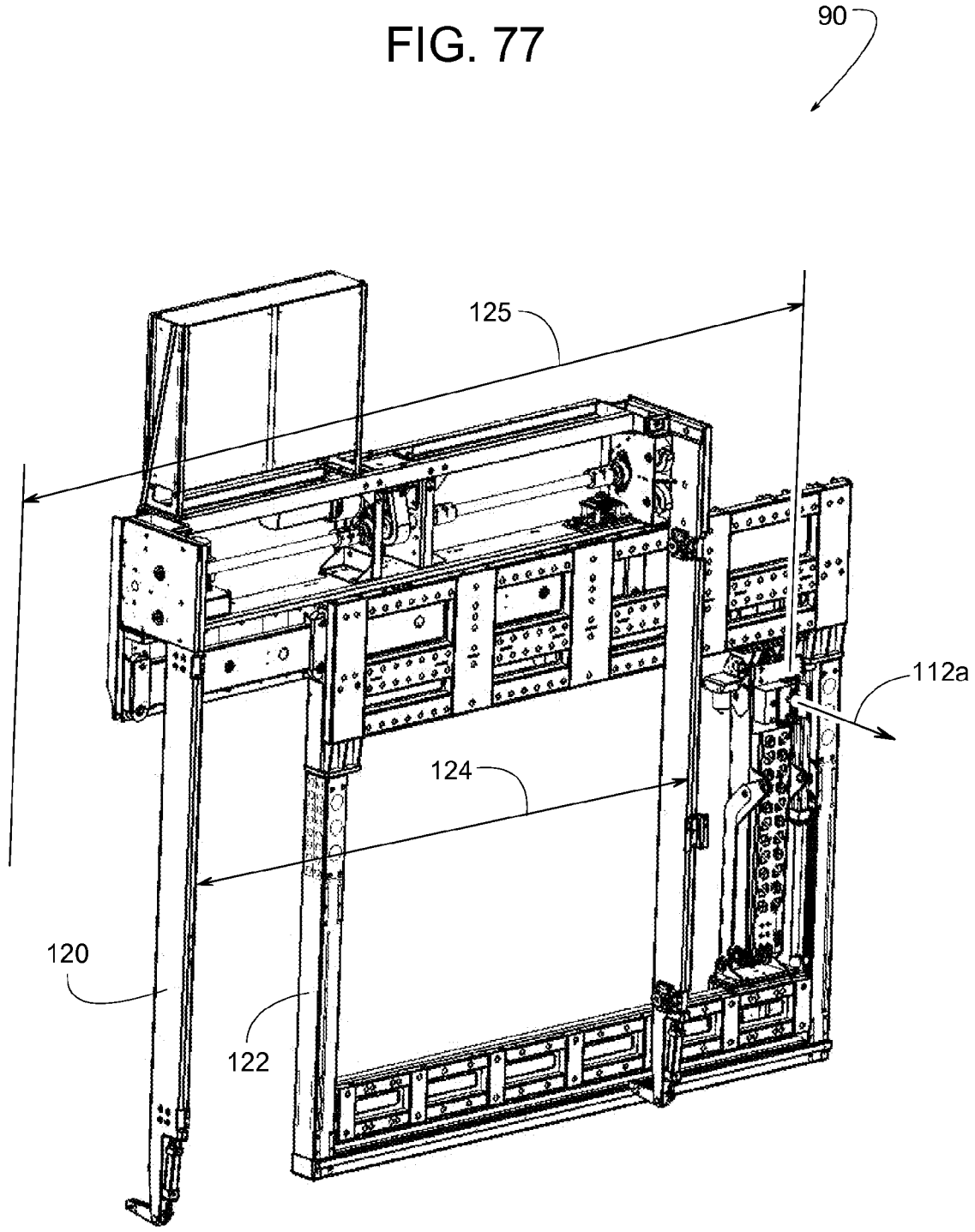
FIG. 77 is a perspective view similar to FIG. 76 but showing the shuttle 122 and the articulated arm both shifted laterally to one side of carriage 120.

With reference to FIGS. 64, 64A, 64C, 64D and particularly the far left blocks of FIG. 64A, "Tubing RIH" means tubing running in hole, i.e., installing tubing. "UTG" refers to upper trolley mechanism 98. "Cylinder A 30" refers to the actuator for raising and lowering main trolley 156, wherein Cylinder-A extending corresponds to lifting main trolley 156, and Cylinder-A lowering corresponds to main trolley 156 descending. "Elevator Jaws" refers to the elevator head 106, wherein "closed" means elevator head 106 is configured and positioned to capture the upper end of a shaft, and "open" means elevator head 106 is retracted and configured to release the shaft's upper end. "Tubing Tongs" refers to tongs mechanism 132, wherein "extend" corresponds to arrow 232 (FIG. 85A) and "retracting" corresponds to arrow 246 (FIG. 87A). "Doping/Cleaning Station" refers to cleaning of the upper and lower ends of a shaft. "Tubing Arm" refers to arm assembly 158 of upper robot 90. "Lower Arm" refers to arm assembly 164 of lower robot 36. "Wellhead Slips" refers to wellhead slip 110.

(24) Hero Valve

Some example embodiments include a workover system for servicing a well that includes a tubular well string with an upper shoulder, the tubular well string defining a fluid passageway therethrough, the workover system comprising:

a mast;

a main trolley mounted for vertical movement along the mast;

an elevator carried by the main trolley, the elevator comprising a shoulder engaging surface being moveable selectively to an operating mode and a relocating mode, the shoulder engaging surface engaging the upper shoulder when the elevator is in the operating mode, and the shoulder engaging surface being spaced apart from the upper shoulder when the elevator is in the relocating mode; and a hero valve carried by the main trolley, the hero valve being movable by the main trolley selectively to a clear position and a deployed position, the hero valve in the clear position being spaced apart from the tubular well string, and the hero valve in the deployed position engaging the tubular well string and obstructing the fluid passageway.

Although the invention is described with respect to a preferred embodiment, modifications thereto will be apparent to those of ordinary skill in the art. The scope of the invention, therefore, is to be determined by reference to the following claims:

The invention claimed is:

1. A method for removing a well string from within a well bore at a well site, wherein the well site includes a pumpjack with a walking beam and a horse head, the well bore defines a longitudinal centerline and the well string when assembled comprises a plurality of shafts interconnected end-to-end, the plurality of shafts includes at least an upper shaft having an upper shaft weight, a lower shaft having a lower shaft weight and a remaining well string below the lower shaft, the method involves the use of a wellhead slip at the well bore and a workover vehicle at the well site, the workover vehicle includes at least one of a tongs mechanism, a mast, a shaft storage area, a trolley track system, a main trolley with an elevator head, an upper trolley mechanism, a robotic system with an end effector, and a transfer track system, the workover method comprising:

leaving at least a portion of the pumpjack intact at the well site;

driving the workover vehicle to the well site;

parking the workover vehicle at the well site such that the longitudinal centerline is interposed between the workover vehicle and the portion of the pumpjack that is left intact at the well site, an imaginary vector pointing horizontally from the portion of the pumpjack that is left intact, passing through the longitudinal centerline toward the workover vehicle defines a forward direction and an imaginary horizontal line perpendicular to the forward direction defines a lateral direction;

the wellhead slip clamping onto the upper shaft and supporting most of the upper shaft weight and the lower shaft weight;

the elevator head capturing the upper shaft;

the wellhead slip releasing the upper shaft;

transferring most of the upper shaft weight and the lower shaft weight from the wellhead slip to the elevator head;

the main trolley traveling upward along the trolley track system, thereby raising the well string and lifting the upper shaft out from within the well bore at a first peak velocity;

the wellhead slip clamping onto the lower shaft;

the main trolley momentarily lowering the well string while the well head slip is clamping onto the lower shaft;

for a first period, the well head slip holding the lower shaft at a substantially constant elevation;

while the upper shaft is above the wellhead slip, transferring most of the upper shaft weight and the lower shaft weight from the elevator head to the wellhead slip;

the main trolley lowering the elevator head while the lower shaft is at the substantially constant elevation;

the upper trolley mechanism traveling along the trolley track system;

the upper trolley mechanism being at least partially above the elevator head and engaging the upper shaft;

the tongs mechanism unscrewing a first joint connecting the upper shaft to the lower shaft;

the main trolley lowering the elevator head while the tongs mechanism is unscrewing the first joint;

the end effector gripping the upper shaft while the upper trolley mechanism is above the end effector and while the elevator head is below the end effector;

after unscrewing the first joint and after gripping the upper shaft, the robotic system transferring the upper shaft from the longitudinal centerline of the well bore to the shaft storage area that is horizontally spaced apart from the longitudinal centerline, wherein the robotic system transferring the upper shaft from the longitudinal centerline of the well bore to the shaft storage area involves moving the upper shaft in translation in the forward direction and the lateral direction;

the end effector releasing the upper shaft at the shaft storage area;

the elevator head capturing the lower shaft;

the wellhead slip releasing the lower shaft, thereby transferring most of the lower shaft weight to the elevator head;

the main trolley lifting the remaining shaft string and thereby lifting the lower shaft out from within the well bore at a second peak velocity, wherein the second peak velocity is greater than the first peak velocity;

the wellhead slip clamping onto the remaining shaft string;

the main trolley momentarily lowering the lower shaft and the remaining shaft string while the well head slip is clamping onto the remaining shaft string;

for a second period, the well head slip holding the remaining shaft string at a substantially fixed elevation;

while the lower shaft is above the wellhead slip, transferring most of the lower shaft weight from the elevator head to the wellhead slip;

the main trolley lowering the elevator head while the remaining shaft string is at the substantially fixed elevation;

the upper trolley mechanism being at least partially above the elevator head and engaging the lower shaft;

the tongs mechanism unscrewing a second joint connecting the lower shaft to the remaining shaft string;

the main trolley lowering the elevator head while the tongs mechanism is unscrewing the second joint;

the end effector gripping the lower shaft while the upper trolley mechanism is above the end effector and while the elevator head is below the end effector;

after unscrewing the second joint and after gripping the lower shaft, the robotic system transferring the lower shaft from the longitudinal centerline of the well bore to the shaft storage area; and the end effector releasing the lower shaft at the shaft storage area.

2. The method of claim 1, further comprising:

the robotic system traveling along the transfer track system, wherein both the trolley track system and the transfer track system are attached to the mast, and the trolley track system is substantially parallel to the transfer track system.

3. The method of claim 1, wherein the robotic system includes an upper robot and a lower robot, and the method further comprising:

both the upper robot and the lower robot selectively engaging and releasing the upper shaft;

the upper robot selectively ascending and descending along the transfer track system;

the lower robot selectively ascending and descending along the transfer track system;

the upper robot traveling relative to the lower robot; and varying a vertical separation distance between the upper robot and the lower robot as a result of the upper robot traveling relative to the lower robot.

4. The method of claim 1, further comprising:

determining whether a predetermined clearance exists between the workover vehicle and the portion of the pumpjack left intact at the well site, wherein determining whether the predetermined clearance exists between the workover vehicle and the portion of the pumpjack left intact at the well site is performed by a sensor attached to the workover vehicle.

5. The method of claim 1, further comprising removing the horse head from the walking beam.

6. The method of claim 1, further comprising removing the walking beam from the portion of the pumpjack that is left intact at the well site.

7. The method of claim 1, wherein each of the upper shaft and the lower shaft is a tube.

8. The method of claim 1, wherein each of the upper shaft and the lower shaft is a sucker rod.

9. The method of claim 1, further comprising the main trolley lowering the elevator head while the robotic system is moving the end effector between the shaft storage area and the longitudinal centerline of the well bore.

10. A method for removing a well string from within a well bore at a well site; wherein the well site includes a pumpjack with a walking beam and a horse head; the well bore defines a longitudinal centerline and the well string when assembled comprises a plurality of shafts interconnected end-to-end; the plurality of shafts includes at least an upper shaft having an upper shaft weight, a lower shaft having a lower shaft weight and a remaining well string below the lower shaft; the method involves the use of a wellhead slip at the well bore and a workover vehicle at the well site; the workover vehicle includes at least one of a tongs mechanism, a mast, a shaft storage area, a trolley track system, a main trolley with an elevator head, an upper trolley mechanism, a transfer track system, and a robotic system comprising an upper robot, a lower robot and an end effector, the workover method comprising:

leaving at least a portion of the pumpjack intact at the well site;

driving the workover vehicle to the well site;

parking the workover vehicle at the well site such that the longitudinal centerline is interposed between the workover vehicle and the portion of the pumpjack that is left intact at the well site, an imaginary vector pointing horizontally from the portion of the pumpjack that is left intact, passing through the longitudinal centerline toward the workover vehicle defines a forward direction and an imaginary horizontal line perpendicular to the forward direction defines a lateral direction;

the wellhead slip clamping onto the upper shaft and supporting most of the upper shaft weight and the lower shaft weight;

the elevator head capturing the upper shaft;

the wellhead slip releasing the upper shaft;

transferring most of the upper shaft weight and the lower shaft weight from the wellhead slip to the elevator head;

the main trolley traveling upward along the trolley track system, thereby raising the well string and lifting the upper shaft out from within the well bore;

the wellhead slip clamping onto the lower shaft;

for a first period, the well head slip holding the lower shaft at a substantially constant elevation;

while the upper shaft is above the wellhead slip, transferring most of the upper shaft weight and the lower shaft weight from the elevator head to the wellhead slip;

the main trolley lowering the elevator head while the lower shaft is at the substantially constant elevation;

the upper trolley mechanism traveling along the trolley track system;

the upper trolley mechanism being at least partially above the elevator head and engaging the upper shaft;

the tongs mechanism unscrewing a first joint connecting the upper shaft to the lower shaft;

the main trolley lowering the elevator head while the tongs mechanism is unscrewing the first joint;

the end effector gripping the upper shaft while the upper trolley mechanism is above the end effector and while the elevator head is below the end effector;

after unscrewing the first joint and after gripping the upper shaft, the robotic system transferring the upper shaft from the longitudinal centerline of the well bore to the shaft storage area that is horizontally spaced apart from the longitudinal centerline;

the end effector releasing the upper shaft at the shaft storage area;

the main trolley lowering the elevator head while the robotic system is moving between the shaft storage area and the longitudinal centerline of the well bore;

the elevator head capturing the lower shaft;

the wellhead slip releasing the lower shaft, thereby transferring most of the lower shaft weight to the elevator head;

the main trolley lifting the remaining shaft string and thereby lifting the lower shaft out from within the well bore;

the wellhead slip clamping onto the remaining shaft string;

for a second period, the well head slip holding the remaining shaft string at a substantially fixed elevation;

while the lower shaft is above the wellhead slip, transferring most of the lower shaft weight from the elevator head to the wellhead slip;

the main trolley lowering the elevator head while the remaining shaft string is at the substantially fixed elevation;

the upper trolley mechanism extending above the elevator head and engaging the lower shaft;

the tongs mechanism unscrewing a second joint connecting the lower shaft to the remaining shaft string;

the main trolley lowering the elevator head while the tongs mechanism is unscrewing the second joint;

the end effector gripping the lower shaft while the upper trolley mechanism is above the end effector and while the elevator head is below the end effector;

after unscrewing the second joint and after gripping the lower shaft, the robotic system transferring the lower shaft from the longitudinal centerline of the well bore to the shaft storage area;

the end effector releasing the lower shaft at the shaft storage area;

the robotic system traveling along the transfer track system, wherein both the trolley track system and the transfer track system are attached to the mast, and the trolley track system is substantially parallel to the transfer track system;

both the upper robot and the lower robot selectively engaging and releasing the upper shaft;

the upper robot selectively ascending and descending along the transfer track system;

the lower robot selectively ascending and descending along the transfer track system;

the lower robot traveling relative to the upper robot;

varying a vertical separation distance between the upper robot and the lower robot as a result of the lower robot traveling relative to the upper robot; and removing the horse head from the pumpjack.

11. The method of claim 10, further comprising:

determining whether a predetermined clearance exists between the workover vehicle and the portion of the pumpjack left intact at the well site, wherein determining whether the predetermined clearance exists between the workover vehicle and the portion of the pumpjack left intact at the well site is performed by a sensor attached to the workover vehicle.

12. The method of claim 10, further comprising removing the walking beam from the portion of the pumpjack that is left intact at the well site.

13. The method of claim 10, wherein the robotic system transferring the upper shaft from the longitudinal centerline of the well bore to the shaft storage area involves moving the upper shaft in the forward direction and the lateral direction.

14. The method of claim 10, wherein the robotic system transferring the upper shaft from the longitudinal centerline of the well bore to the shaft storage area involves moving the upper shaft in translation in the forward direction and the lateral direction.

15. The method of claim 10, further comprising the main trolley lowering the elevator head while the robotic system is moving the end effector between the shaft storage area and the longitudinal centerline of the well bore.

16. A method for removing a well string from within a well bore at a well site; wherein the well site includes a pumpjack with a walking beam and a horse head; the well bore defines a longitudinal centerline and the well string when assembled comprises a plurality of shafts interconnected end-to-end; the plurality of shafts includes at least an upper shaft having an upper shaft weight, a lower shaft having a lower shaft weight and a remaining well string below the lower shaft; the method involves the use of a wellhead slip at the well bore and a workover vehicle at the well site; the workover vehicle includes at least one of a tongs mechanism, a mast, a shaft storage area, a trolley track system, a main trolley with an elevator head, an upper trolley mechanism, a transfer track system, and a robotic system comprising an upper robot, a lower robot and an end effector, the workover method comprising:

leaving at least a portion of the pumpjack intact at the well site;

driving the workover vehicle to the well site;

parking the workover vehicle at the well site such that the longitudinal centerline is interposed between the workover vehicle and the portion of the pumpjack that is left intact at the well site, an imaginary vector pointing horizontally from the portion of the pumpjack that is left intact, passing through the longitudinal centerline toward the workover vehicle defines a forward direction and an imaginary horizontal line perpendicular to the forward direction defines a lateral direction;

the wellhead slip clamping onto the upper shaft and supporting most of the upper shaft weight and the lower shaft weight;

the elevator head capturing the upper shaft;

the wellhead slip releasing the upper shaft;

transferring most of the upper shaft weight and the lower shaft weight from the wellhead slip to the elevator head;

the main trolley traveling upward along the trolley track system, thereby raising the well string and lifting the upper shaft out from within the well bore;

the wellhead slip clamping onto the lower shaft;

the main trolley momentarily lowering the well string while the well head slip is clamping onto the lower shaft;

for a first period, the well head slip holding the lower shaft at a substantially constant elevation;

while the upper shaft is above the wellhead slip, transferring most of the upper shaft weight and the lower shaft weight from the elevator head to the wellhead slip;

the main trolley lowering the elevator head while the lower shaft is at the substantially constant elevation;

the upper trolley mechanism traveling along the trolley track system;

the upper trolley mechanism being at least partially above the elevator head and engaging the upper shaft;

the tongs mechanism unscrewing a first joint connecting the upper shaft to the lower shaft;

the main trolley lowering the elevator head while the tongs mechanism is unscrewing the joint;

the end effector gripping the upper shaft while the upper trolley mechanism is above the end effector and while the elevator head is below the end effector;

after unscrewing the first joint and after gripping the upper shaft, the robotic system transferring the upper shaft from the longitudinal centerline of the well bore to the shaft storage area that is horizontally spaced apart from the longitudinal centerline, wherein the robotic system transferring the upper shaft from the longitudinal centerline of the well bore to the shaft storage area involves moving the upper shaft in translation in the forward direction and the lateral direction;

the end effector releasing the upper shaft at the shaft storage area;

the elevator head capturing the lower shaft;

the wellhead slip releasing the lower shaft, thereby transferring most of the lower shaft weight to the elevator head;

the main trolley lifting the remaining shaft string and thereby lifting the lower shaft out from within the well bore;

the wellhead slip clamping onto the remaining shaft string;

the main trolley momentarily lowering the lower shaft and the remaining shaft string while the well head slip is clamping onto the remaining shaft string;

for a second period, the well head slip holding the remaining shaft string at a substantially fixed elevation;

while the lower shaft is above the wellhead slip, transferring most of the lower shaft weight from the elevator head to the wellhead slip;

the main trolley lowering the elevator head while the remaining shaft string is at the substantially fixed elevation;

the upper trolley mechanism being at least partially above the elevator head and engaging the lower shaft;

the tongs mechanism unscrewing a second joint connecting the lower shaft to the remaining shaft string;

the main trolley lowering the elevator head while the tongs mechanism is unscrewing the second joint;

the end effector gripping the lower shaft while the upper trolley mechanism is above the end effector and while the elevator head is below the end effector;

after unscrewing the second joint and after gripping the lower shaft, the robotic system transferring the lower shaft from the longitudinal centerline of the well bore to the shaft storage area;

the end effector releasing the lower shaft at the shaft storage area;

the robotic system traveling along the transfer track system, wherein both the trolley track system and the transfer track system are attached to the mast, and the trolley track system is substantially parallel to the transfer track system;

both the upper robot and the lower robot selectively engaging and releasing the upper shaft;

the upper robot selectively ascending and descending along the transfer track system;

the lower robot selectively ascending and descending along the transfer track system;

the upper robot traveling relative to the lower robot;

varying a vertical separation distance between the upper robot and the lower robot as a result of the upper robot traveling relative to the lower robot; and removing the horse head from the pumpjack.

17. The method of claim 16, determining whether a predetermined clearance exists between the workover vehicle and the portion of the pumpjack left intact at the well site, wherein determining whether the predetermined clearance exists between the workover vehicle and the portion of the pumpjack left intact at the well site is performed by a sensor attached to the workover vehicle.

18. The method of claim 16, wherein the robotic system is moving the end effector between the shaft storage area and the longitudinal centerline of the well bore while the tongs system is unscrewing the first joint.

* * * * *